US009545662B2

(12) United States Patent
Anderson et al.

(10) Patent No.: US 9,545,662 B2
(45) Date of Patent: Jan. 17, 2017

(54) AUTOMATED VARIABLE DIMENSION MOLD AND BOTTOM BLOCK SYSTEM

(75) Inventors: Michael K. Anderson, Spokane, WA (US); Craig Shaber, Spokane Valley, WA (US); Steve Anderson, Farmington, WA (US); Brett Thielman, Spokane, WA (US); Mike Komicki, Spokane, WA (US)

(73) Assignee: Wagstaff, Inc., Spokane, WA (US)

( * ) Notice: Subject to any disclaimer, the term of this patent is extended or adjusted under 35 U.S.C. 154(b) by 0 days.

(21) Appl. No.: 13/416,933

(22) Filed: Mar. 9, 2012

(65) Prior Publication Data

US 2013/0233506 A1 Sep. 12, 2013

Related U.S. Application Data

(62) Division of application No. 11/895,272, filed on Aug. 23, 2007, now abandoned.

(51) Int. Cl.

| | |
|---|---|
| ***B22D 11/04*** | (2006.01) |
| ***B22D 11/05*** | (2006.01) |
| ***B22D 11/08*** | (2006.01) |
| ***B22D 11/041*** | (2006.01) |

(52) U.S. Cl.

CPC ..... *B22D 11/041* (2013.01); *B22D 11/05* (2013.01); *B22D 11/08* (2013.01)

(58) Field of Classification Search

CPC ..... B22D 11/041; B22D 11/049; B22D 11/05; B22D 11/06; B22D 11/08

USPC ..... 164/487, 491, 436, 444

See application file for complete search history.

(56) References Cited

U.S. PATENT DOCUMENTS

| | | | | |
|---|---|---|---|---|
| 4,134,441 | A * | 1/1979 | Ohmori et al. | 164/491 |
| 4,270,593 | A * | 6/1981 | Bachner | 164/491 |
| 4,505,321 | A * | 3/1985 | Zeller | 164/491 |
| 4,635,702 | A * | 1/1987 | Kolakowski et al. | 164/418 |
| 4,635,704 | A * | 1/1987 | Chielens et al. | 164/452 |
| 4,727,926 | A * | 3/1988 | Tsutsumi et al. | 164/436 |
| 4,909,305 | A * | 3/1990 | Fasano | 164/459 |
| 5,201,361 | A * | 4/1993 | Grove et al. | 164/459 |
| 5,947,183 | A * | 9/1999 | Schneider et al. | 164/425 |
| 6,408,930 | B1 * | 6/2002 | von Wyl et al. | 164/436 |

* cited by examiner

*Primary Examiner* — Kevin P Kerns
(74) *Attorney, Agent, or Firm* — Wells St. John, P.S.

(57) ABSTRACT

A molten metal mold and bottom block system, including apparatus and method embodiments, which may include a mold cavity framework with a first side, a second side opposite the first side, a third side, and a fourth side opposite the third side, each side including an inner surface and the inner surfaces defining a mold cavity, and wherein one or more of the sides are movably mounted relative to the second side, and are controllably moved during the casting. This system may also include embodiments wherein the castpart produced has a tapered form at one or both of the castpart ends. Aspects of this invention may be considered to be a castpart shrinkage management system or a castpart form or profile control system due to the advantage of increased controls of castpart form during the casting process.

20 Claims, 43 Drawing Sheets

AUTOMATED VARIABLE DIMENSION MOLD AND BOTTOM BLOCK SYSTEM

CROSS REFERENCE TO RELATED APPLICATION

This is a divisional of U.S. patent application Ser. No. 11/895,272, filed Aug. 23, 2007, now abandoned, which is co-pending, and from which this application claims priority.

TECHNICAL FIELD

This invention pertains to an automated variable dimension mold and bottom block system, resulting in a desired castpart taper or configuration.

BACKGROUND OF THE INVENTION

Metal ingots, billets and other castparts may be formed by a casting process which utilizes a vertically oriented mold situated above a large casting pit beneath the floor level of the metal casting facility, although this invention may also be utilized in horizontal molds. The lower component of the vertical casting mold is a starting block. When the casting process begins, the starting blocks are in their upward-most position and in the molds. As molten metal is poured into the mold bore or cavity and cooled (typically by water), the starting block is slowly lowered at a pre-determined rate by a hydraulic cylinder or other device. As the starting block is lowered, solidified metal or aluminum emerges from the bottom of the mold and ingots, rounds or billets of various geometries are formed, which may also be referred to herein as castparts.

While the invention applies to the casting of metals in general, including without limitation, aluminum, brass, lead, zinc, magnesium, copper, steel, etc., the examples given and preferred embodiment disclosed may be directed to aluminum, and therefore the term aluminum or molten metal may be used throughout for consistency even though the invention applies more generally to metals.

While there are numerous ways to achieve and configure a vertical casting arrangement, FIG. 1 illustrates one example. In FIG. 1, the vertical casting of aluminum generally occurs beneath the elevation level of the factory floor in a casting pit. Directly beneath the casting pit floor 101*a* is a caisson 103, in which the hydraulic cylinder barrel 102 for the hydraulic cylinder is placed.

As shown in FIG. 1, the components of the lower portion of a typical vertical aluminum casting apparatus, shown within a casting pit 101 and a caisson 103, are a hydraulic cylinder barrel 102, a ram 106, a mounting base housing 105, a platen 107 and a bottom block 108 (also referred to as a starting head or starting block base), all shown at elevations below the casting facility floor 104.

The mounting base housing 105 is mounted to the floor 101*a* of the casting pit 101, below which is the caisson 103. The caisson 103 is defined by its side walls 103*b* and its floor 103*a*.

A typical mold table assembly 110 is also shown in FIG. 1, which can be tilted as shown by hydraulic cylinder 111 pushing mold table tilt arm 110*a* such that it pivots about point 112 and thereby raises and rotates the main casting frame assembly, as shown in FIG. 1. There are also mold table carriages which allow the mold table assemblies to be moved to and from the casting position above the casting pit.

FIG. 1 further shows the platen 107 and starting block base 108 partially descended into the casting pit 101 with castpart 113 (which may be an ingot or a billet being partially formed. Castpart 113 is on the starting block base 108, which may include a starting head, or bottom block, which usually (but not always) sits on the starting block base 108, all of which is known in the art and need not therefore be shown or described in greater detail. While the term starting block is used for item 108, it should be noted that the terms bottom block and starting head are also used in the industry to refer to item 108, bottom block is typically used when an ingot is being cast and starting head when a billet is being cast.

While the starting block base 108 in FIG. 1 only shows one starting block 108 and pedestal, there are typically several of each mounted on each starting block base, which simultaneously cast billets, special tapers or configurations, or ingots as the starting block is lowered during the casting process.

When hydraulic fluid is introduced into the hydraulic cylinder at sufficient pressure, the ram 106, and consequently the starting block 108, are raised to the desired elevation start level for the casting process, which is when the starting blocks are within the mold table assembly 110.

The lowering of the starting block 108 is accomplished by metering the hydraulic fluid from the cylinder at a pre-determined rate, thereby lowering the ram 106 and consequently the starting block at a pre-determined and controlled rate. The mold is controllably cooled during the process to assist in the solidification of the emerging ingots or billets, typically using water cooling means.

There are numerous mold and casting technologies that fit into mold tables, and no one in particular is required to practice the various embodiments of this invention, since they are known by those of ordinary skill in the art.

The upper side of the typical mold table operatively connects to, or interacts with, the metal distribution system. The typical mold table also operatively connects to the molds which it houses.

When metal is cast using a continuous cast vertical mold, the molten metal is cooled in the mold and continuously emerges from the lower end of the mold as the starting block base is lowered. The emerging billet, ingot or other configuration is intended to be sufficiently solidified such that it maintains its desired profile, taper or other desired configuration. There is an air gap between the emerging solidified metal and the permeable ring wall. Below that, there is also a mold air cavity between the emerging solidified metal and the lower portion of the mold and related equipment.

Once casting is complete, the castpart, an ingot in this example, is removed from the bottom block. FIG. 1A illustrates an exemplary bottom block configuration with a castpart 113 being removed from the bottom block 108 after casting. FIG. 1A illustrates a bottom block 108 with a particular shape or configuration in the internal cavity which receives the initial flow of molten metal during the casting process, and the outer perimeter of the castpart 113 once solidified takes that shape.

FIG. 1A illustrates sloped portions 115 & 116, and indented portion 119 on castpart 113. Sloped portions 115 & 116 generally correspond to bottom block indentations 117 & 114 in shape and configuration, and with some variance generally related to shrinkage or other casting factors. Bottom block protrusion 118 corresponds in shape and configuration to Castparts indentation 119, all as can be seen in FIG. 1A. The sloped portions 115 & 116 in prior art ingots have been different angles, such as thirty degrees, forty-five degrees, and sixty degrees.

FIG. 1B is an elevation cross sectional view of a prior art mold wall 142 with casting surface 142*a*, castpart 141, mold framework 143, coolant chamber 149, coolant impact zone 146 where the coolant (typically water) hits and cools the castpart 141. Embodiments of this invention may be applied to prior art of all types, including the mold configuration illustrated in FIG. 1B.

In conventional casting and direct chill casting processes for rolling ingot, an ingot goes through a substantial transformation process during rolling. Ingot may be rolled into plate, can stock, aluminum foil and other products of differing dimensions and thicknesses by a process which sends the ingot through a series of rollers repetitively, with the rollers being sequentially moved closer together. This rolling equipment may be referred to as a rolling stand.

One of the problems associated with this process is that a portion of the rolling ingot is wasted due to a phenomenon sometimes referred to as alligatoring. Alligatoring occurs during the rolling process when metal from the main body of the ingot gets rolled and pushed over the end of the ingot on the head and the butt sides. When the ingot is observed in this condition from the side view the head and the butt resemble the mouth of an alligator, which is where the term alligatoring originated. Alligatoring is illustrated in FIG. 9. During the rolling process, the ends of the ingots which exhibit alligatoring are cut off, thereby resulting in a substantial amount of waste of aluminum which must be reheated and re-cast, in addition to the expense of doing so.

In some prior art, it has been shown that by producing an angle with a tapered head and butt, alligatoring may be reduced or eliminated.

It is an object of some embodiments of this invention to provide an automated variable dimensioned mold casting and bottom block system which provides tapered and other configurations of castparts.

It is an object of some embodiments of this invention to provide an automated variable dimensioned mold casting system which reduces end crop losses.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical, and preferred embodiment being illustrated in the accompanying drawings, as required.

BRIEF DESCRIPTION OF THE DRAWINGS

Preferred embodiments of the invention are described below with reference to the following accompanying drawings.

FIG. 4 is a cross-sectional top schematic view of an embodiment of a perimeter wall of the mold, illustrating potential directions of movement of sidewalls;

FIG. 5 is a top view of one embodiment of a mold casting system contemplated by this invention, wherein two of the perimeter walls are movable;

FIG. 6 is a top view of one embodiment of a mold casting system contemplated by this invention, wherein two of the end perimeter walls are movable;

FIG. 10 is a schematic representation of one embodiment of an automated variable dimension mold and bottom block system, wherein the bottom block is wider than the starting position or width of the movable walls;

FIG. 36 is a schematic elevation representation of one configuration of mold walls or casting surfaces that may be utilized in some aspects of this invention, illustrating a top and a bottom beveled surface area on each mold wall;

FIG. 37A is a schematic elevation representation of one configuration of mold walls or casting surfaces that may be utilized in some aspects of this invention, illustrating two top and two bottom beveled surface areas on each mold wall;

FIG. 37B is a schematic elevation representation of one configuration of mold walls or casting surfaces that may be utilized in some aspects of this invention, illustrating a top and a bottom beveled surface area on each mold wall, with each beveled area combined with a curved or arcuate surface area;

FIG. 37C is a schematic elevation representation of one configuration of mold walls or casting surfaces that may be utilized in some aspects of this invention, illustrating a top and a bottom curved or arcuate surface area on each mold wall;

DETAILED DESCRIPTION OF THE PREFERRED EMBODIMENTS

Figure 1:
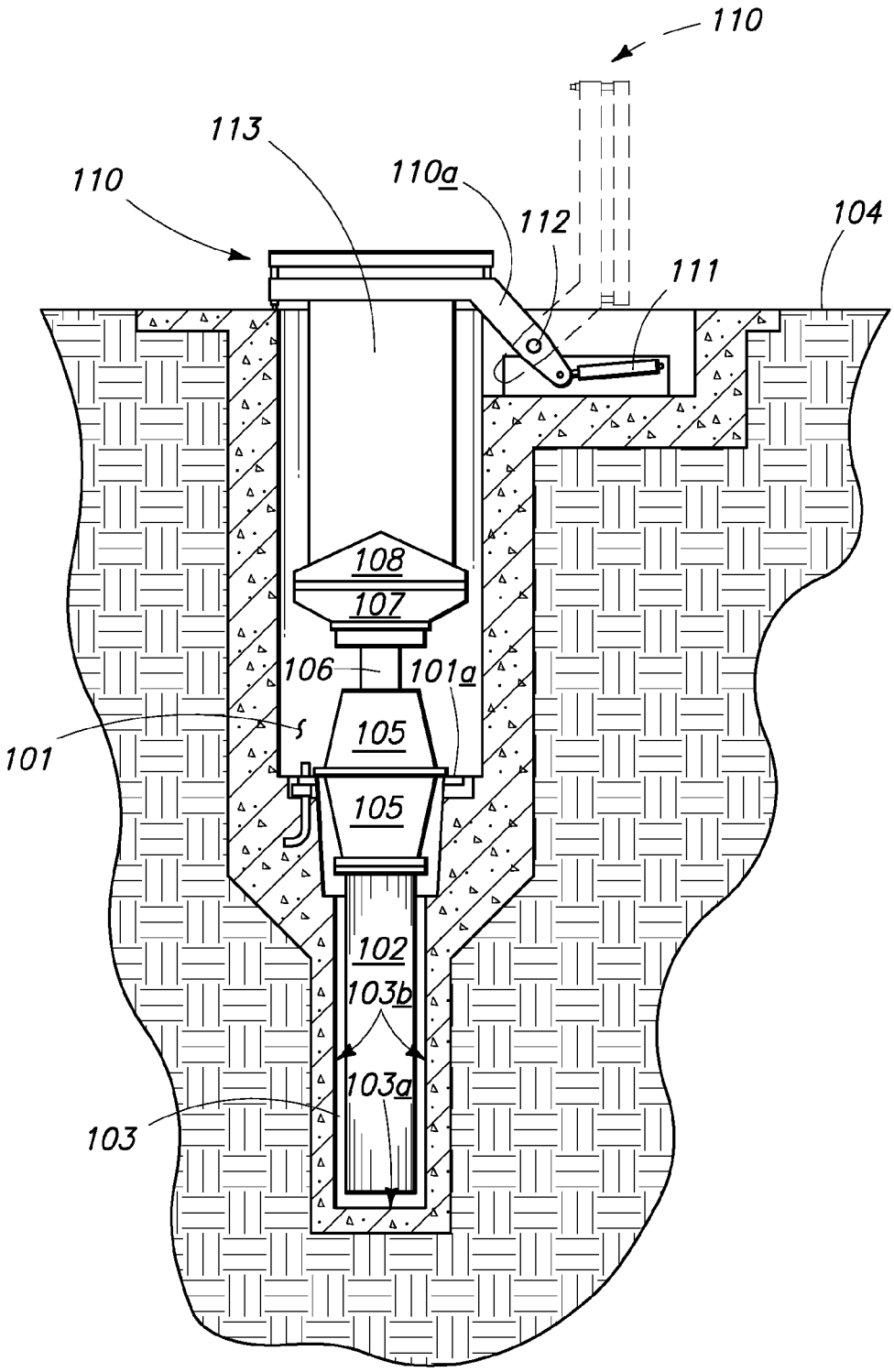
Fig 1 PRIOR ART
FIG. 1 is an elevation view of a prior art vertical casting pit, caisson and metal casting apparatus.

Many of the fastening, connection, manufacturing and other means and components utilized in this invention are widely known and used in the field of the invention described, and their exact nature or type is not necessary for an understanding and use of the invention by a person skilled in the art or science; therefore, they will not be discussed in significant detail. Furthermore, the various components shown or described herein for any specific application of this invention can be varied or altered as anticipated by this invention and the practice of a specific application or embodiment of any element may already be widely known or used in the art or by, persons skilled in the art or science; therefore, each will not be discussed in significant detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

It is to be understood that this invention applies to and can be utilized in connection with various types of metal casting and pour technologies and configurations, including but not limited to both hot top technology and conventional pour technology. The mold therefore should be able to receive molten metal from a source of molten metal, whatever the particular source type is. The mold cavities in the mold should therefore be oriented in fluid or molten metal receiving position relative to the source of molten metal.

Aspects of this invention control the dimensions of the head and butt of ingots through an automated variable dimension mold and bottom block system. In some embodiments of this invention for example, the two rolling face sides of the mold would move in and out relative to each other, thereby providing tapering of the ingot. The bottom block may be narrower in thickness than the nominal thickness of the ingot, and at the beginning of the cast, the mold sides may be positioned inward towards the center of the ingot and adjacent to the sides of the bottom block. At the start of the cast, the sides of the mold would be gradually moved outward at a rate that would form the desired dimensions on the butt of the ingot, resulting in any one of a number of different desired forms depending upon the application. Once the ingot dimensions reach the desired nominal ingot thickness for rolling, the mold walls would be held constant in position. Then, at the end of the cast, the mold walls will gradually be moved in until the head of the ingot (the top portion) has reached the desired dimensions, at which time the cast would be completed. It will be appreciated by those of ordinary skill in the art that the ingot top portion is sometimes referred to as the head of the ingot, and the bottom portion of the ingot sometimes referred to as the ingot butt, or butt of the ingot, as the ingot is in the vertical casting position.

Aspects of this invention also contemplate a process which may be utilized in some embodiments of this invention which include controlling cast variables such as the metal level control, cast speed and the rate at which the sides of the mold are moved.

During casting, there may be three phases which are considered for control to produce a more desirable castpart, namely startup casting, steady state casting and ending casting, with steady state casting being that between startup and ending casting. Different control parameters may be desired for each of these phases of casting, and more phases may be introduced to divide any one or more of these into sub-phases, depending on the desired castpart results.

The shape of the mold face may also play a role in the process in some embodiments of this invention. For instance, at the beginning of the cast when the mold walls are moved outward from the center of the ingot, the metal level may be kept above a certain level relative to the mold or mold walls. Then, near the end of the cast, when the mold sides are brought back inward towards the center of the ingot, the metal level may be dropped to a lower level between certain points which are within a certain range between the mold walls, with a specific angle of the mold walls. The angle of the mold walls may also be dependent on the cast speed and the rate at which the mold walls are moved in. This may also be done where the design of the mold is such that the angle between points on the mold wall is essentially equal to the angle of the desired castpart.

Ingot castparts may come in any one of a number of different lengths, widths and configurations, generally ranging from fifteen feet to twenty five feet in length. The cross-sectional dimensions of a twenty foot long ingot may for instance be thirty inches by seventy two inches, or alternatively may be twenty inches by sixty inches.

It is also believed that a deeper bottom block may assist in reducing or eliminating liquations and bleeds of the castpart so that the castpart may be able to support its own form by the time the bottom block emerges below the mold walls. Generally prior art includes configurations wherein the bottom block was wider than the mold cavity and could not be extended into the mold cavity. Aspects of this invention on the other hand allow for the bottom block to be inserted into the mold cavity which allows more time for the molten metal to remain and cool within the bottom block before additional weight from additional casting is placed on that initial metal, which allows that lower part of the solidifying castpart to better support the form of the ingot as a whole via solidification. In other aspects of the invention, external or internal cooling within the bottom block may assist this support.

There is a secondary benefit to engaging the block through the mold, and that is because clearance between the spout and block is maintained at normal industry standards. Another such benefit is preventing massive oxidation, which is made possible with movable mold walls which seal or reduce the mold to gap sufficiently to prevent bleed-outs when the block passes through the mold and metal rolls over the starting block rim contacting the mold.

It will be appreciated by those of ordinary skill in the art that the term bottom block may also be referred to as a starting head, dummy block, stool cap, or a starting block, all commonly used in the industry to refer to the same general components.

While others have recognized the problem and attempted to taper or configure the castparts or ingots in more desirable ways, they have done so by machining or cutting the castpart after it is molded and solidified, which is a more costly and time-consuming procedure which still results in an undesirable amount of metal which must be scrapped, re-melted and then recast. Other have also attempted to taper the castpart(s) by casting into starting heads with angles greater than thirty degrees, which only affects the bottom portion of the castpart. This invention on the other hand allows forming or configuring castparts at both the top and bottom end during the molding process, without the need to machine the castpart thereafter.

FIG. 1 is an elevation view of a typical prior art vertical casting pit, caisson and metal casting apparatus, and is described in more detail above.

Figure 2:
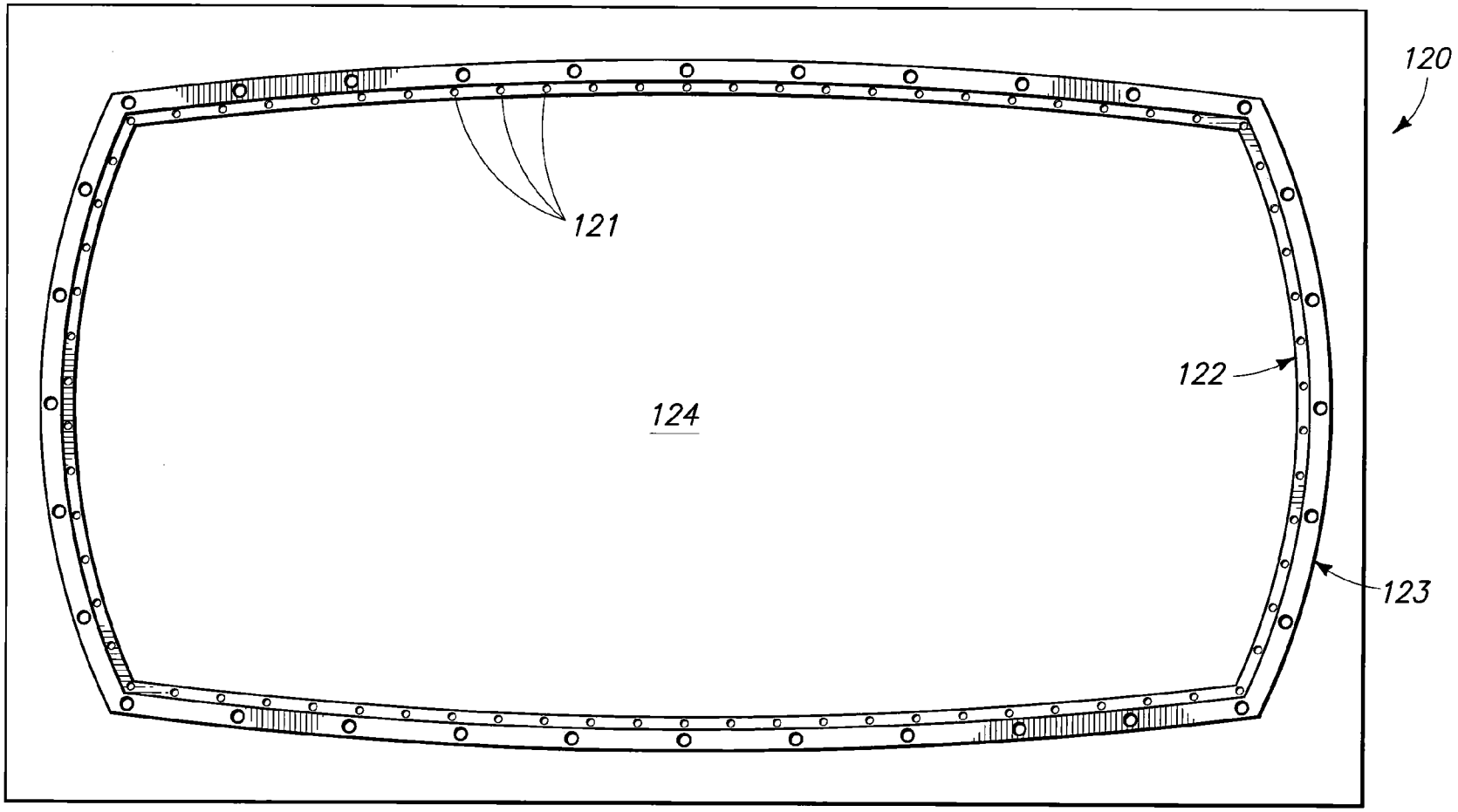
FIG 2 PRIOR ART
FIG. 2 is a cross-sectional schematic top view of a typical fixed prior art mold casting.

FIG. 2 is a cross-sectional schematic top view of a typical fixed or static prior art mold casting perimeter wall 120, including outer surface 123, inner perimeter wall surface 122, mold cavity 124 and a plurality of lubricant delivery apertures 121.

Figure 3:
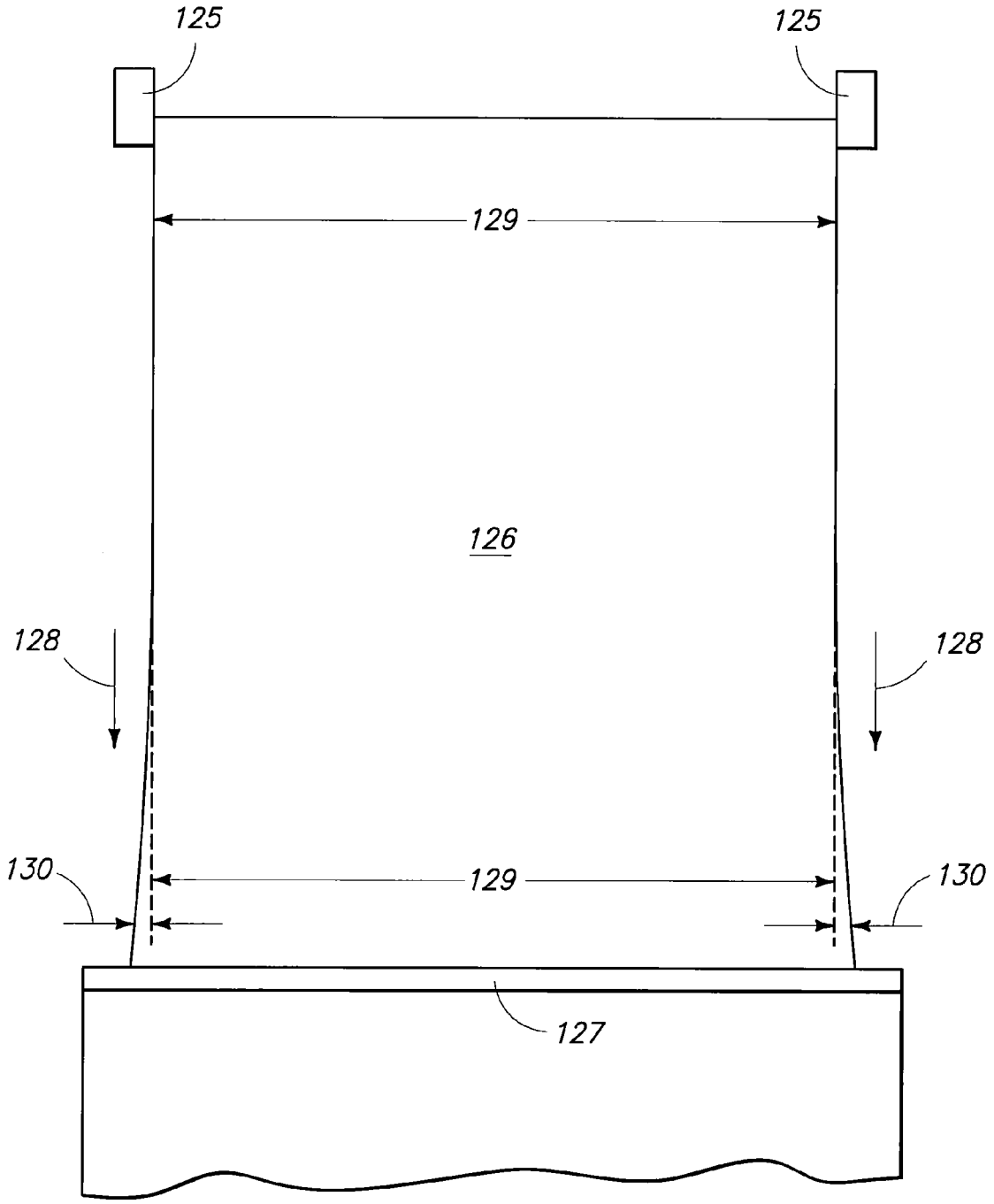
FIG. 3 is an elevation schematic representation of the bottom portion of a castpart expanding in a horizontal direction during the casting process.

FIG. 3 is an elevation schematic elevation representation of the bottom portion of a castpart 126 thickness in a horizontal direction during the casting process. FIG. 3 shows mold walls 125, mold opening 129, castpart 126, with downward arrows 128 showing the movement of the castpart downwardly. Starting block 127 is shown and butt swell distance 130 is shown to illustrate the thicker portion at the bottom of the castpart 126. Generally the bottom portion may be thicker because there may be more shrinkage in the middle portion of the castpart, and less shrinkage at the bottom portion.

The bottom portion of the castpart is sometimes referred to as the butt or butt portion of the castpart, and it tends to be thicker, which is sometimes referred to as "butt swell". The illustration of butt swell may be exaggerated in FIG. 3 for illustrative purposes and the specific amount of swell depends upon numerous parameters in the molding process, which are generally known by those of ordinary skill in the art. It will be appreciated by those of ordinary skill in the art the significant amount of time and money that is spent to remove butt swell from the castpart, requiring that metal be sent to scrap and requiring substantial expense in the process.

FIG. 4 is a cross-sectional top schematic view of an embodiment of a perimeter wall 140 of an aspect of a mold system contemplated by this invention, illustrating potential directions of movement of the mold wall or mold sidewalls. FIG. 4 illustrates the mold side walls 141, mold cavity 143, mold end walls 142, with arrows 144 indicating the potential movement of sidewalls 141, and arrows 145 indicating the potential movement of end walls 142.

FIG. 5 is a top view of one embodiment of a mold casting system 160 contemplated by this invention, wherein two of the rigid perimeter walls, a first side and a second side, are movable. FIG. 5 shows inner surface 163 of sidewalls of the mold and inner surfaces 164 of the perimeter wall with the mold cavity 162 in the center. Framework 161 may be any one of a number of different frameworks generally.

It will be appreciated by those of ordinary skill in the art how the castpart form or configuration can be manipulated by adjusting one or more of the cast parameters in combination with the movable walls, parameters such as cast speed, cast length, metal level, vertical height of castparts, rate of movement of the mold walls inward or outward, as the case may be, as well as other cast parameters. It will further be appreciated that aspects of the mold system disclosed by this invention may create any one of a number of different forms and configurations of castparts, including substantially linear sides, arcuate, convex and concave head and butt sections such that any slice is generally rectangular in shape. Due to the number of potential objectives and variables for a given casting, no one set of parameters is desired for this invention, but instead this invention provides and additional casting control system with additional parameters, to work toward the optimization of the resulting castparts.

It will be appreciated that the movement of the mold walls may mechanically be accomplished in any one of a number of different ways, such as by motors causing the movement. A motor operatively connected to a first side wall of a mold framework may for example be controlled by a servo drive, which may be controlled by a programmable logic controller ("PLC"), which may be controlled or configured via a human machine interface ("HMI"). It will be noted that other types of mechanical drives and controls may be utilized within the contemplation of this invention.

FIG. 6 is a top view of one embodiment of a mold casting system 160 contemplated by this invention, wherein two of the end perimeter walls, a third side and a fourth side, are movable. FIG. 6 illustrates framework 161, inner surface 164 of end wall, inner surface 163 of sidewalls, mold cavity 162, wherein end walls moved to the positions shown by hidden lines identified as inner surface 164 of end walls of the perimeter wall.

Figure 1A:
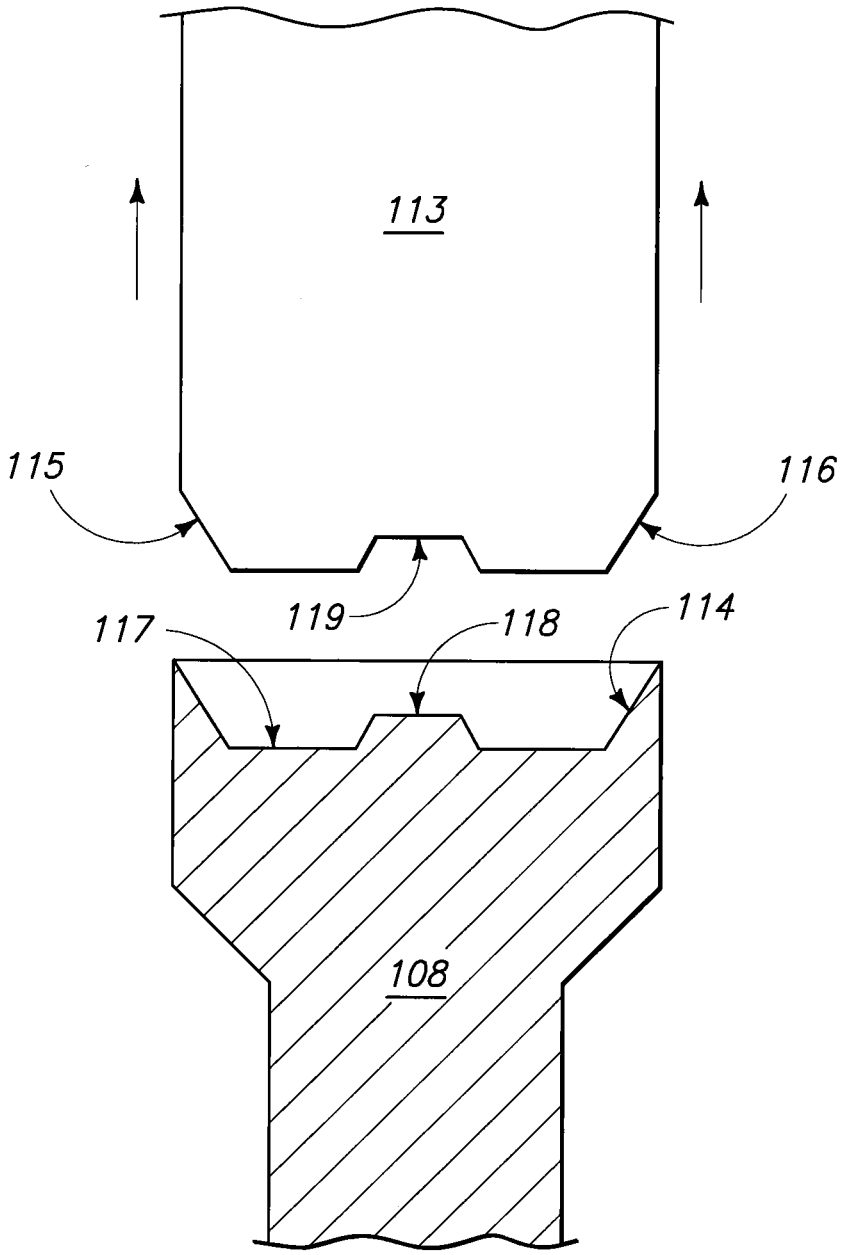
FIG 1A PRIOR ART
FIG. 1A is an elevation view of a particularly shaped prior art bottom block and corresponding castpart being removed therefrom.
Figure 1B:
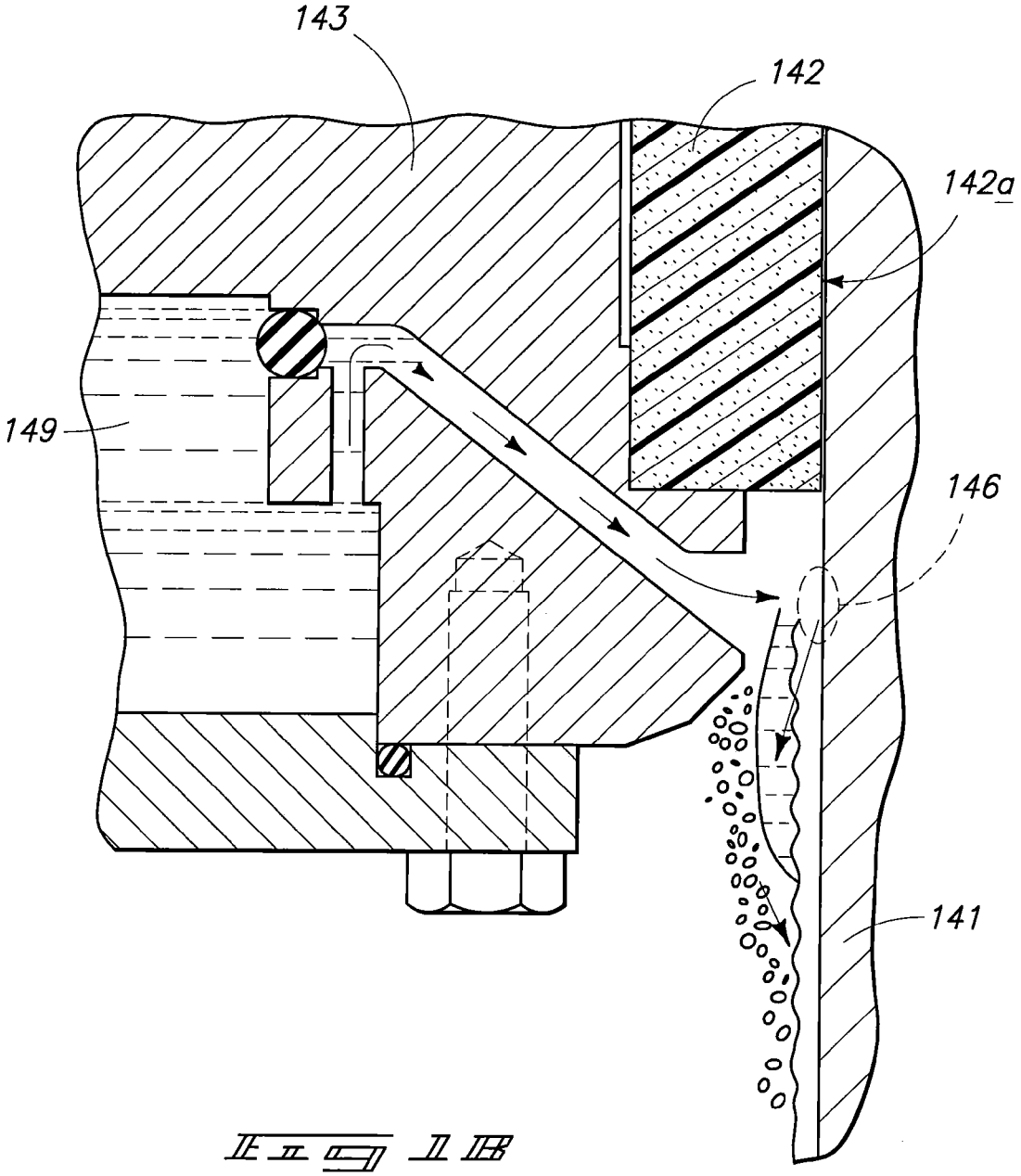
FIG 1B PRIOR ART
FIG. 1B is an elevation cross sectional view of a prior art mold wall or casting surface cooling and interfacing with a castpart.
Figure 7:
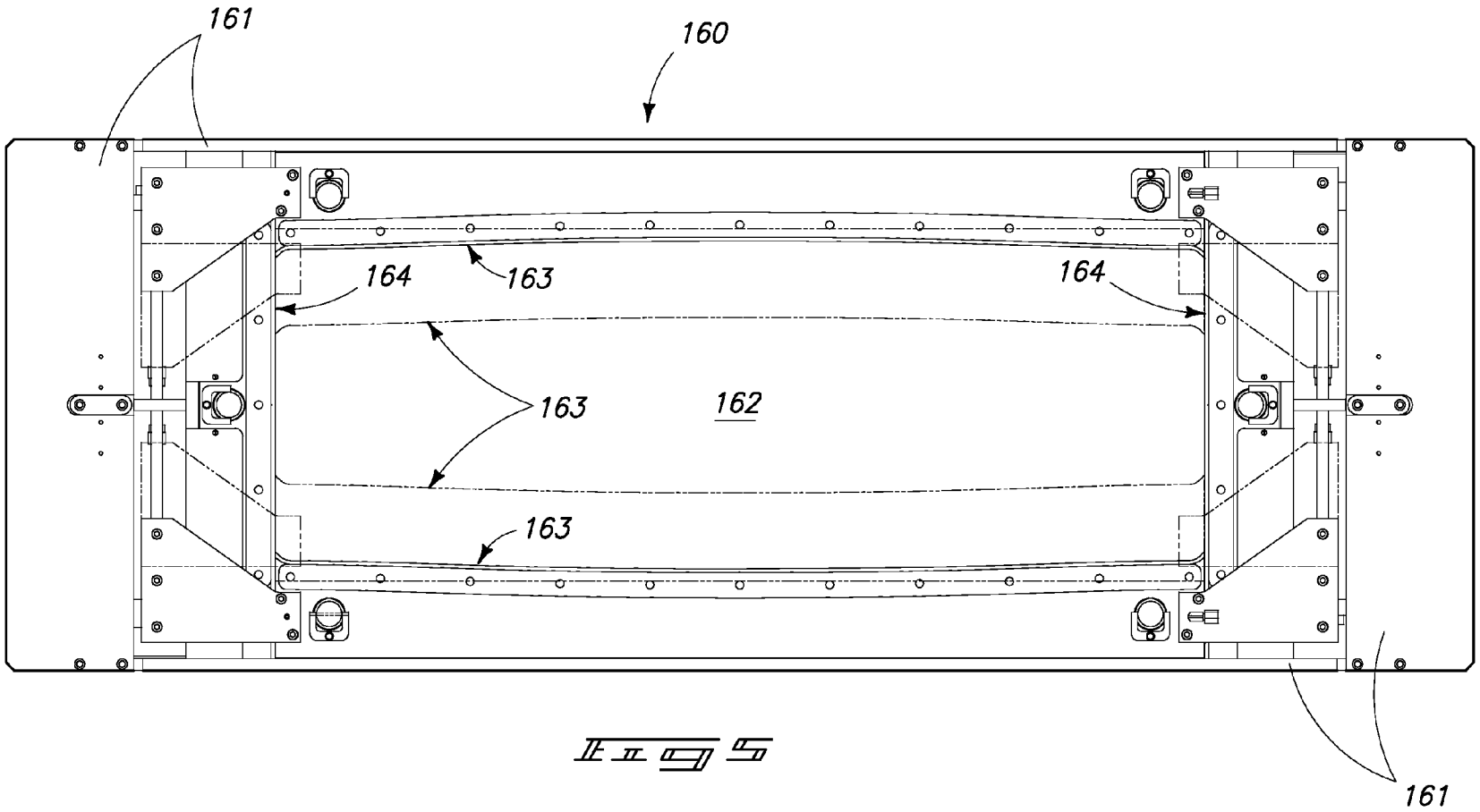
FIG. 7 is a representative elevation view of one example of an ingot which may be produced as a product of embodiments of this invention, illustrating tapering at the top and bottom portions of the ingot.
Figure 11:
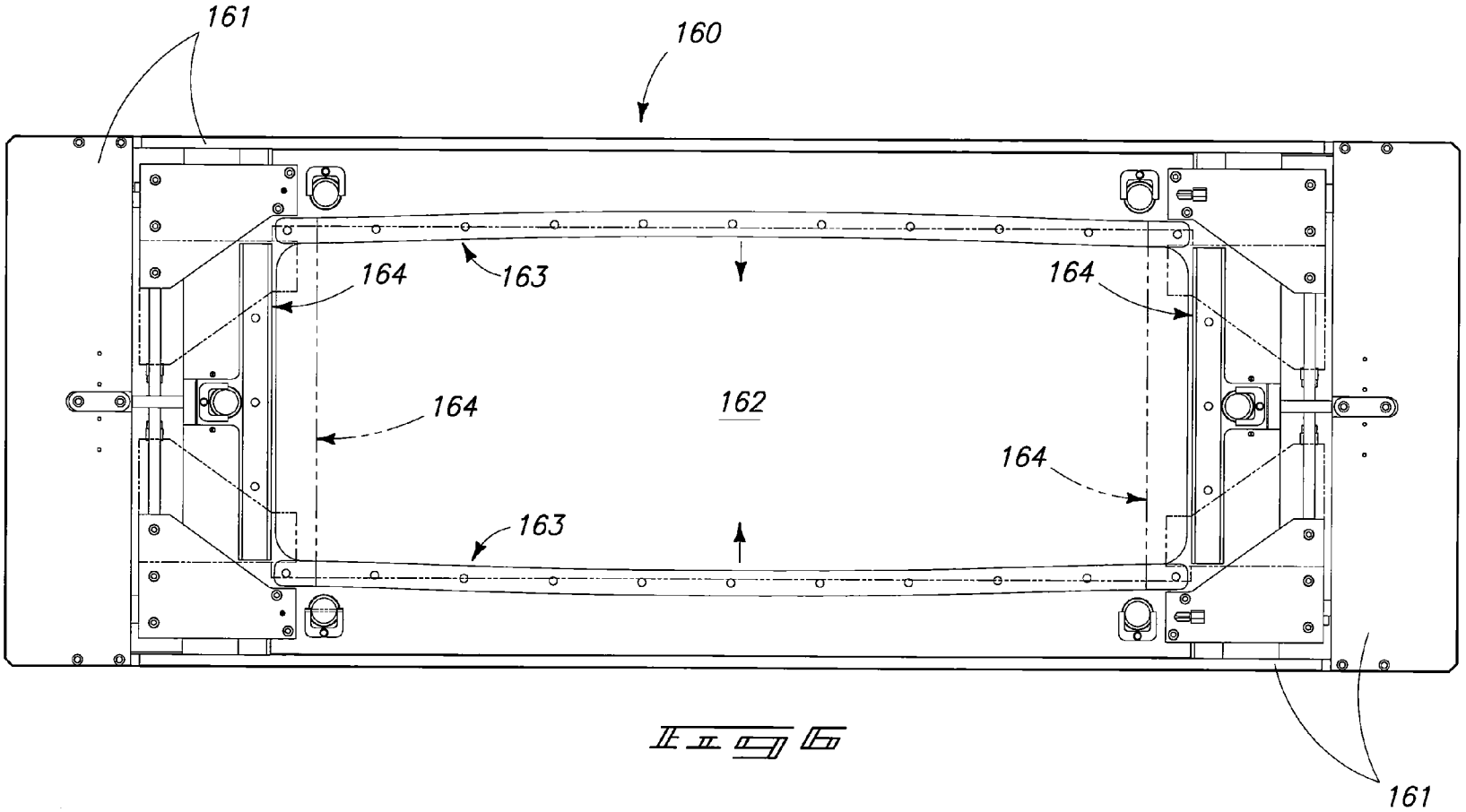
Figure 7:
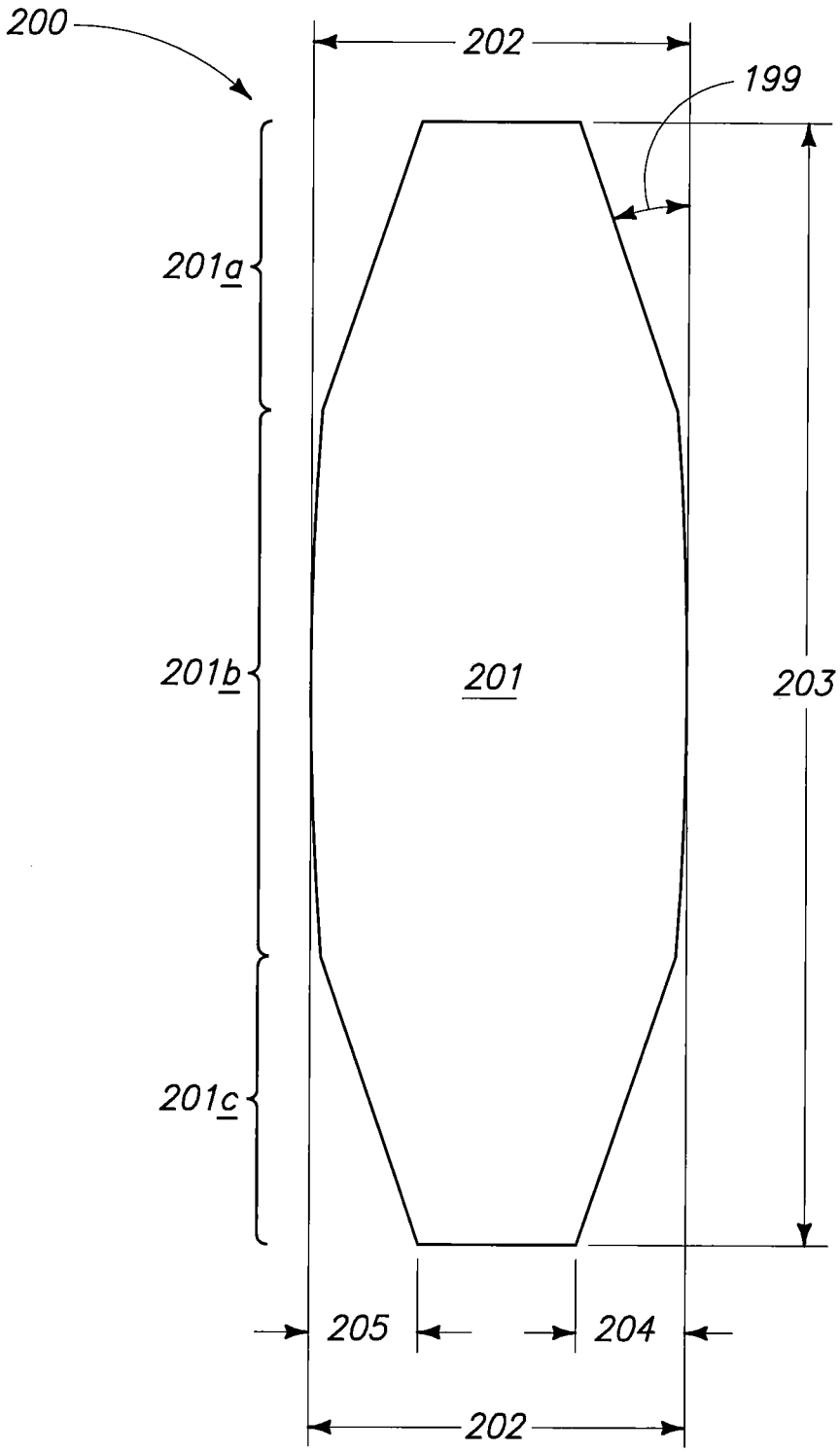

FIG. 7 is a representative elevation view of one example of an ingot 201 which may be produced as a product of embodiments of this invention, illustrating tapering at the top and bottom portions of the ingot 201. FIG. 7 illustrates a potential resulting form or configuration of a castpart 200, with width 202, height 203, with arrows 204 and 205 representing the lineal distance for the arcuate portion of castpart 201, which may also be an angled portion. FIG. 7 shows a top portion 201*a*, a middle portion 201*b* and a bottom or lower portion 201*c*, of castpart 201. It will be noted that with embodiments of this invention, the form of the top, middle or lower portions may be cast as desired in a controlled way and the top portion 201*a* may be configured and angled differently than the bottom portion 201*c*, including by a different method or apparatus. For instance the bottom portion may be formed by a particularly configured bottom block internal cavity as illustrated in FIG. 1A while the top portion 201*a* may be configured utilizing the embodiments of this invention which for instance utilize moving walls.

FIG. 7 also illustrates angle 199 on the rolling surface of the castpart. While angle 199 may be any angle within the contemplation of this invention, in some embodiments it is preferred that angle 199 be between twenty-one degrees and twenty-nine degrees, such as at twenty-six degrees. While numerous factors may affect the preferred angle 199 for a castpart 201 to be later rolled, in some applications of this invention twenty-six degrees may be preferred. FIG. 7 also illustrates how a castpart it may be treated differently in different sections or portions and FIG. 7 in particular shows three portions, a top portion 201*a*, a middle portion 201*b* and a lower portion 201*c*. For cast management and control, it will be appreciated by those of ordinary skill in the art that the castpart 201 may be theoretically divided into any one of a number of different portions in order to achieve the desired resulting castpart, with no one in particular being required to practice the invention.

While prior attempts to affect the shape of the ingots have taught away from this method (i.e. post-casting trimming of the castpart, shaping the bottom block), this invention has the advantage of being able to form the desired castpart as desired, such as by tapering both the top portion and the bottom portion of the castpart.

Figure 8:
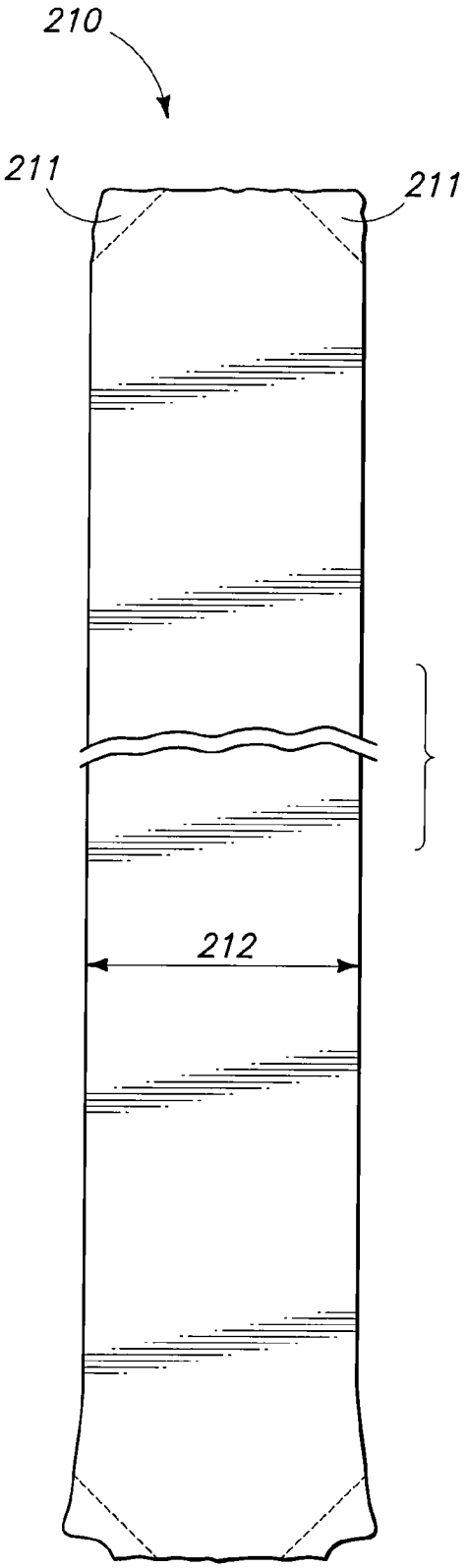
FIG. 8 is an elevation view of a typical castpart ingot, with some shrinkage and associated cracking shown in the corners.

FIG. 8 is an elevation view of a typical castpart ingot, with some shrinkage and butt swell. FIG. 8 illustrates castpart 210, corners 211, with castpart thickness 212.

Figure 9:
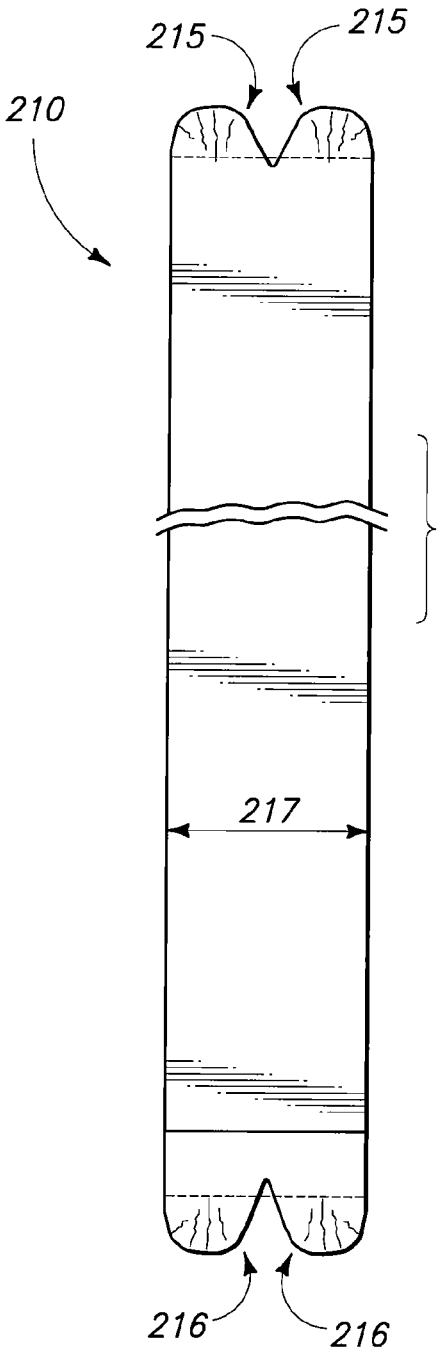
FIG. 9 is an elevation view of the ends of an ingot such as that shown in FIG. 8, after rolling operations, and generally illustrating alligatoring.
Figure 11:
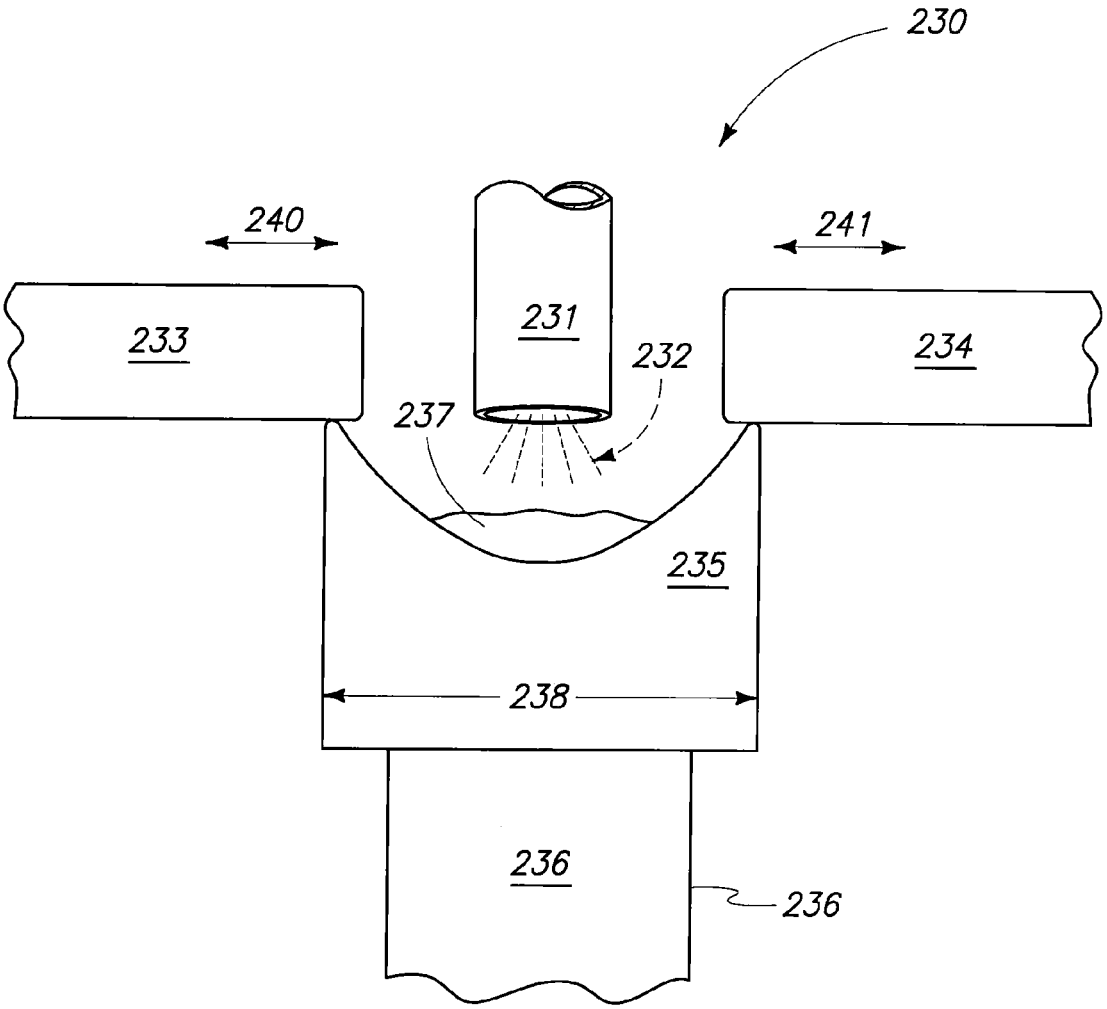
Figure 11:
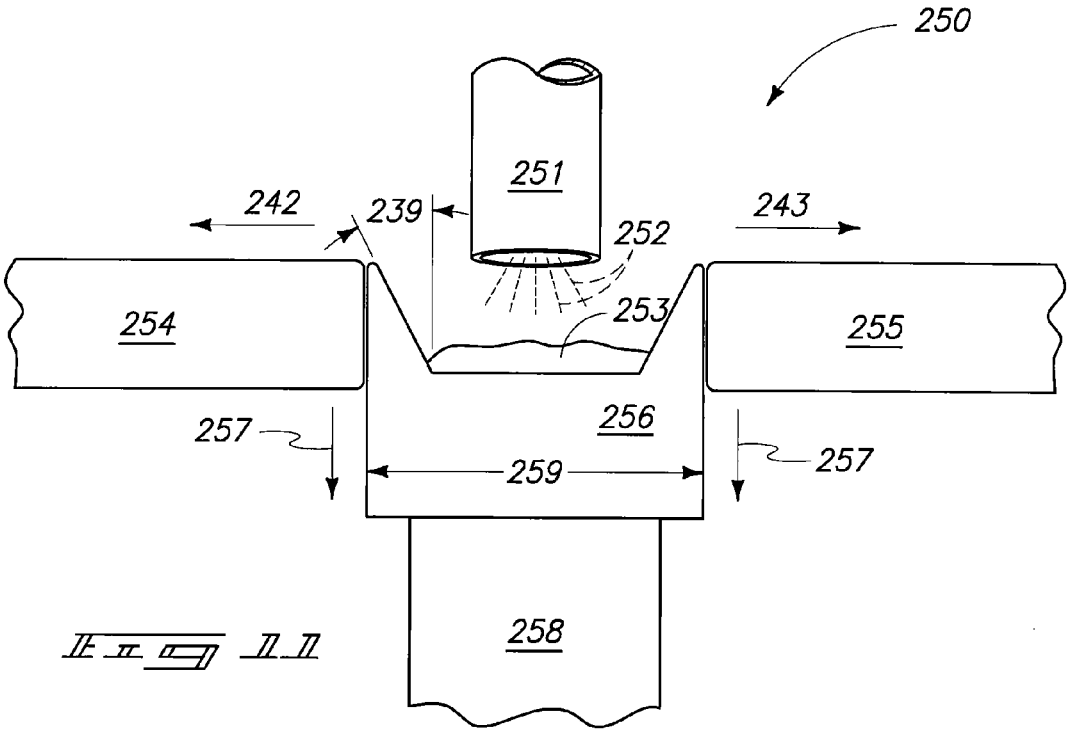

FIG. 9 is an elevation view of the ends of an ingot 210 such as that shown in FIG. 8, after having been rolled, and generally illustrating alligatoring. FIG. 9 illustrates castpart width 217, alligatoring 216 and 215 at opposing ends of castpart 210. It is generally known by those of ordinary skill in the art that alligatoring is an unwanted and undesirable result of rolling.

FIG. 10 is a schematic elevation representation of one embodiment of an automated variable dimension mold and bottom block system 230, wherein the bottom block 235 is wider than the starting position or width of the movable walls. FIG. 10 illustrates spout 231, movable walls 233 and 234, starting block 235, molten metal 237 delivered by spout 231 via metal flow 232. Starting block 235 in this aspect of the invention is a width 238 with drive cylinder 236 providing the lowering of the castpart during casting. Arrows 240 and 241 illustrate the respective movement of mold walls 233 and 234, respectively.

Figure 11:
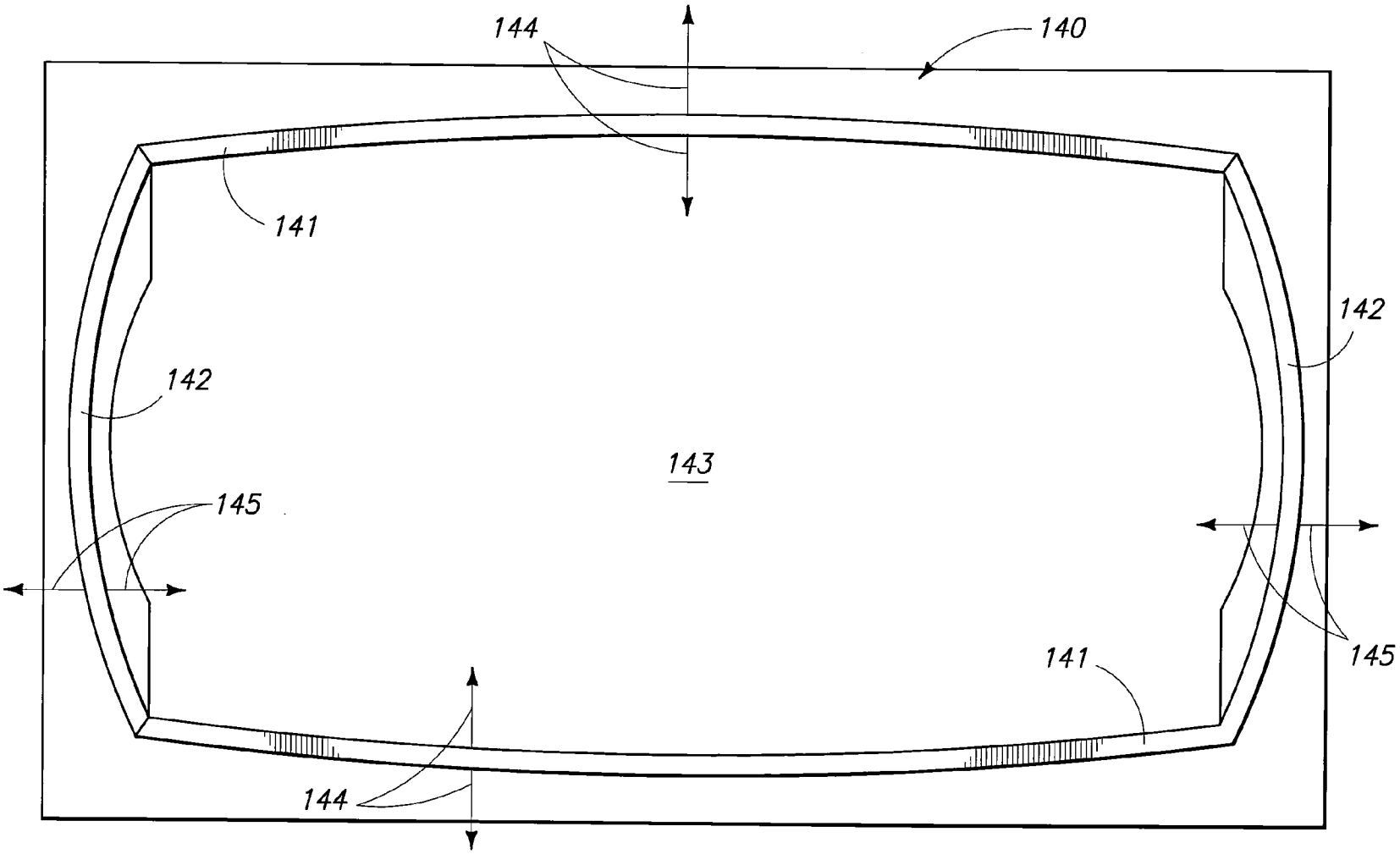
FIG. 11 is a schematic representation of one embodiment of an automated variable dimension mold and bottom block system, wherein the movable mold walls allow the bottom block to be started within the movable mold walls.

FIG. 11 is a schematic elevation representation of one embodiment of an automated variable dimension mold and bottom block system 250, wherein the movable mold walls allow the bottom block 256 to be started between the movable mold walls 254 and 255. FIG. 11 illustrates spout 251, molten metal 252 being delivered to starting block 256 and shown as 253 accumulating within starting block 256. Starting block 256 has an approximate thickness 259 and arrows 257 reflect downward movement of cylinder 258 and starting block 256. Mold walls 254 and 255 are shown, and this invention contemplates, that the mold walls 254 and 255 will be moved outwardly during the casting process as shown by arrows 242 and 243. FIG. 11 further illustrates how in some embodiments of the invention, the internal angles 239 within a bottom block 256 may be utilized to achieve a particular form on the bottom of the ingot. This type of forming combined with other aspects of this invention may be utilized to achieve a castpart which is formed on the top portion and the bottom portion without the need to later cut or machine to achieve this.

It will be appreciated by those of ordinary skill in the art that it is generally more desirable to reduce the pour drop, which is the distance from the spout to the location where the molten metal lands or is deposited in or on the bottom block. It will be evident to those of skill in the art comparing the pour drop in FIG. 10 to that in FIG. 11, the benefits which may be achieved in aspects of this invention by allowing the bottom block to be raised up higher in the mold cavity and between the movable mold walls, such as movable mold walls to 254 and 255.

Figure 12:
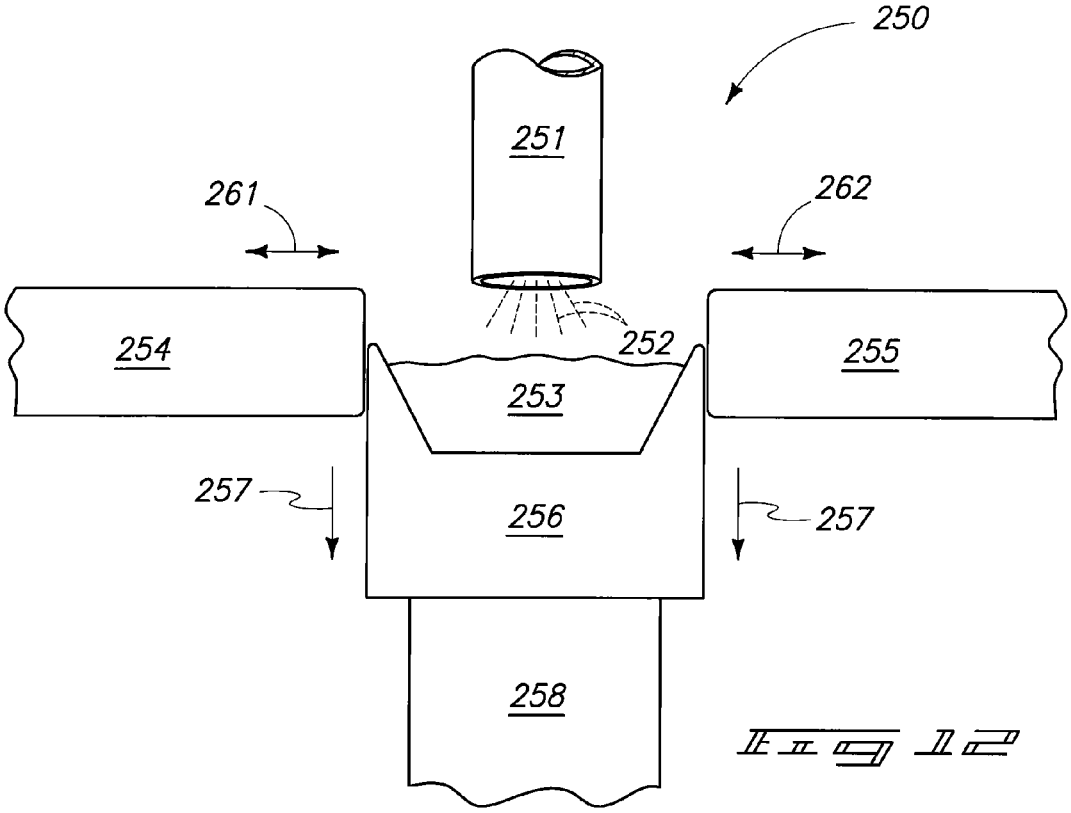
FIG. 12 is a schematic representation of one embodiment of an automated variable dimension mold and bottom block system, part way into the casting process as the bottom block is being lowered.

FIG. 12 is a schematic representation of one embodiment of an automated variable dimension mold and bottom block system 250, part way into the casting process as the bottom block 256 is being lowered. FIG. 12 shows first movable wall 254, movable as indicated by arrows 261, second movable wall 255 as reflected by arrows 262. The system 250 illustrated in FIG. 12 further shows molten metal 252 from spout 251, accumulated metal 253 with arrows 261 and 262 reflecting the respective movements of mold walls 254 and 255.

Figure 13:
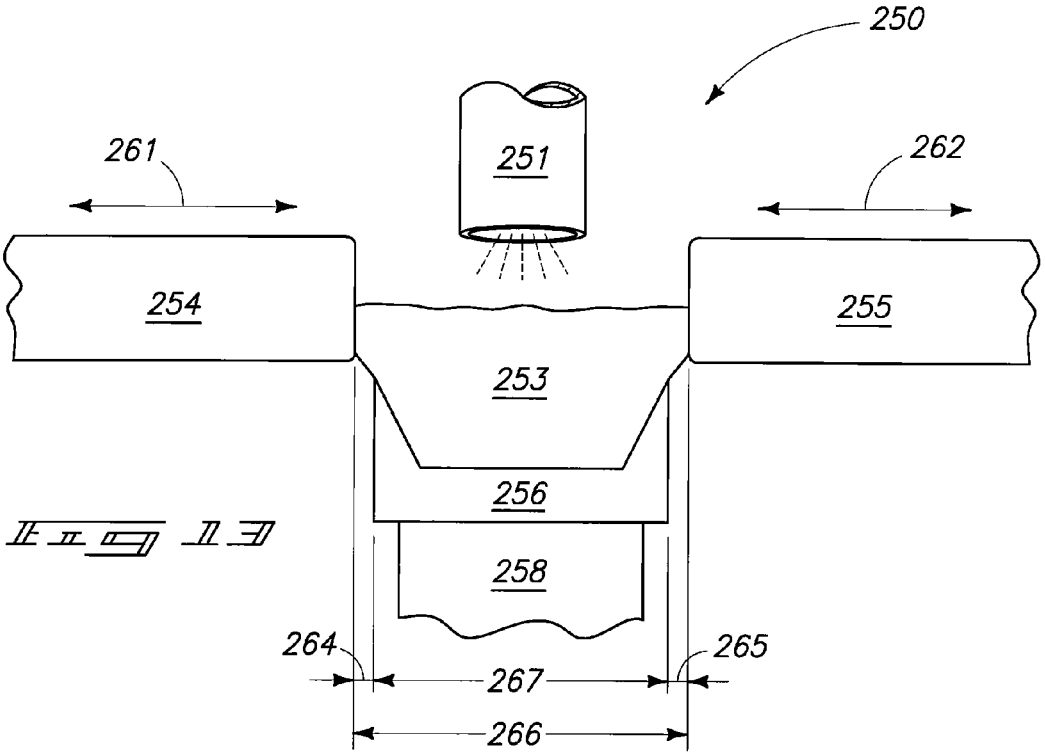
FIG. 13 is a schematic representation of one embodiment of an automated variable dimension mold and bottom block system, further into the casting process and illustrating how the castpart may be molded dimensionally wider than the bottom block.

FIG. 13 is a schematic representation of one embodiment of an automated variable dimension mold and bottom block system 250, further into the casting process compared to FIG. 12, and illustrating how the castpart 253 may be molded dimensionally wider than the bottom block 256. FIG. 13 illustrates first movable wall 254, second movable wall 255 as indicated by arrows 261 and 262 respectively. The system 250 includes spout 251, molten metal 253, starting block 256 and starting cylinder 258. Some dimensions are shown in the figure, namely width 267 of starting block 256, with the cylinder 258, with starting block 256 having a width dimension of 256, whereas ingot 253 has been cast at the outer dimension 266 greater than the outer dimension of the starting block 256 in the same direction. Distance 264 represents the additional dimension on that side of the ingot 253 by which the ingot 253 exceeds the dimension of starting block 256, and distance 265 represents the additional dimension on the opposing side of the ingot 253 by which the ingot exceeds the dimension of starting block 256.

Figure 14:
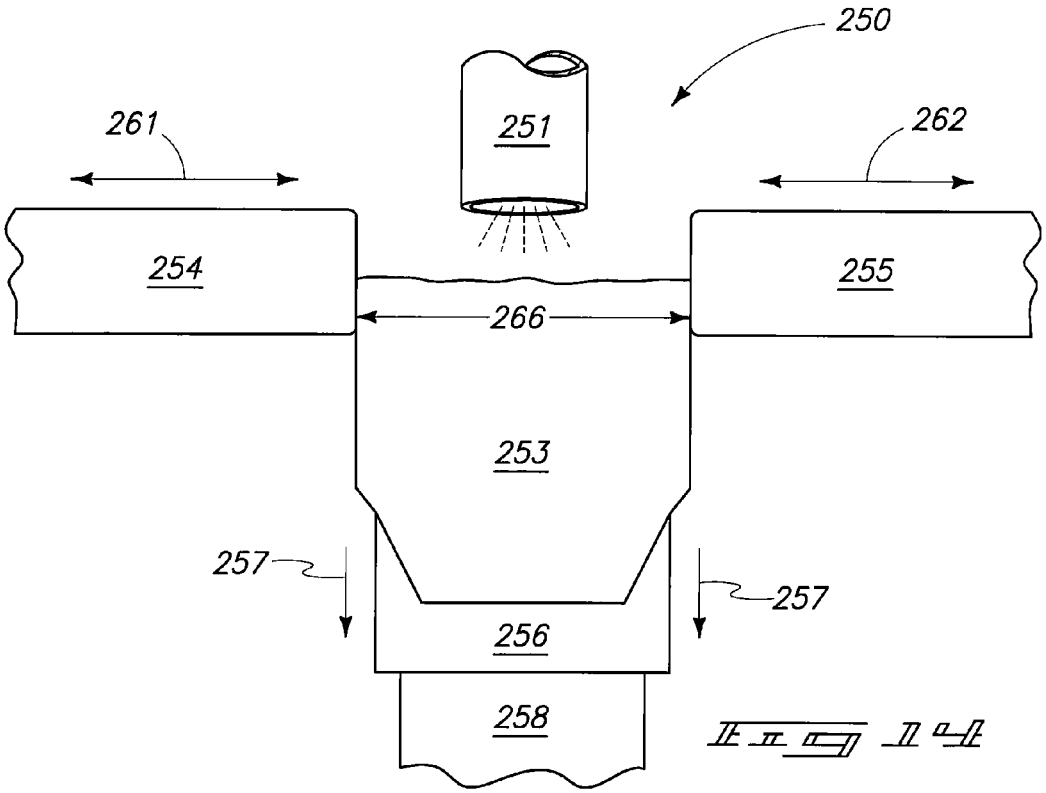
FIG. 14 is a schematic representation of one embodiment of an automated variable dimension mold and bottom block system, still further into the casting process from FIG. 13.

FIG. 14 is a schematic representation of one embodiment of an automated variable dimension mold and bottom block system 250, still further into the casting process from FIG. 13, with the castpart 253 being further formed. Since like numbers represent like items and components from FIG. 13, each will not be further identified and discussed here in relation to FIG. 14, since they are sufficiently identified and discussed with respect to FIG. 13.

Figure 15:
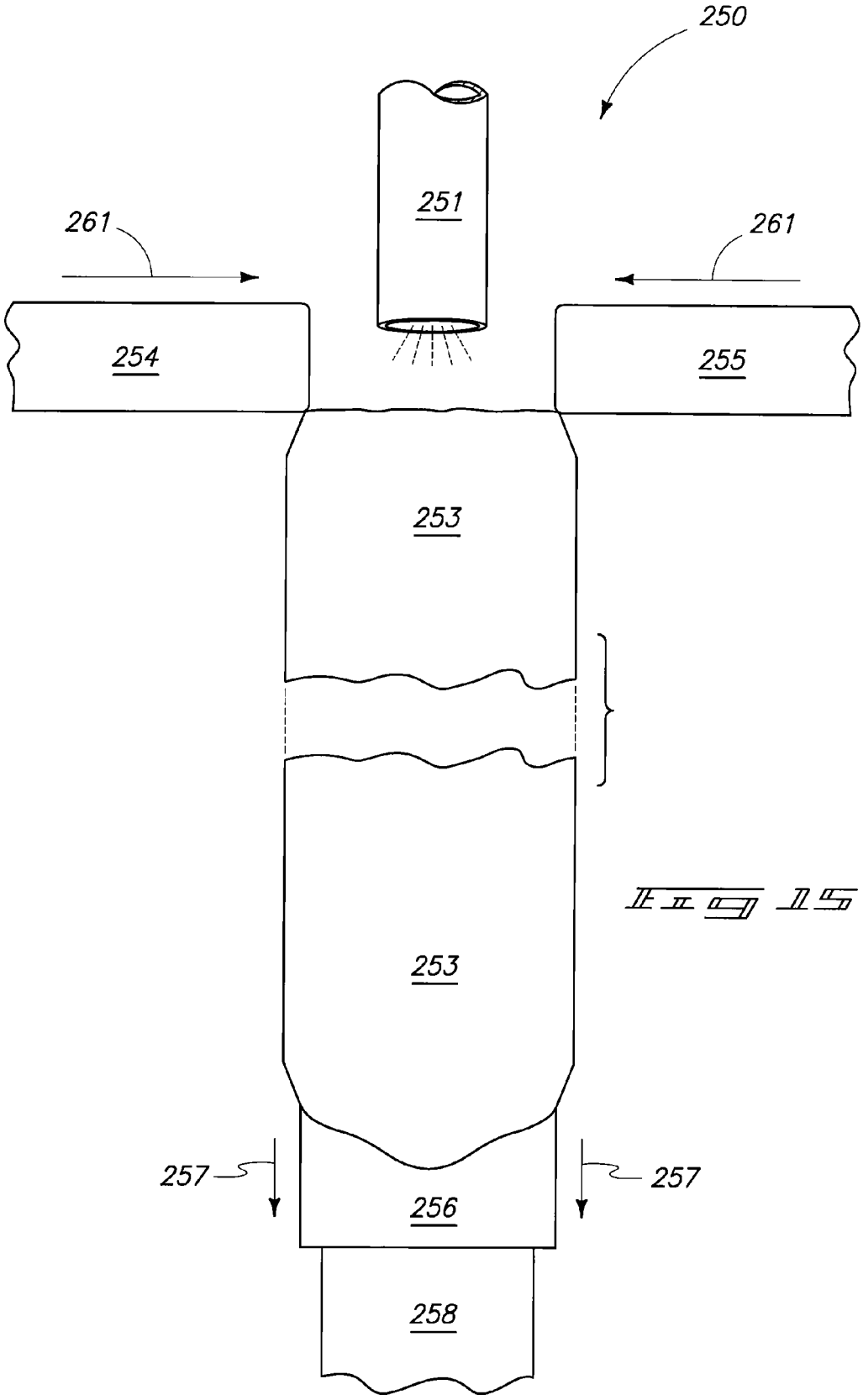
FIG. 15 is a schematic representation of one embodiment of an automated variable dimension mold and bottom block system, illustrating the ability of aspects of this invention to affect the profile or configuration of the top of the castpart at the end of the cast.

FIG. 15 is a schematic representation of one embodiment of an automated variable dimension mold and bottom block system 250, illustrating the end portion of the cast and which shows the ability of aspects of this invention to affect the form or configuration of the top of the castpart 253. Arrows 261 illustrate how mold walls 254 and 255 may be moved inwardly at the end part of the casting process to affect the corner form and configuration of castpart 253. It will be appreciated by those of ordinary skill in the art that any one of a number of different forms and configurations may be programmed into such a system to achieve the desired profile and form of the castpart 253, with no one in particular being required to practice this invention. In fact a feature of some aspects of the invention is the ability to produce any one of a number of different forms of castparts 253 for the specific application. Since like numbers represent like items and components from FIG. 13, each will not be further identified and discussed here in relation to FIG. 15, since they are sufficiently identified and discussed with respect to FIG. 13.

Figure 16:
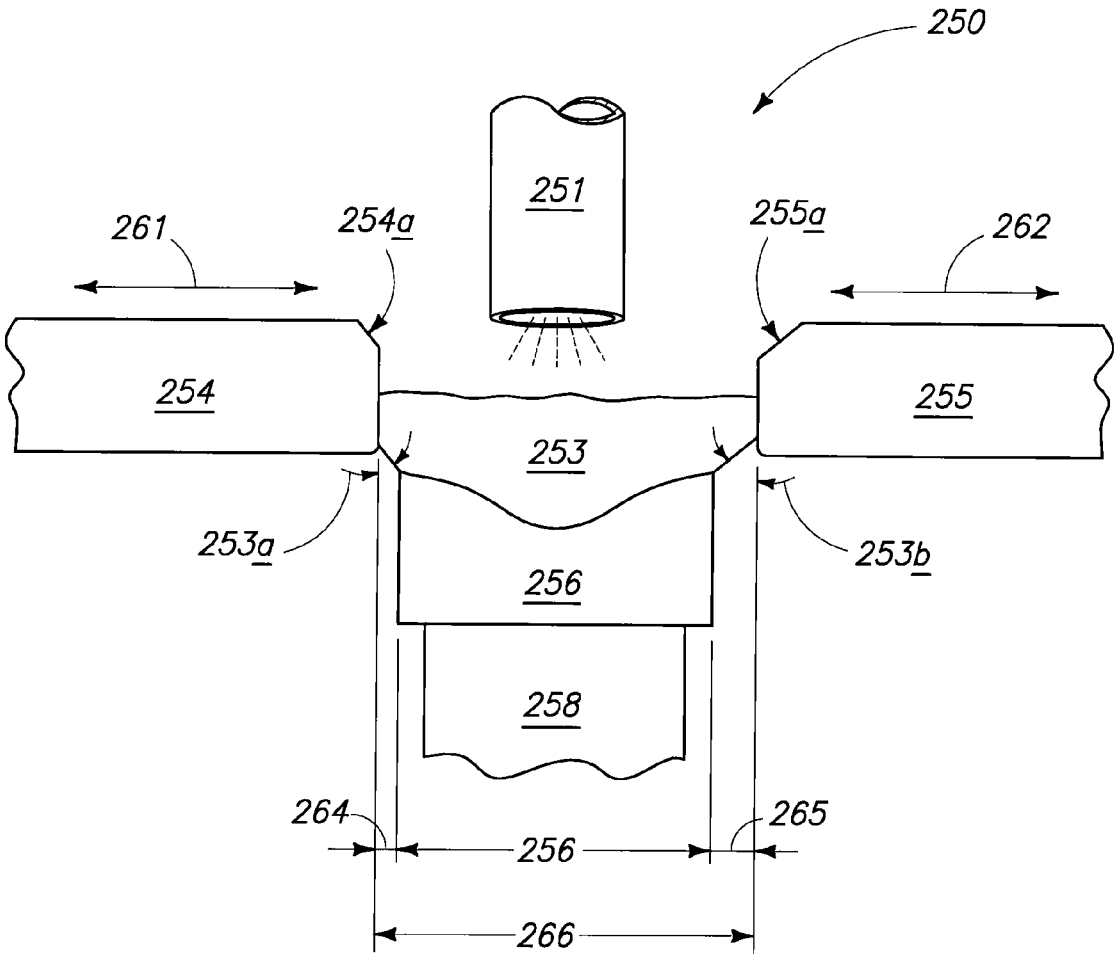
FIG. 16 is a schematic representation of one embodiment of an automated variable dimension mold and bottom block system, illustrating a castpart partially into the casting process wherein this invention provides a different dimension and taper or configuration on one side of the castpart compared to the other side.

FIG. 16 is a schematic representation of one embodiment of an automated variable dimension mold and bottom block system 250, illustrating a castpart 253 partially into the casting process wherein this invention provides a different dimension and form on one side of the castpart compared to the other side. FIG. 16 illustrates how aspects of this invention may be utilized to create asymmetrical castparts 253 if desired, in that one side may be provided with different dimensions when compared to the opposing side. FIG. 16 shows a different distance from the center of the castpart 253 represented by arrow 265 as compared to arrow 264 on the opposing side of the castpart 253. It will be appreciated by those of ordinary skill in the art that the ability to produce asymmetrical parts is not limited to dimensions as shown in FIG. 16, but can also be utilized to produce different forms and configurations on one side of the castpart 253 versus another side of the castpart 253. Since like numbers represent like items and components from FIG. 13, each will not be further identified and discussed here in relation to FIG. 16, since they are sufficiently identified and discussed with respect to FIG. 13.

FIG. 16 also illustrates how in some embodiments of the invention that the angle of the upper surface 254*a* of the mold wall 254 may correspond to the corresponding angle 253*a* on the lower portion of the resulting castpart, and similarly the angle of the upper surface 255*a* of the mold wall 255 corresponds to the corresponding angle 253*b* on the lower portion of the resulting castpart. In practice, the angles 253*a* and 253*b* may be one degree or more different than the corresponding angle on the top portions 254*a* and 255*a* of mold walls 254 and 255.

Figure 17:
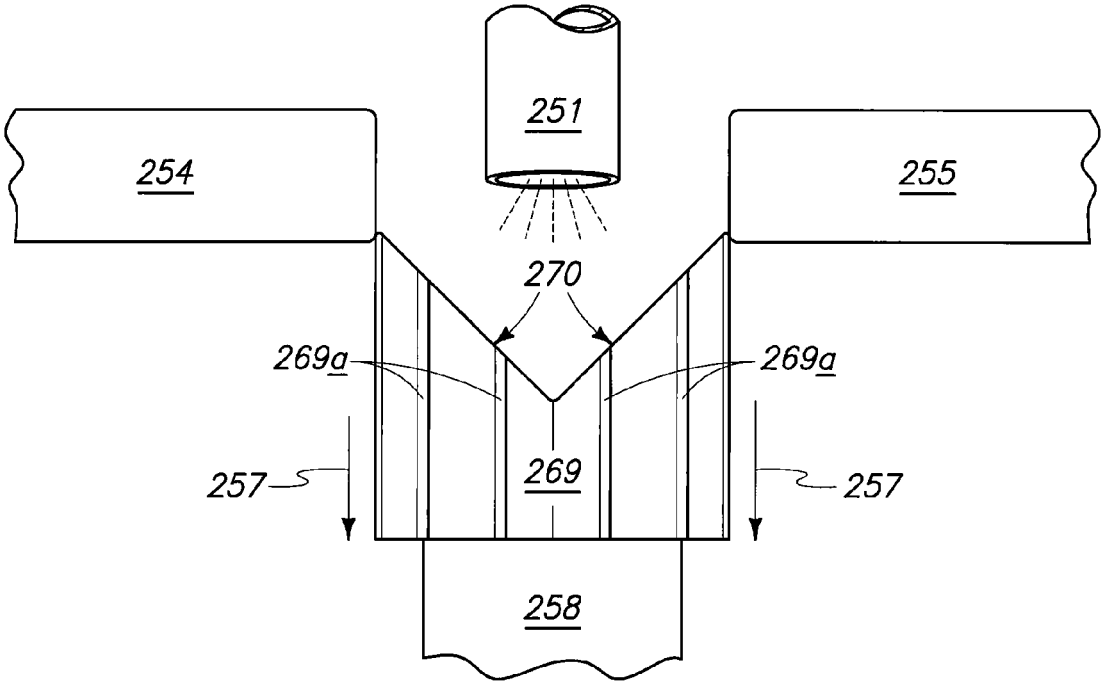
FIG. 17 is a schematic representation of an aspect of an automated variable dimension mold and bottom block system contemplated by this invention, illustrating a differently configured bottom block the approximate width of the mold opening.

FIG. 17 is a schematic representation of an aspect of an automated variable dimension mold and bottom block system contemplated by this invention, illustrating a differently configured bottom block 269 which is the approximate width of the mold opening.

FIG. 17 further shows another aspect of invention, illustrating grooves 269*a* vertically oriented around bottom block 269. These grooves 269*a* may provide a conduit and surface area through which coolant may be passed to further assist and cool the bottom block 269 and molten metal contained therein. Another cooling means is shown and described relative to FIG. 18 below.

FIG. 17 further illustrates another bottom block 269 configuration wherein angled sides 270 may be provided in the bottom block 269 to form the bottom portion of a resulting castpart to create the desired form for later rolling the castpart. This aspect may be utilized in combination with other aspects to create the desired form or configuration of the castparts on both the top portion and the bottom portion, all within the contemplation of this invention. For instance, the bottom portion of the castpart illustrated in FIG. 34 may be produced utilizing a bottom block 269 such as that shown in FIG. 17. Since like numbers represent like items and components from FIG. 13, each will not be further identified and discussed here in relation to FIG. 17, since they are sufficiently identified and discussed with respect to FIG. 13.

Figure 18B:
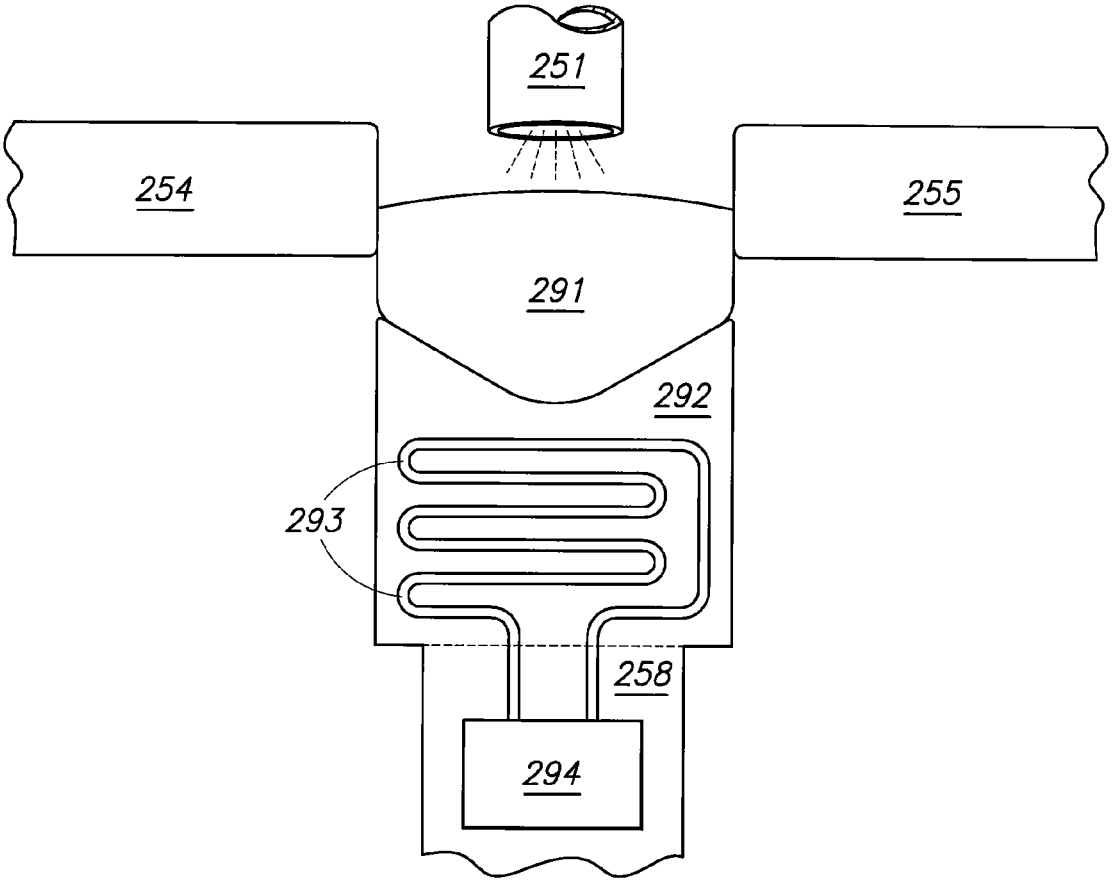
FIG. 18 is a schematic representation of one embodiment of an automated variable dimension mold and bottom block system, illustrating another aspect of this invention, wherein a liquid cooling is utilized within the bottom block to achieve more desirable cooling of the molten metal relative to the bottom block.

FIG. 18 is a schematic representation of another aspect of an automated variable dimension mold and bottom block system, illustrating a liquid cooling system utilized within the bottom block 292 to achieve more desirable cooling of the molten metal 291 relative to the bottom block 292. FIG. 18 shows the bottom block 292 cooling system wherein the cylinder 258 is utilized to house the cooling system 294, wherein the cooling system may be comprised of cooling conduit 293 operatively connected to cooling system components 294 to provide sufficient cooling to solidify the molten metal comprising castpart 291 during the initial part of the cast. Those of ordinary skill in the art will appreciate that any one of a number of different types of cooling systems, cooling system components and locations for the cooling system, may be utilized within the contemplation of this invention, with no one in particular being required to practice this invention. Since like numbers represent like items and components from FIG. 13, each will not be further identified and discussed here in relation to FIG. 18, since they are sufficiently identified and discussed with respect to FIG. 13.

Figure 19:
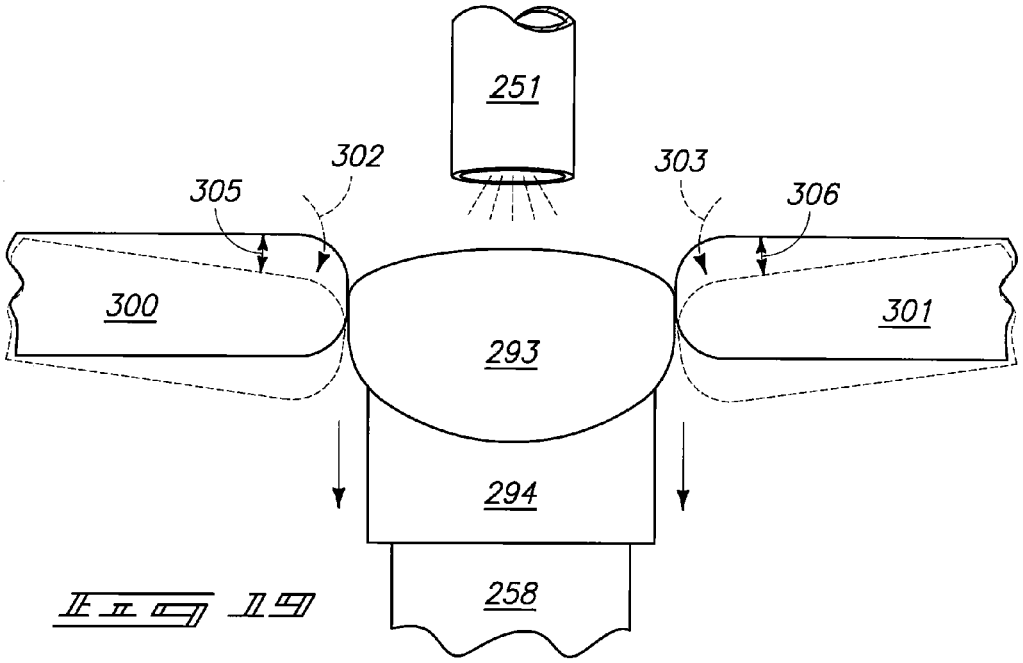
FIG. 19 is a schematic representation of one embodiment of an automated variable dimension mold and bottom block system, illustrating another aspect of the invention wherein the movement of the mold side walls is not linear.

FIG. 19 a schematic representation of one embodiment of an automated variable dimension mold and bottom block system contemplated by this invention, illustrating an aspect of the invention wherein the movement of the mold side walls 300 and 301 are not necessarily linear like in prior figures, but instead are pivoted or alternatively moved outwardly and inwardly to affect the form of the castpart according to arrows 302 and 303. Mold wall 300 may for instance be moved downwardly to angle 305 and mold wall 301 may be moved angularly downward to angle 306, to provide the desired castpart form as the bottom block 292 is lowered during casting. It will be appreciated by those of ordinary skill in the art that the specific outer form of the mold walls 300 and 301 may be configured for specific applications and different forms and corners may be utilized to achieve different resulting castpart configurations. FIG. 19 further illustrates spout 251, cylinder 258 and bottom block 292. It will further be noted that the pivotal mounting of mold walls 300 and 301 may be in a cam or other configuration to accomplish the desired castpart result, all within the contemplation of this invention.

Figure 20:
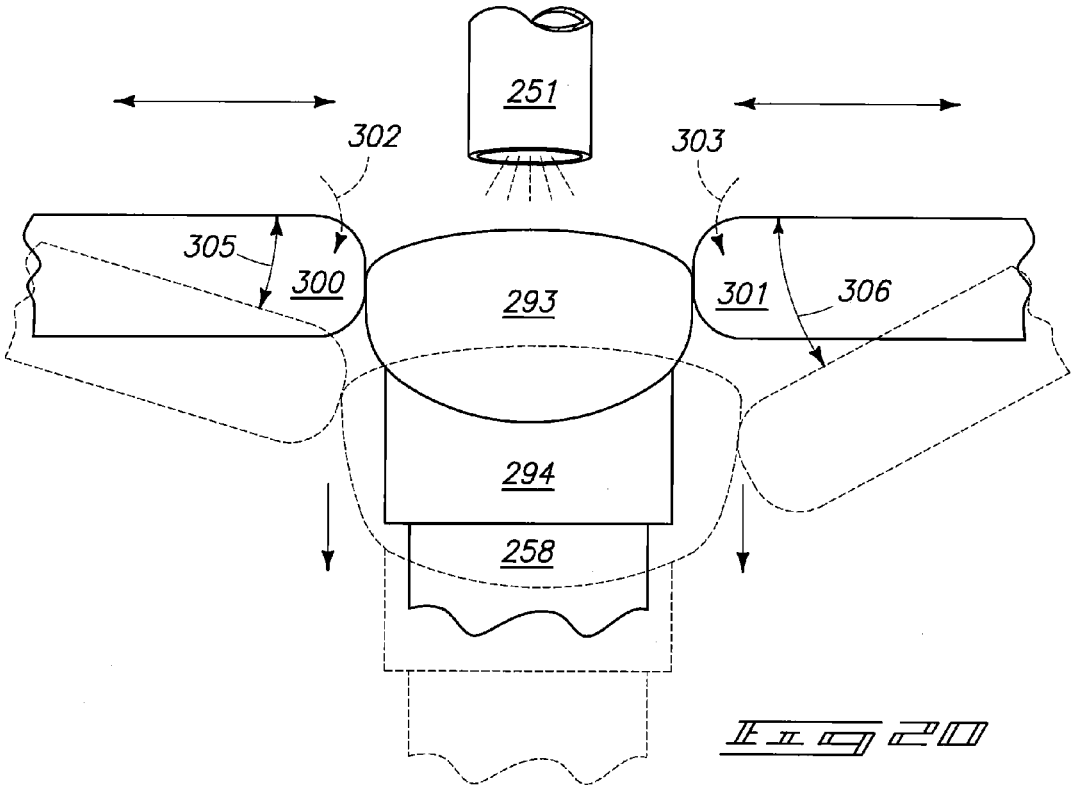
FIG. 20 is a schematic representation of one embodiment of an automated variable dimension mold and bottom block system, illustrating an aspect of the invention similar to that shown in FIG. 19, only wherein one of the mold walls is moved at a dissimilar angle from the other mold wall to provide a different dimension and/or configuration on one side of the castpart compared to the other side.

FIG. 20 is a schematic representation of one embodiment of an automated variable dimension mold and bottom block system contemplated by this invention, illustrating an aspect of the invention similar to that shown in FIG. 19, only wherein one of the mold walls is moved at a dissimilar angle from the other mold wall to provide a different dimension and/or form on one side of the castpart compared to the other side. Angle 305 in FIG. 20 is a different or dissimilar angle to angle 306 on the opposing mold wall, to provide the asymmetrical mold configuration or to provide a differing form on one side of the castpart 293 compared to the other side of the castpart 293. Since like, numbers represent like items and components from FIG. 19, each will not be further identified and discussed here in relation to FIG. 20, since they are sufficiently identified and discussed with respect to FIG. 19.

Figure 21:
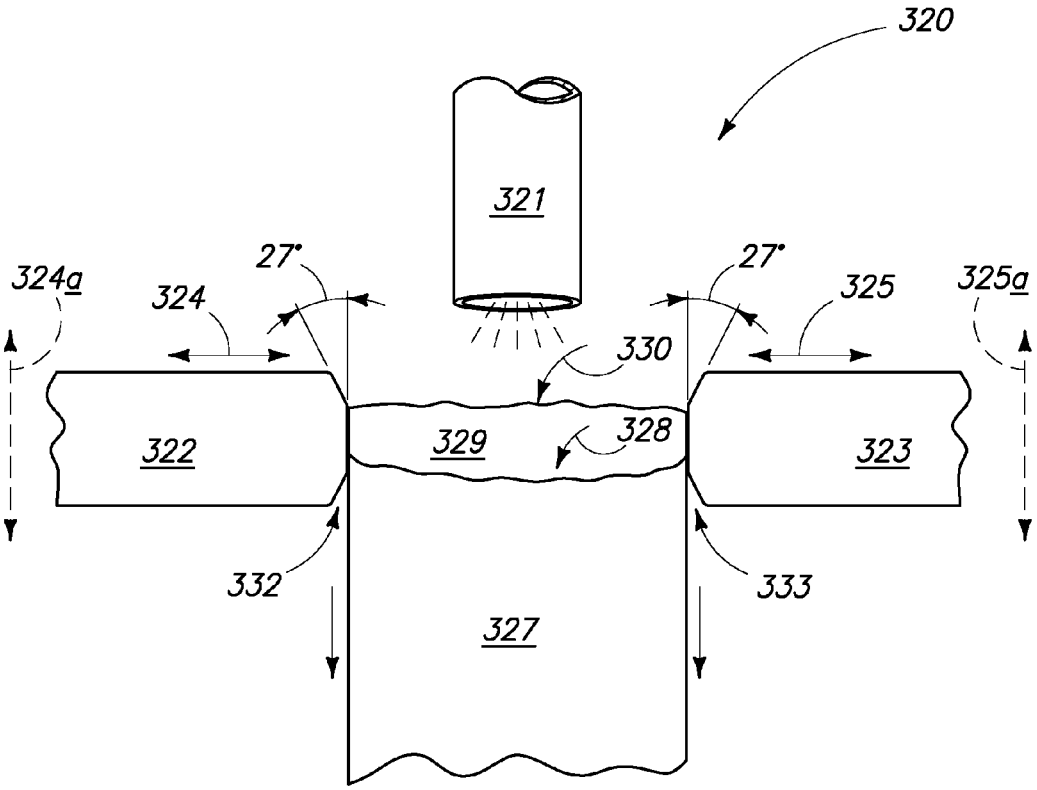
FIG. 21 is a schematic representation of one embodiment of an automated variable dimension mold and bottom block system, illustrating a differently formed or configured mold wall.

FIG. 21 is a schematic representation of one embodiment of an automated variable dimension mold and bottom block system 320 contemplated by this invention, illustrating differently formed or configured mold walls 322 and 323. The spout 321 delivers molten metal, the mold walls 322 and 323 each may be independently moved as indicated by arrows 324 and 325. This system 320 shows a molten metal 329 becoming part of castpart 327, molten metal surface 330, and a more solidified surface 328. Mold walls 322 and 323 have more beveled ends instead of rounded ends, and arrows 332 and 333 illustrate the exit portion of the mold walls 322 and 323 during the casting process and as the castpart 327 is being solidified.

FIG. 21 further illustrates a further aspect of this invention wherein the mold walls 322 and 323 may be moved upward or downward linearly or in some other pattern, as indicated by arrows 324*a* and 325*a*. This vertical movement in particular will allow some flexibility in controlling the distance from spout 321 to the molten metal surface 330, as well as the position of specific mold wall geometries to the metal level. It is more difficult due to other equipment and molten metal delivery systems, to move the spout 321 in many situations. While FIG. 21 illustrates that the angle of the top portion and lower portion of mold walls 322 and 323 may be at twenty-seven degrees, that angle can be any one of a number of different angles, with no one in particular being required to practice the invention.

Figure 22:
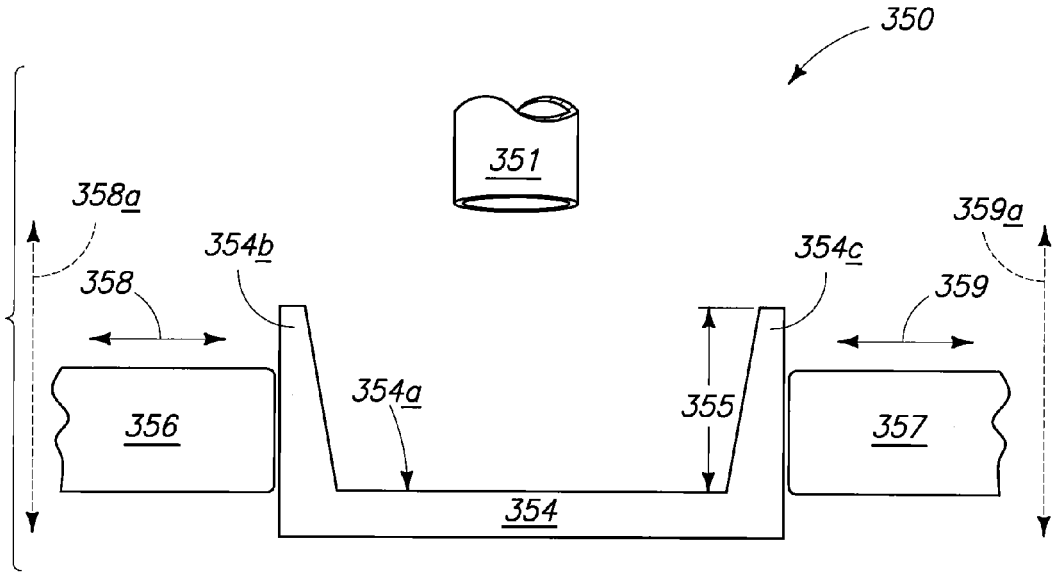
FIG. 22 is a schematic representation of another aspect of the invention with a differently configured bottom block and which need only have full height side walls on two sides, wherein said aspect may use the mold walls as part or all of the perimeter wall on the other two sides.

FIG. 22 is a schematic representation of another aspect of the invention with a differently configured bottom block, and wherein the bottom block need only have full height side walls on two sides, wherein said aspect may use the mold walls as part or instead of the side wall on the other two sides. FIG. 22 shows first movable mold wall 356, second movable mold wall 357, which respectively move according to arrows 358 and 359, bottom block 354 with bottom block interior surface 354*a* and sidewalls 354*b* and 354*c*. FIG. 22 also shows spout 351 at original height 352 and lowered to distance 353 from bottom surface 354*a* of bottom block 354. The sidewalls 354*b* and 354*c* are height 355, all within the contemplation of this aspect of the system 350. It will be appreciated that instead of moving the spout vertically, the mold or mold walls may also be moved vertically relative to the spout to accomplish the desired casting, all within the contemplation of this invention.

It will be appreciated by those of ordinary skill in the art that the mold or the spout 351 may be moved upwardly and downwardly to achieve different desired results during casting. The height of the spout may be one of the casting parameters which may be adjusted or balanced to achieve the desired results. For instance as shown in the schematic in FIG. 30, the molten metal level will preferably be at or near the top of mold walls just before the mold walls are moved outwardly to achieve a different form and configuration. This will provide some buffer so that as the mold walls are moved outwardly it does not create a bleed out or leak situation with the molten metal contained between the respective mold walls. Conversely, just before the mold walls are moved closer together, it would be preferable to have the molten metal level lower on the mold wall so that it will only rise up toward the top of the mold wall and not over during the inward movement of mold walls in the process.

Figure 23:
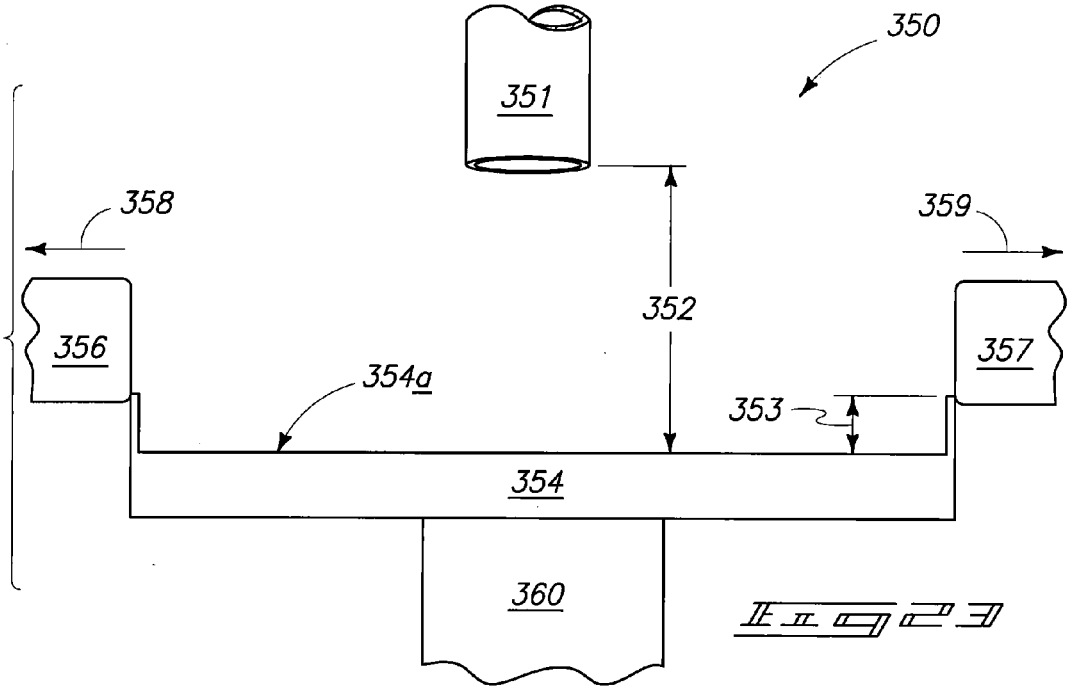
FIG. 23 is a schematic representation of the embodiment of an automated variable dimension mold and bottom block system illustrated in FIG. 22, showing the end of the bottom block and the absence of bottom block end walls.

FIG. 23 is a schematic representation of the embodiment of an automated variable dimension mold and bottom block system 350 illustrated in FIG. 22, showing the end of the bottom block 354 on cylinder 360 and the absence of bottom block end walls. FIG. 23 also shows spout 351 at height 352, mold wall 356 and mold wall 357, with arrows 358 and arrows 359 respectively indicating movement of the two mold walls. Inner surface 354*a* of bottom block 354 is also shown.

Figure 24:
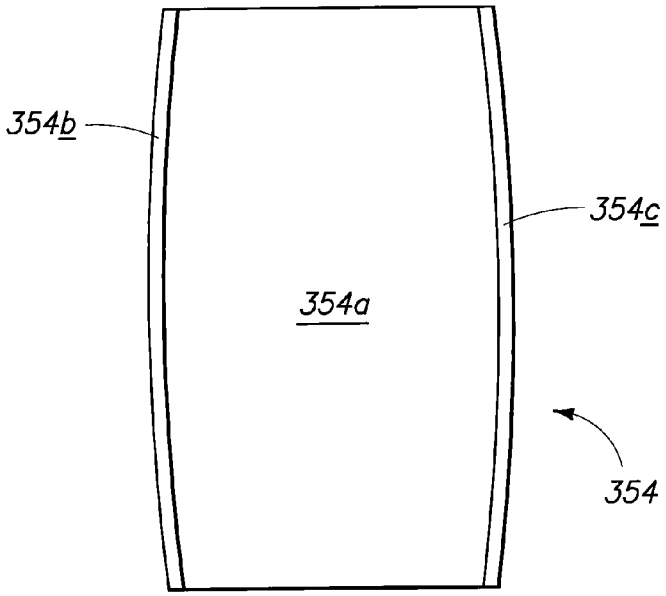
FIG. 24 is a schematic representation of one embodiment of a possible mold starting block configuration for some aspects of this invention, and which may be utilized in embodiments of this invention of the perimeter wall on two sides only.

FIG. 24 is a schematic representation of one aspect or embodiment of a possible mold starting block configuration for some aspects of this invention, and which may be utilized in embodiments of this invention of the perimeter wall on two sides only. FIG. 24 shows bottom block 354 with bottom surface 354*a*, sidewalls 354*b* and 354*c*.

Figure 25:
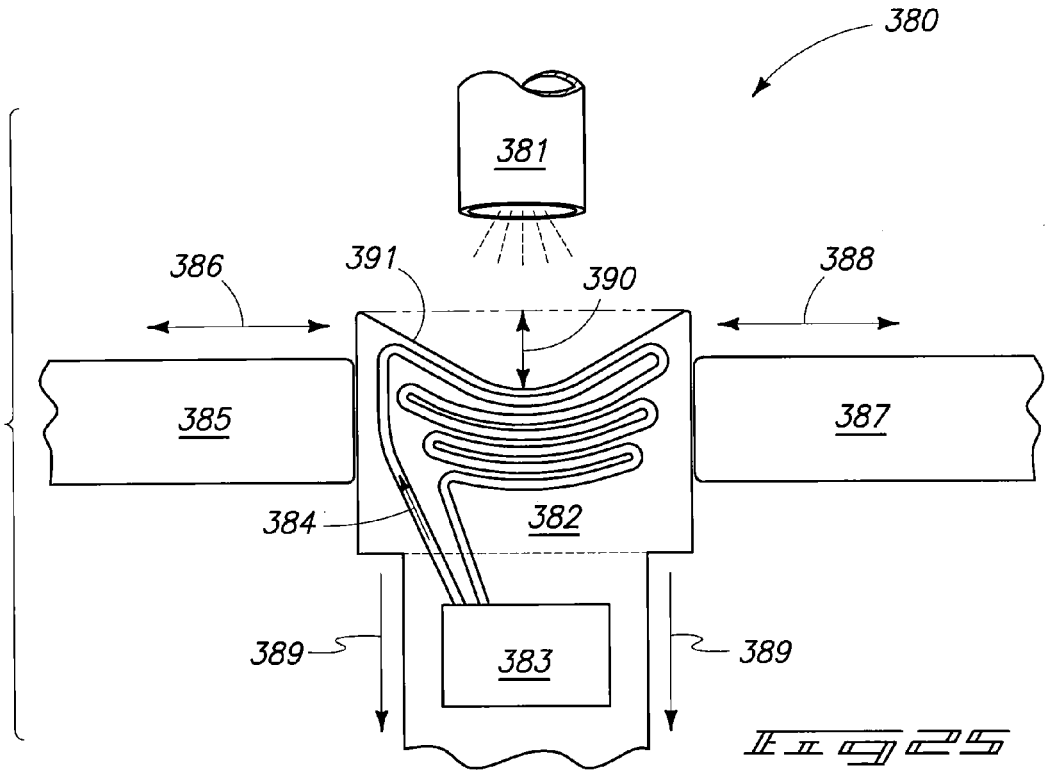
FIG. 25 is a schematic representation of one embodiment of an automated variable dimension mold and bottom block system, illustrating another aspect of this invention, wherein a liquid cooling system is utilized within the bottom block to achieve more desirable cooling of the molten metal relative to the bottom block.

FIG. 25 is a schematic representation of another possible embodiment of an automated variable dimension mold and bottom block system 380, illustrating another aspect of this invention wherein a liquid cooling system is utilized within the bottom block 382 to achieve more desirable cooling of the molten metal relative to the bottom block 382. FIG. 25 shows spout 381, first movable mold wall 385 shown movable by arrow 386, second mold movable mold wall 387 shown movable by arrow 388, with arrows 389 indicating downward movement or lowering of the starting block 382 during the casting process. Inner surface 391 has depth 390 receiving molten metal from spout 381.

Those of ordinary skill in the art will appreciate that any one of a number of different types of cooling systems, and cooling system components may be utilized to provide cooling to the bottom block 382. Cooling system 383 with a coolant conduit 384 is one example as coolant is routed through the bottom block and provides cooling to better solidify molten metal deposited on bottom block 382 by spout 381. Another example of a way to provide additional cooling to a bottom block is illustrated in FIG. 17, wherein cooling channels or grooves are provided in the bottom block to receive coolant that is primarily utilized on the solidifying molten metal.

Figure 26:
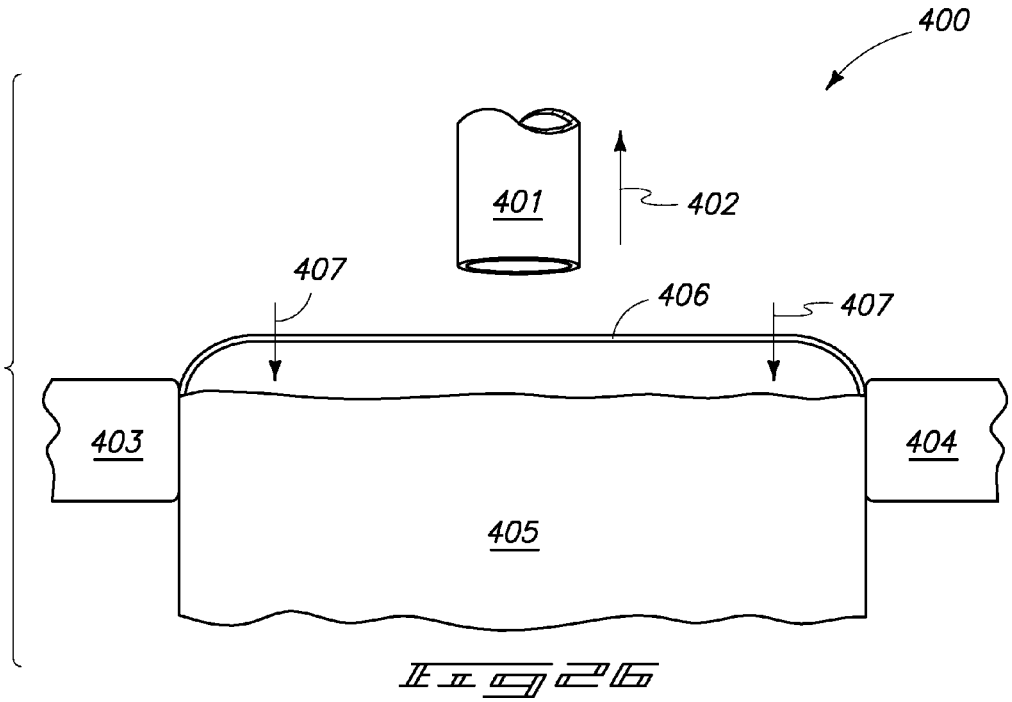
FIG. 26 is a schematic representation of another aspect of the invention, which includes a castpart top cap being lowered on to the top of the molten metal at the top of the castpart.

FIG. 26 is a schematic representation of another aspect 400 of the invention, which includes a castpart top cap 406 being lowered (as indicated by arrows 407) onto the top of the molten metal at the top of the castpart 405. FIG. 26 further shows first mold wall 403, second mold wall 404, spout 401, arrow 402 indicating that spout 401 may be moved upwardly out of the way after the pouring of molten metal ceases. Alternatively and as represented by arrows 415*a* and 416*a* in FIG. 27 and arrows 358*a* and 359*a* in FIG. 22, this movement may also be accomplished by the vertical movement of mold walls 403 and 404 as shown, which toward the end of the cast would be downward. Aspects of this invention provide for the tapering or shaping of the upper end of the ingot or castpart 405.

Figure 27:
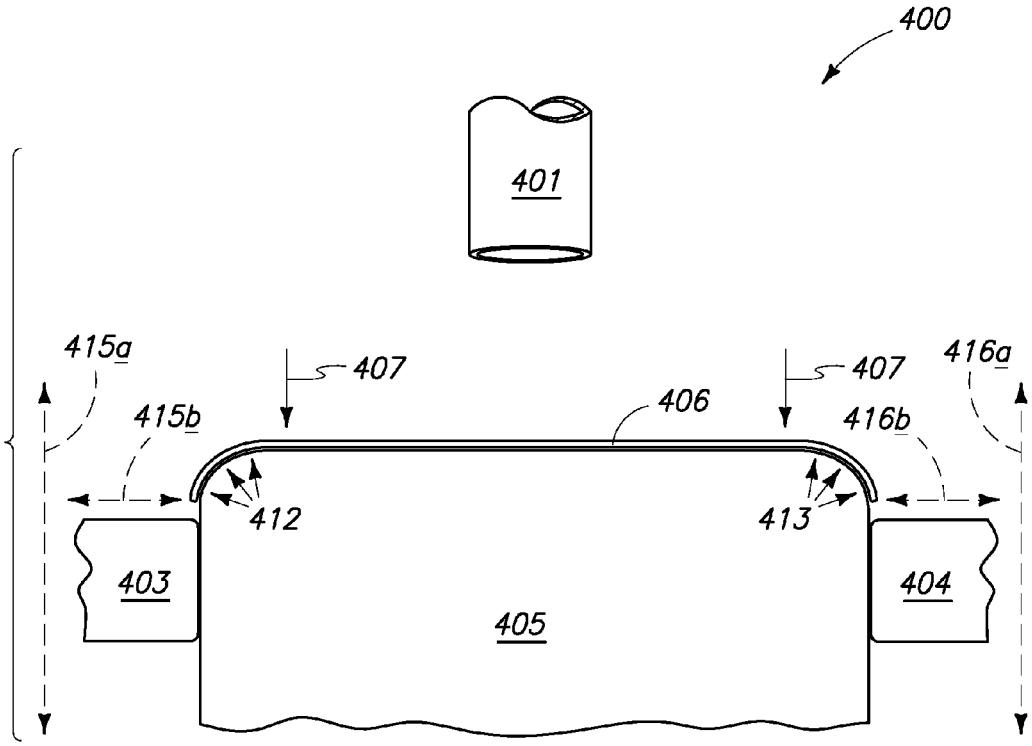
FIG. 27 is a schematic representation of the embodiment of the invention illustrated in FIG. 26, where the top cap has been imparted onto the top of the castpart thereby causing the molten metal to take the contour or configuration of the side of the top cap.

FIG. 27 is a schematic representation of the aspect 400 of the invention illustrated in FIG. 26, where the top cap 406 has been imparted onto the top of the castpart 405 thereby causing the molten metal to take the form of the inside of the top cap 406, and in this example forming a radius at the corners as indicated by items 412 and 413. Arrows 407 indicate that downward pressure or movement may be placed upon top cap 406 to prevent molten metal from escaping between top cap 406 and mold walls 403 and 404. Arrows 415*a* and 416*a* illustrate how mold walls 403 and 404 may be moved vertically (although the movement need not be limited to linear movement vertically), during the casting process, in order to provide more desirable clearances with the spout 401, or for other casting control reasons. FIG. 27 further illustrates how mold walls in aspects of this invention may be moved both vertically and horizontally with the horizontal movement of the mold walls being indicated by arrows 415*b* and 416*b*, as shown.

Figure 28A:
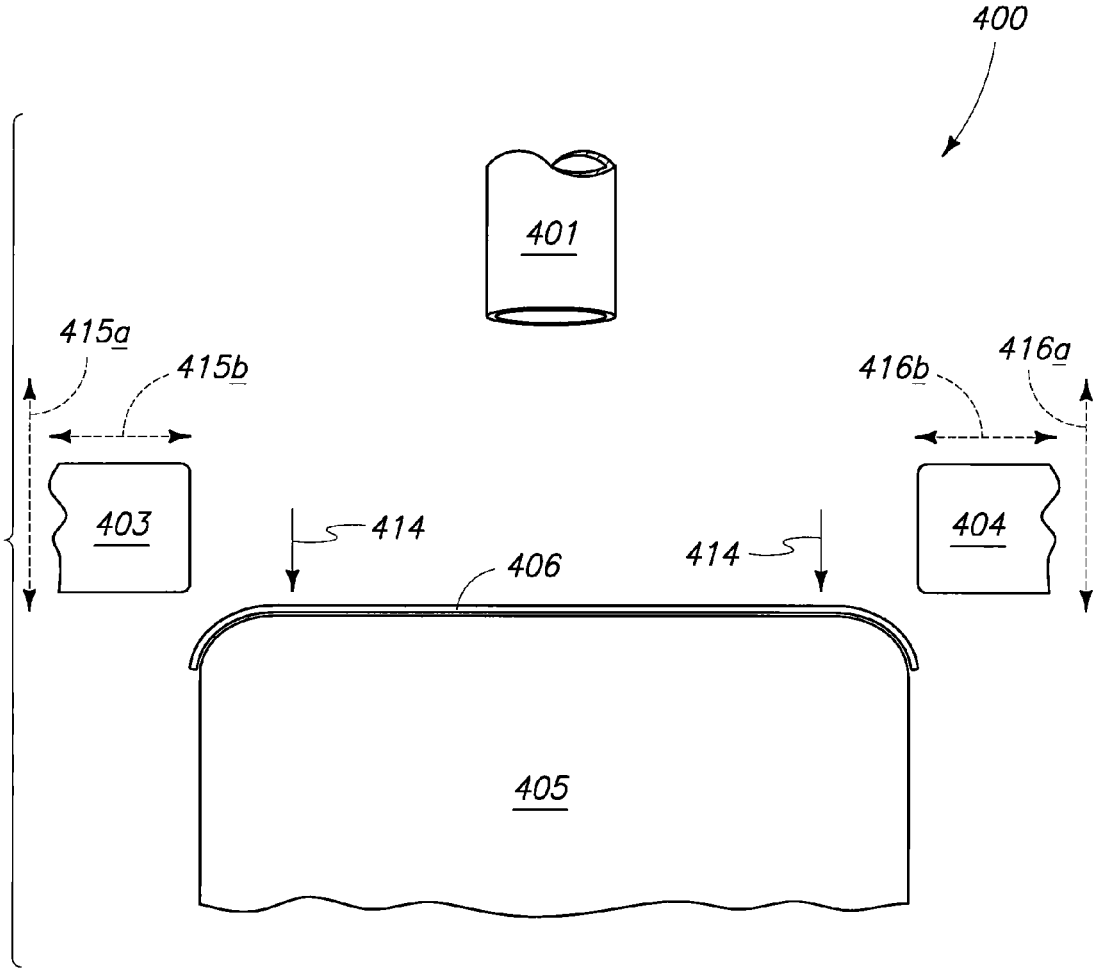
FIG. 28A is a schematic representation of the embodiment of the aspect of the invention illustrated in FIGS. 26 and 27, exiting the lower part of the mold cavity with a particular shaped top cap.

FIG. 28A is a schematic representation of the aspect 400 of the invention illustrated in FIGS. 26 and 27, as the castpart 405 is exiting the lower part of the mold cavity. The mold cavity is the area generally between first mold wall 403 and second mold wall 404. FIG. 28A also shows spout 401, arrows 415*a* and 416*a* showing downward movement of mold walls 403 and 404, castpart top cap 406 on solidifying castpart 405. Arrows 414 indicate the general movement of the top cap 406 with the castpart 405. It will also be noted that alternatively, the top cap 406 may be maintained on or relative to mold walls 403 and 404 while filling at cast end to create the top shape without spout movement, in which case the top could be cooled by liquid or air and cold be made out of a refractory or a metal in various embodiments of the invention. FIG. 28A further illustrates how mold walls in aspects of this invention may be moved both vertically and horizontally with the horizontal movement of the mold walls being indicated by arrows 415*b* and 416*b*, as shown.

Figure 28B:
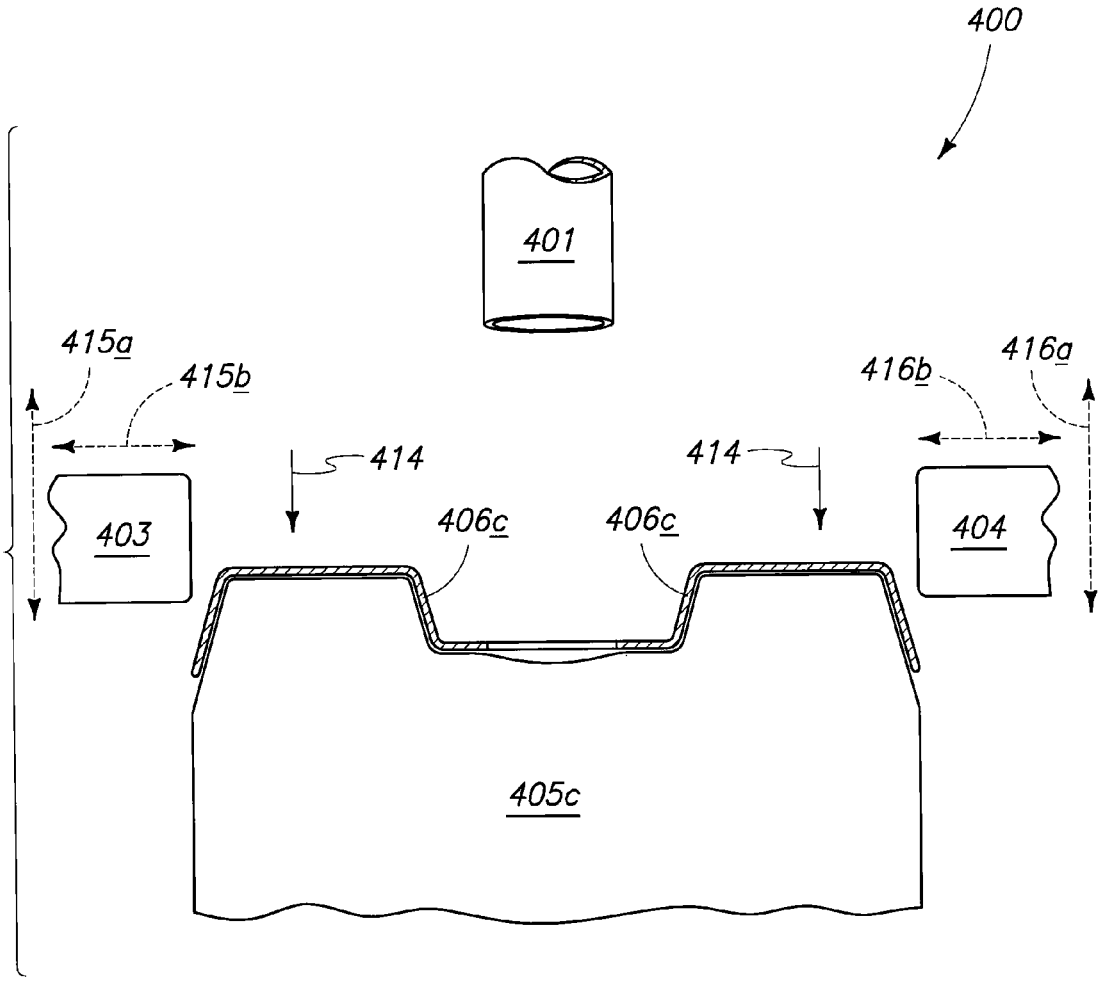
FIG. 28B is a schematic representation of the embodiment of the aspect of the invention illustrated in FIGS. 26 and 27, exiting the lower part of the mold cavity with a differently shaped top cap.

FIG. 28B is the same schematic representation of the aspect 400 of the invention as in FIG. 28A, only wherein the top cap 406 has a different configuration to achieve a differently shaped top portion of the castpart 405*c*. FIG. 28B illustrates a top cap wherein the sides are angled and the middle portion indented as illustrated by indent angles 406*c*. FIG. 28B further illustrates how mold walls in aspects of this invention may be moved both vertically and horizontally with the horizontal movement of the mold walls being indicated by arrows 415*b* and 416*b*, as shown.

Figure 28C:
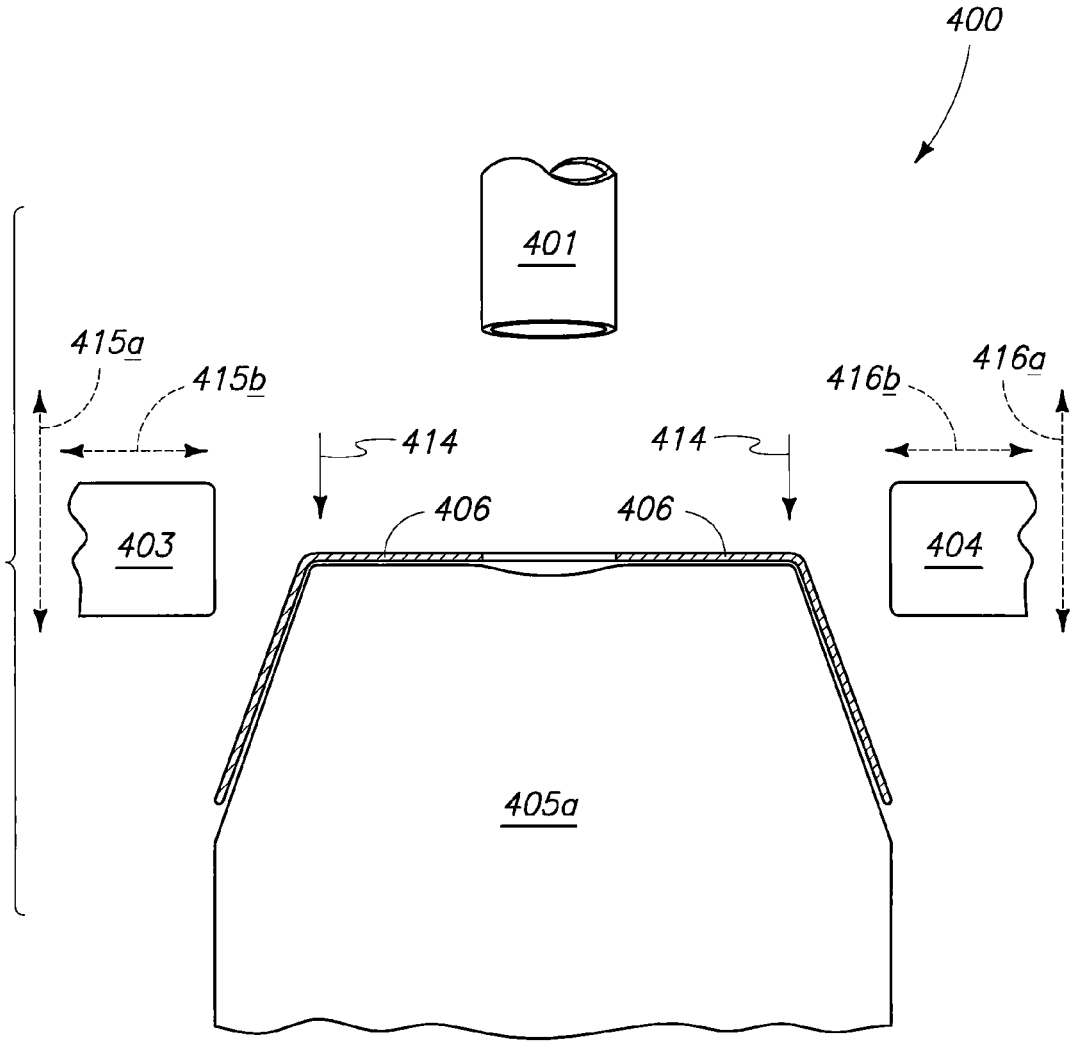
FIG. 28C is a schematic representation of the embodiment of the aspect of the invention illustrated in FIGS. 26 and 27, exiting the lower part of the mold cavity with yet another differently shaped top cap.

Similarly, FIG. 28C is the same schematic representation of the aspect 400 of the invention as in FIG. 28A and FIG. 28B, only wherein the top cap 406 has a different configuration to achieve a differently shaped top portion which includes tapered side angles and which consequently results in side angles in the top portion of castpart 405*a*. FIG. 28C further illustrates how mold walls in aspects of this invention may be moved both vertically and horizontally with the horizontal movement of the mold walls being indicated by arrows 415*b* and 416*b*, as shown.

The ability to move the mold walls 403 and 404 in the direction indicated by arrows 415*a* and 416*a* (generally vertical) provides the enhanced ability to utilize a top cap 406 to configure the top portion of the castpart 405*a*, along and in combination with the mold walls 403 and 404 being movable in the horizontal direction (as shown in other figures)

Figure 29:
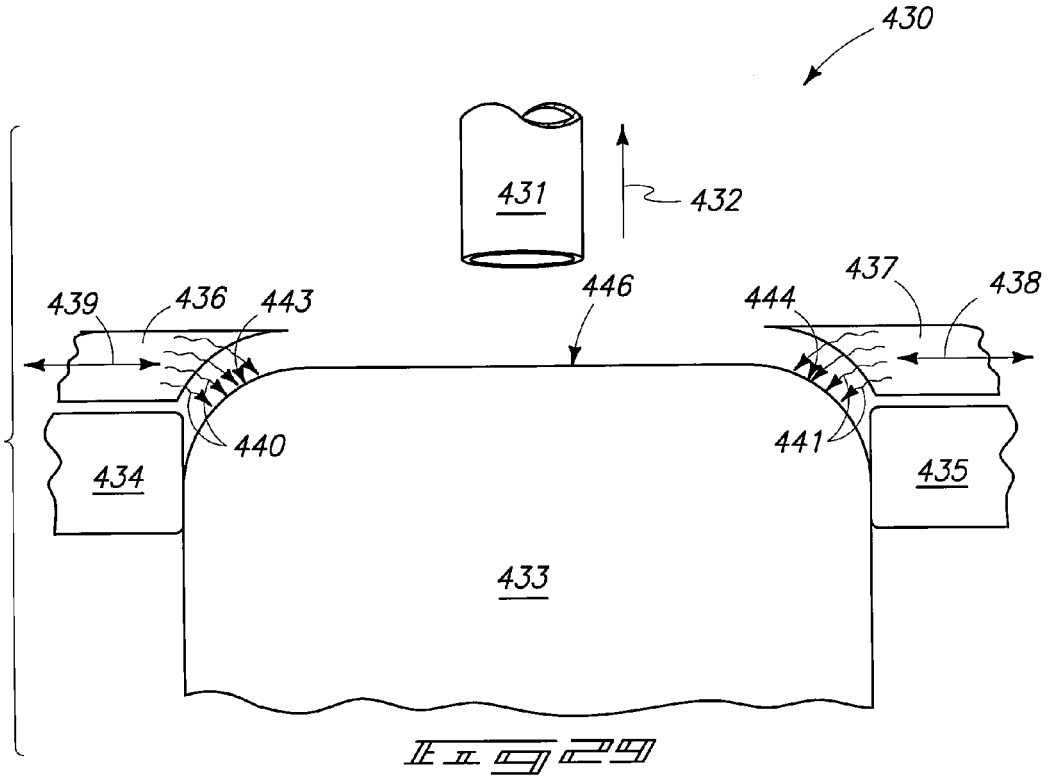
FIG. 29 is a schematic representation of yet another aspect of the invention, wherein any electromagnetic field is utilized to form the top of the castpart at the end of the casting process.

FIG. 29 is a schematic representation of yet another aspect 430 of the invention wherein an electromagnetic field (represented by arrows 440 and 441) is utilized to form the top of the castpart 433 at the end of the casting process. FIG. 29 shows spout 431, movable according to arrow 432 in an upward direction, top surface 446 of castpart 433 being formed through the imparting of a magnetic force or magnetic field on, at or near the top surface 446. A magnetic device 436 and 437 may be moved toward or away from the top surface 446 of castpart 433 in order to achieve the desired form of the top portion 443 and 444 of castpart 433, as shown by arrows 438 and 439. Mold walls 434 and 435 are shown just below the magnetic devices 436 and 437, although they may be adjacent or even below mold walls 434 and 435, all within the contemplation of this invention. There is a type of casting referred to as Electro Magnetic Casting, the acronym being EMC, which may also be used to provide the forming or tapering of the top portion of the castpart toward the end of casting, as shown in an exemplary manner in FIG. 29.

Figure 30:
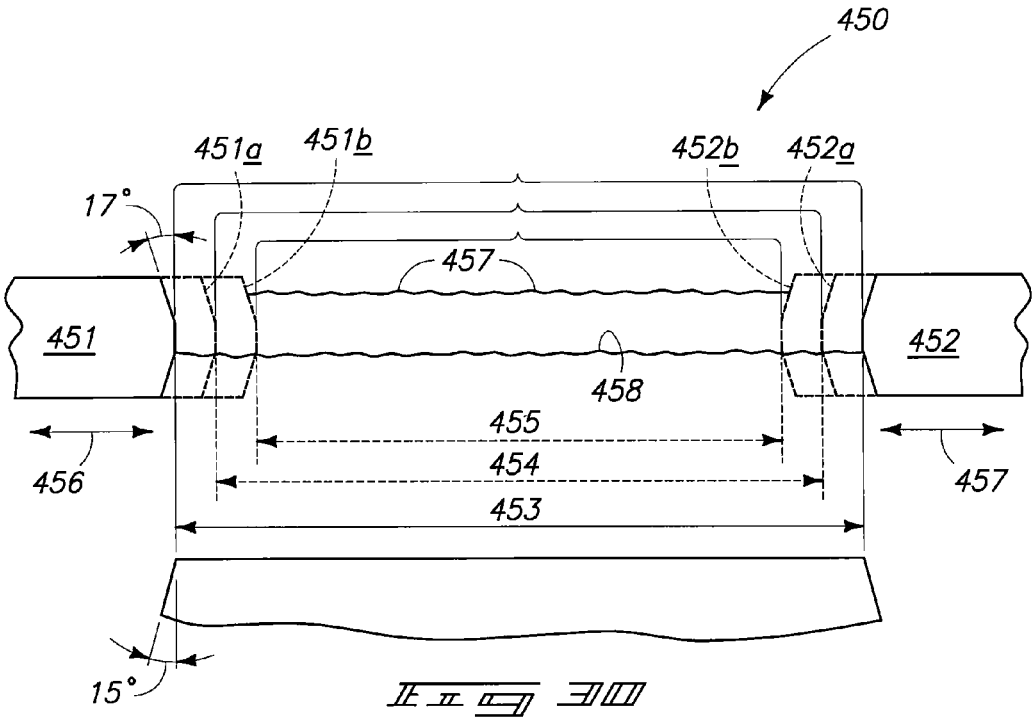
FIG. 30 is a schematic elevation representation of exemplary movements which may be made by movable mold walls contemplated in embodiments of this invention.

FIG. 30 is a schematic representation of an aspect 450 of this invention, illustrating exemplary movements which may be made by movable mold walls 451 and 452, as contemplated in some aspects of this invention. FIG. 30 shows varying distances between mold walls 451 and 452 to illustrate movement thereof. It will be appreciated by those of ordinary skill in the art and is shown in other figures that the movement need not be symmetrical, but instead can be programmed to achieve other results that may be desired in asymmetrical patterning of castparts. Hidden lines 451*a* and 452*a* show a second position of mold walls 451 and 452, and hidden lines 451*b* and 452*b* show further possible movement positions of the mold walls, along with any intermediate position in between.

FIG. 30 also serves to illustrate how casting parameters such as controlling the molten metal level between levels 457 and 458 for example, may be utilized in combination with aspects of this invention. For instance when mold walls are spaced apart as indicated by arrow 455, the molten metal level 457 may be preferable if the mold walls are later going to be moved outwardly as indicated by arrows 456 and 457. Conversely if the mold walls 451 and 452 are spaced apart the distance indicated by arrow 453, and the process will have the mold walls 451 and 452 move together, then molten metal level 458 may be more desirable to allow for the reduction in the mold cavity area and which would naturally cause the molten metal level 458 to rise as the mold walls 451 and 452 move together. This may also serve to prevent binding on the ingot or castpart as the mold cavity is reduced. It would be preferable that the molten metal level 458 not rise above the mold walls as the mold walls are moved inwardly, as will be appreciated by those of ordinary skill in the art.

FIG. 30 also illustrates how one molten metal mold in embodiments of this invention may be used to cast castparts of different sizes, such as cast a twenty-one inch ingot in a first casting, and a nineteen inch ingot in a second casting. Since prior molds are generally dedicated to one size, embodiments of this invention provide more flexibility in a manufacturing facility and reduce the change-out of molds that would otherwise need to be accomplished to cast castparts of different widths. In those embodiments, distance 455 would represent a first castpart with a first thickness, distance 454 would represent a second castpart with a second thickness, and distance 453 would represent a third castpart with a third thickness. It will be noted that there are a number of different thicknesses or widths that may be cast into castparts within the contemplation of this invention.

Figure 31:
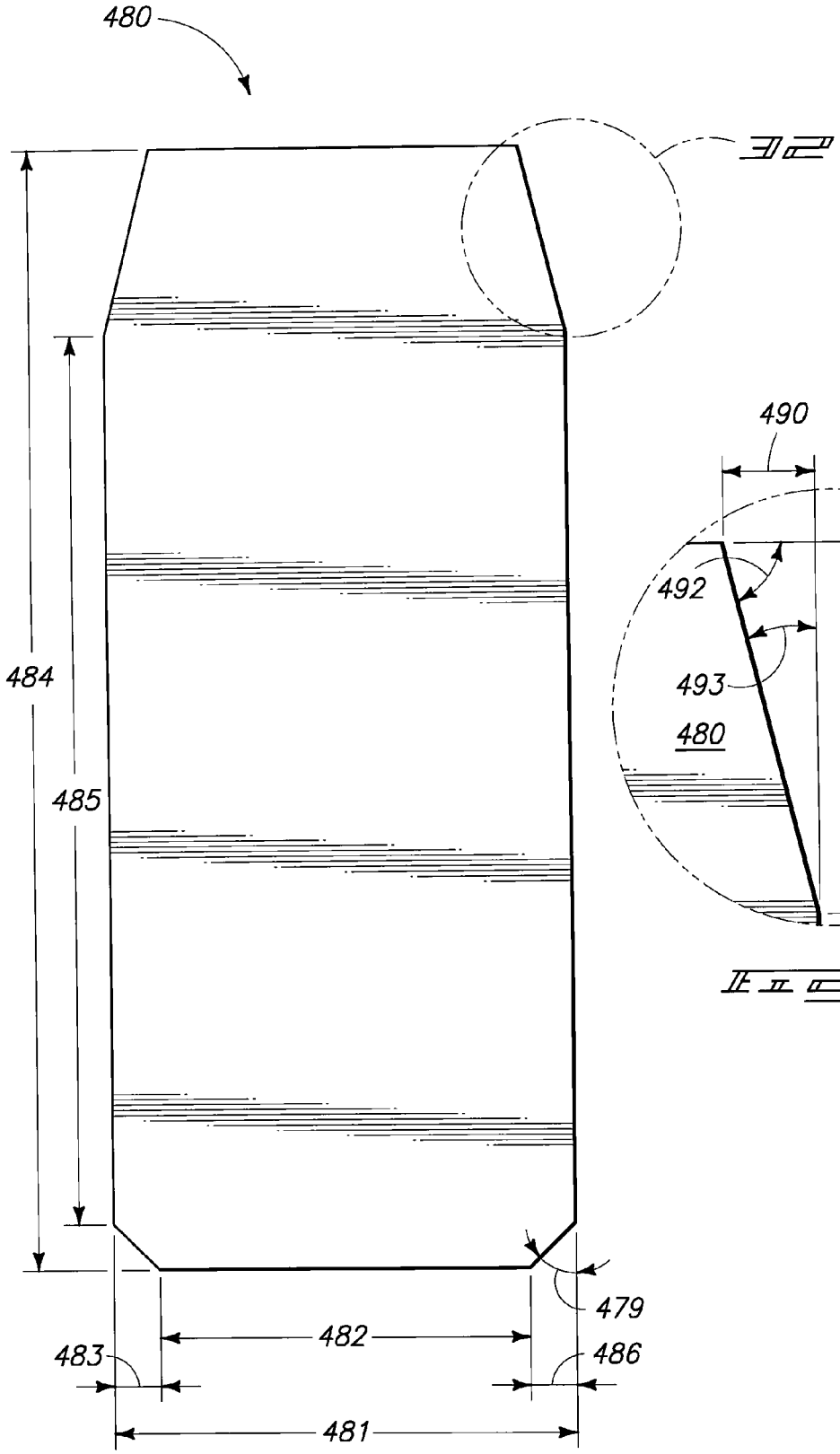
FIG. 31 is an elevation view of a castpart profile or configuration of which may be produced as or part of the casting system disclosed by aspects of this invention.

FIG. 31 is an elevation view of a castpart form of which may be produced as or part of the casting system disclosed by aspects of this invention. The castpart 480 shown in FIG. 31 has an overall length or height 484, and beveled corners on the top portion of the castpart are further shown in detail 32, and the angled edges on the bottom portion are shown beveled at angle 479. The straight edge distance 485 on the side of the castpart, and straight edge distance 482 on the bottom may be determined based upon the desired resulting form and rolling that will later occur on the castpart. Castpart width 481 and beveled widths 483 and 486 are also illustrated in FIG. 31. It will be appreciated by those of ordinary skill in the art that aspects of this process may produce symmetrical or asymmetrical castparts from different dimensions; for example distance 483 may be different from distance 486.

Figure 32:
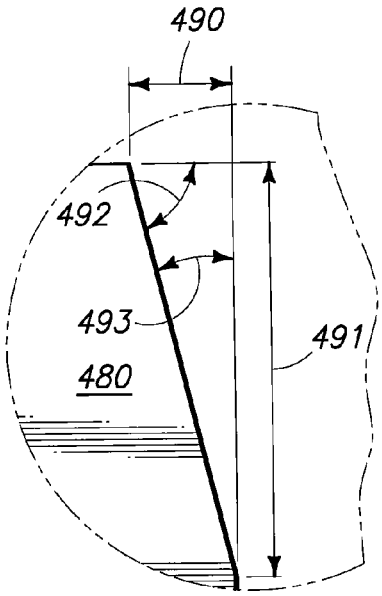
FIG. 32 is detail 32 from FIG. 31.

FIG. 32 is detail 32 from FIG. 31, and illustrates castpart 480, bevel width 490, bevel height 491 with angles 492 and 493 providing the parameters of the bevel. It will be appreciated that these parameters may be changed depending upon the other casting parameters, the metal composition, the intended rolling to be accomplished on the castpart 480, as well as by many other factors in the casting or application of the castpart at a later time, all within the contemplation of this invention.

Figure 33:
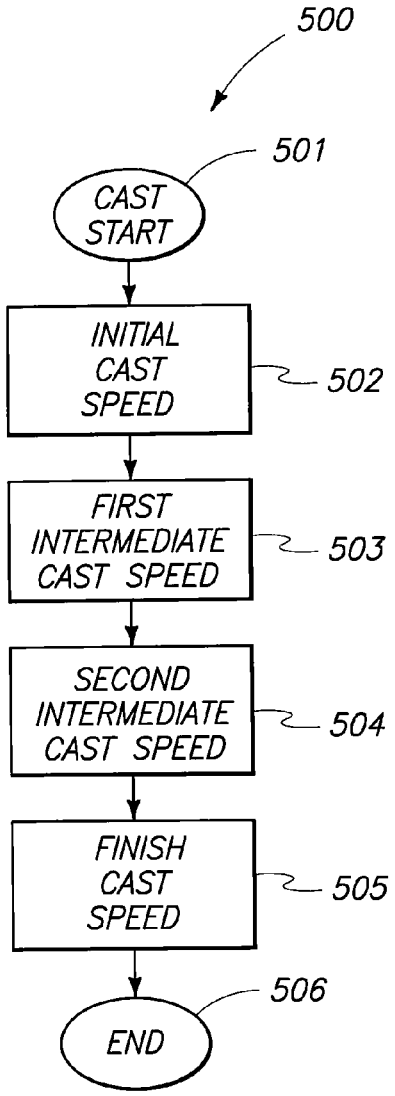
FIG. 33 is a block flow diagram of one embodiment of a process which may be utilized in embodiments of this invention.

FIG. 33 is a block flow diagram 500 of one embodiment of a process which may be utilized in embodiments of this invention. FIG. 33 illustrates the cast start 501 with an initial cast speed 502. At some point the cast speed is typically ramped or increased and a first intermediate cast speed 503 may be utilized to produce the desired results, taper or other feature of the castpart. Although it may not be necessary, a second intermediate cast speed ramp 504 may be utilized, and generally a finish cast speed ramp 505 will be utilized before the end 506 of the casting process. Depending upon the tapering and other goals of the casting, as well as other casting parameters, the cast speed may be varied in order to achieve the desired results.

Figure 34:
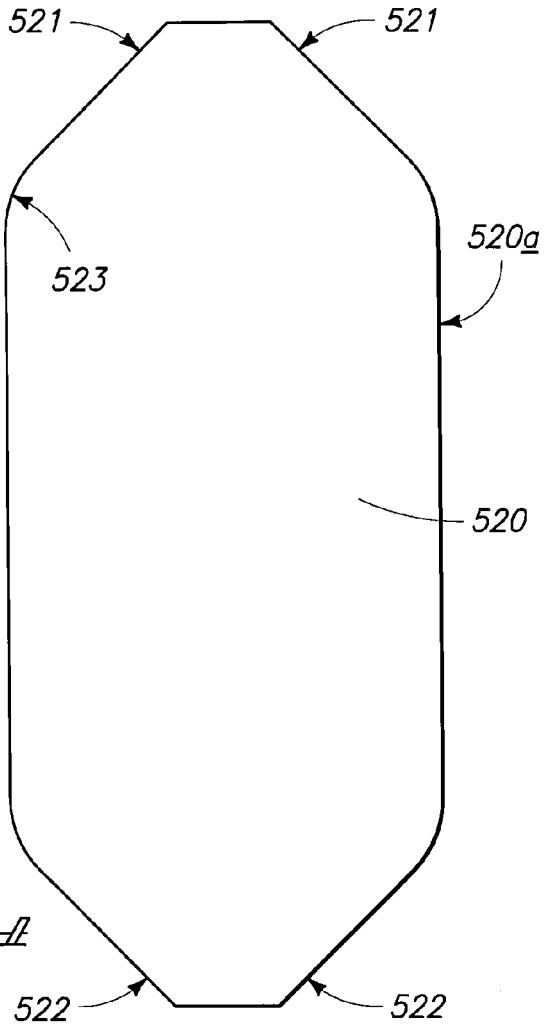
FIG. 34 is an elevation view of another aspect of this invention, illustrating another design of an ingot that may be produced as part of this invention.

FIG. 34 is an elevation view of another aspect of this invention, illustrating another form of an ingot 520 that may be produced as part of this invention. FIG. 34 shows tapered top portion surface 521, sidewall 520*a*, radius 523 and bottom tapered portion surface 522. A significant advantage and feature of aspects of this invention is the ability to produce any one of a number of different castpart configurations and forms during the casting process instead of through machining or other work after the casting of the castpart. This feature and advantage will allow significant savings in the cost and expense of later machining or manipulating the solidified castpart, as well as in reheating scrap and waste from the after-cast process.

It will also be noted that while the embodiments shown in the figures show a first side, a second side, a third side and a fourth side, there may be embodiments of this invention wherein the sides are configured such that two, three, four or more sides define the mold framework with the inner surfaces of said sides defining the mold cavity, all within the scope of this invention.

It will also be appreciated by those of ordinary skill in the art that with the invention providing a movable mold wall, other benefits will be received, such as the ability to correct the molding process to reduce butt swell and position molds relative to spouts, and correct mold clearances. Those of ordinary skill in the art will appreciate that this will allow the cast to be done faster and more efficiently. Prior art recognizes the problem with butt swell and the advantages that would be realized if the butt swell problem were resolved. Prior attempts have tried to increase the casting speed to reduce the butt swell; however aspects of this invention allow a resulting parallel profile due to the ability to move the mold walls, which allows the castpart to be cast faster with less butt swell or without increased butt swell.

Embodiments of this invention will also allow the cast speed to be optimized. The cast speed in a vertical casting arrangement is the speed at which the bottom block is lowered into the casting pit as the molten metal solidifies. There has traditionally been a tradeoff between cast speed and castpart quality because while it is desired to cast faster from a production standpoint, faster cast speeds generally result in more shrinkage and a concave outer surface or rolling surface during steady state casting. If the cast speed is too slow in a given application, an undesirable amount of butt swell tends to result. Embodiments of this invention may therefore allow shrinkage to be better managed or controlled to result in a more desirable castpart shape while casting at a casting speed that would result in excessive shrinking but for the use of this invention. A more desirable castpart shape in some applications is a castpart with approximately parallel sides in the middle portion of the castpart, which generally provides a more desirable rolling surface. Embodiments of this invention provide improved shrinkage management and control in vertical molten metal mold systems.

Embodiments of this invention directed to shrinkage management may include a method to optimize the rolling surfaces of a castpart produced during continuous molten metal casting. In such an embodiment a correlation may be drawn or predicted for a given predetermined cast speed for a specific castpart, that shrinkage of a certain amount at different locations along the castpart would otherwise occur. This invention then allows for the relative movement of the mold walls (or the first side and/or second side) to counter the shrinkage, thereby providing a shrinkage control or management system.

Figure 35:
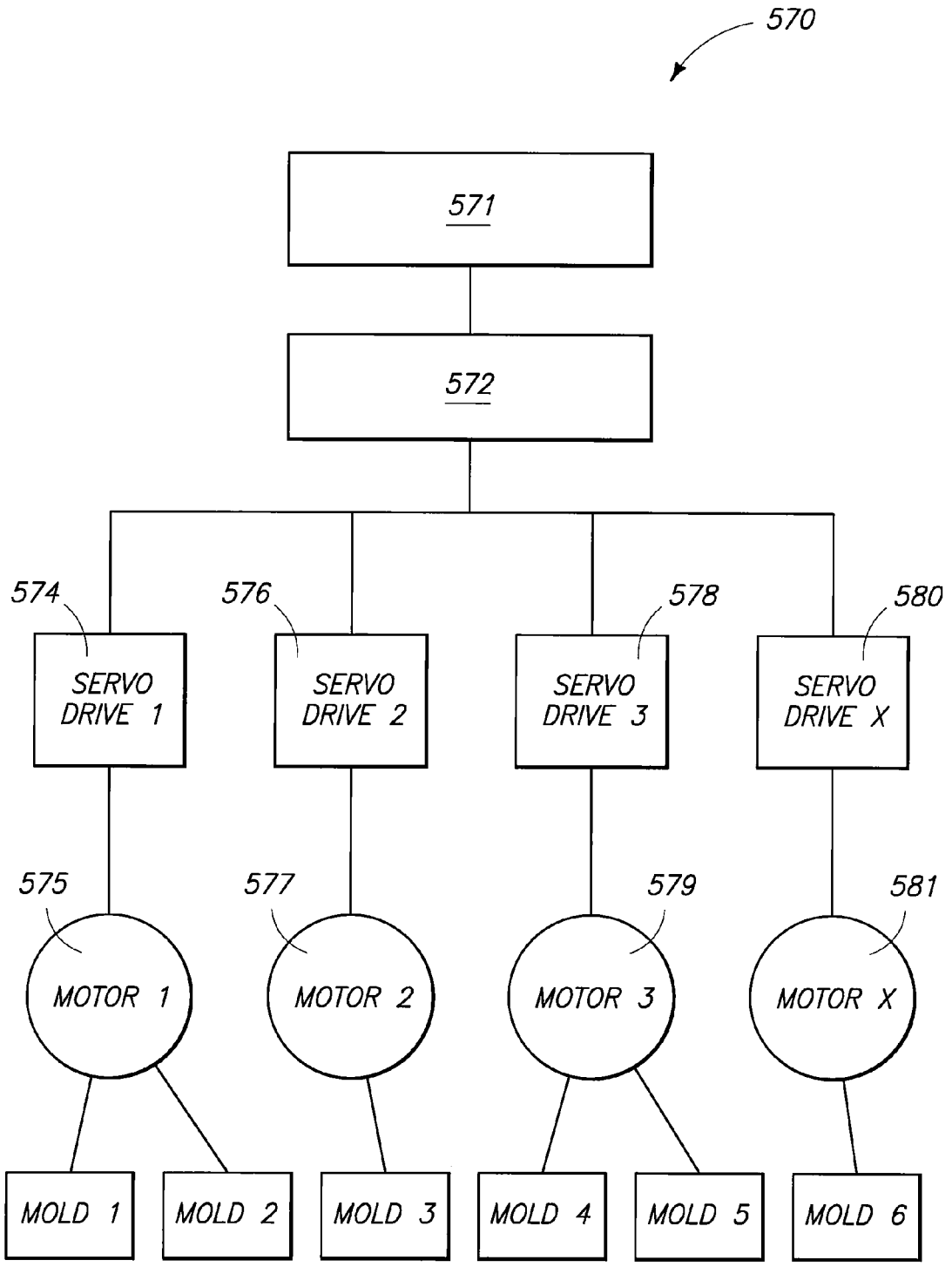
FIG. 35 is a schematic diagram of an embodiment of a control system that may be utilized to control mold side wall movement in practicing aspects of this invention.
Figure 31B:
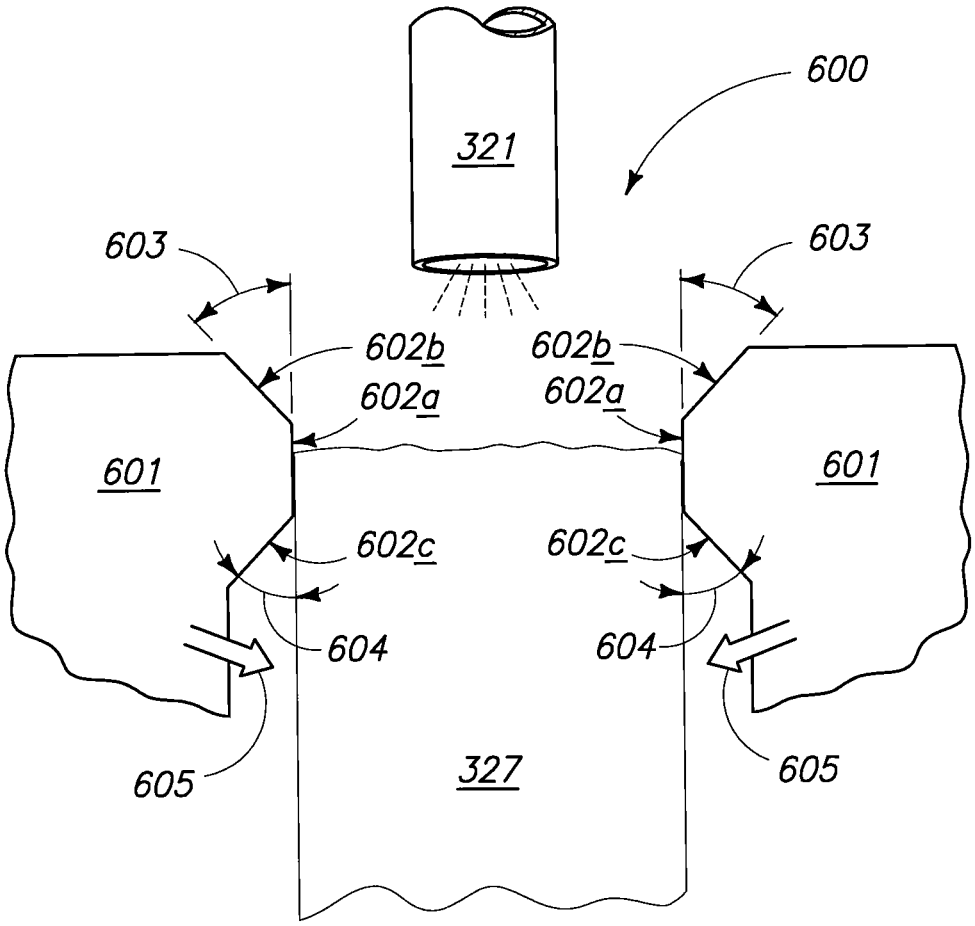
Figure 31A:
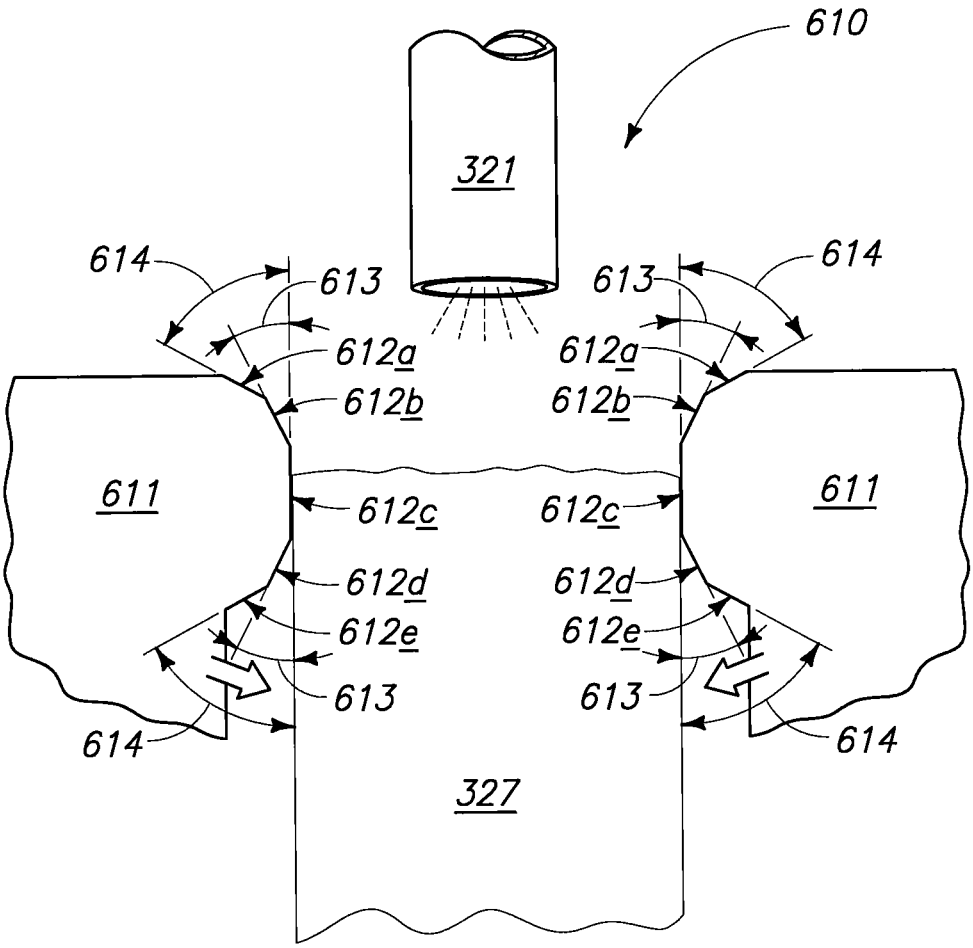
Figure 31B:
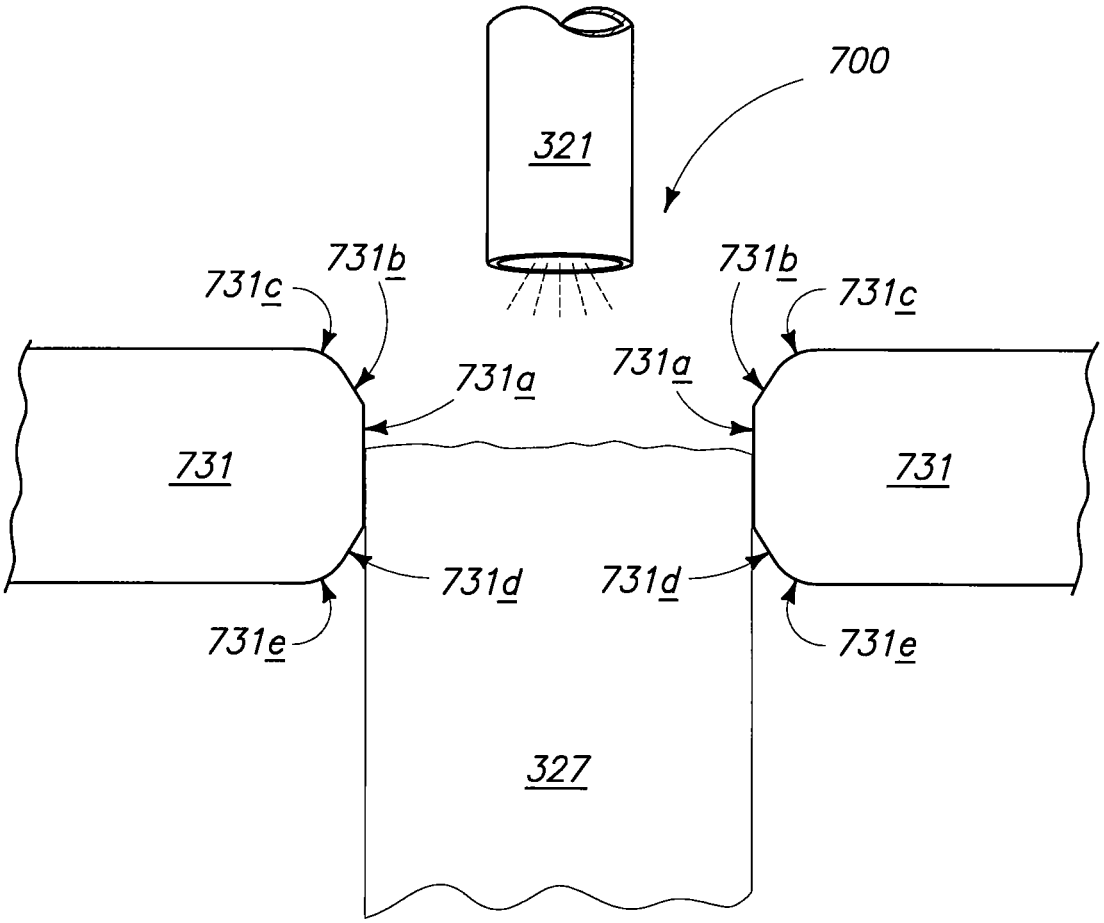
Figure 31C:
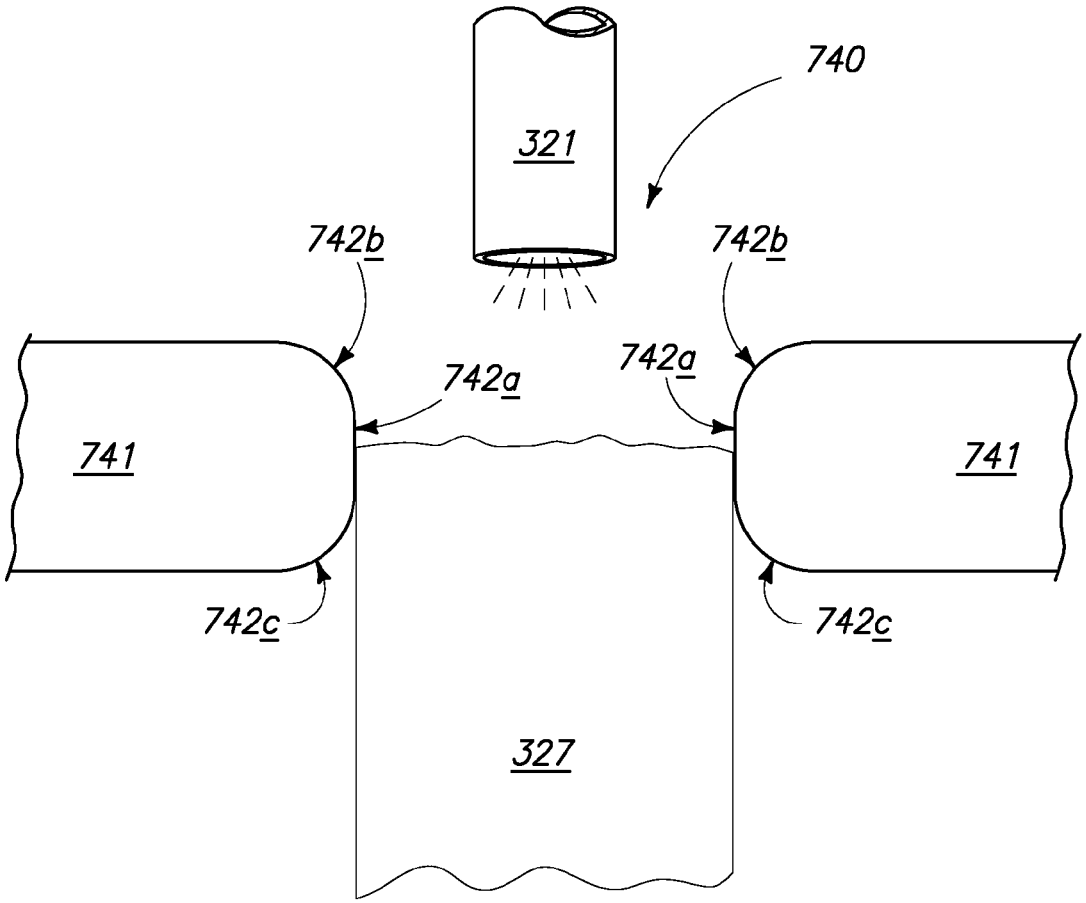

FIG. 35 is a schematic diagram of an embodiment of a control system 570 that may be utilized to control mold side wall movement in practicing aspects of this invention. FIG. 35 illustrates human machine interface ("HMI") 571, programmable logic controller ("PLC") 572 operably connected to and controlled or directed by HMI 571, first motor 575 driven and controlled by first servo drive 574, which is shown operably connected to and controlled by PLC 572, second motor 577 driven and controlled by second servo drive 576, which is shown operably connected to and controlled by PLC 572, third motor 579 driven and controlled by third servo drive 578, which is shown operably connected to and controlled by PLC 572, and fourth motor 581 driven and controlled by fourth servo drive 580, which is shown operably connected to and controlled by PLC 572. It will be noted that this is an exemplary number of components such as motors, servo drives, PLC and HMI, with no one number being required to practice this invention, nor any particular ratio of one group of like components to another.

FIG. 35 further illustrates how each of the motors may be controlling one or more molds, with no one particular number of molds controlled being required to practice this invention. FIG. 35 illustrates first motor 575 controlling two molds, second motor 577 controlling one mold, third motor 579 controlling two molds and motor X (which may represent the total number of motors) controlling one mold.

FIG. 36 is a schematic elevation representation of one configuration 600 of mold walls or casting surfaces that may be utilized in some aspects of this invention, illustrating a top casting surface 602*b*, which may also be referred to as an upper portion of the casting surface 602*b*, a middle portion 602*a* of the casting surface, and a bottom beveled surface area which is the bottom portion 602*c* of the casting surface. FIG. 36 illustrates cast part 327, coolant stream 605, mold walls 601, spout 321, bevel angle 603 for upper portion 602*b* and angle 604 for the bevel in lower portion 602*c* of the casting surface. The molten metal level is shown in the middle portion 602*a* of the casting surface.

FIGS. 37A through 37E show a number of different configurations, angles and other geometries for the upper, middle and lower portions of the casting surface on mold walls to show various applications of embodiments of this invention. It will be appreciated that no one particular configuration is required to practice the invention, but that any one of a number of different configurations may be utilized to optimize different embodiments based on different casting parameters.

FIG. 37A is a schematic elevation representation of one configuration 610 of mold walls 611 with or casting surfaces that may be utilized in some aspects of this invention. FIG. 37A illustrates such a configuration which includes two top casting surface areas 612*a* and 612*b*, two bottom casting surface areas 612*d* and 612*e*, and middle portion 612*c* of casting surface, for each mold wall 611. The first top casting surface area 612*a* is at angle 614 to the vertical, the second top casting surface area 612*b* is at angle 613 to the vertical, first bottom casting surface area 612*e* is at angle 614 to the political and second bottom casting surface area 612*d* is at angle 613 to vertical. FIG. 37A also shows cast pail 327, spout 321, and mold walls 611.

FIG. 37B is a schematic elevation representation of one configuration 700 of mold walls 731 with casting surfaces that may be utilized in some aspects of this invention, illustrating a top portion and a bottom portion that include both a linear casting surface 731*b* and a curved or arcuate casting surface 731*c*, a middle portion 731*a* of the casting surface and a lower portion of the casting surface which includes linear casting surface 731*d* and arcuate casting surface 731*e*. FIG. 37B also shows cast part 327, spout 321, and mold walls 731.

FIG. 37C is a schematic elevation representation of one configuration 740 of mold walls 741 with casting surfaces that may be utilized in some aspects of this invention, illustrating a top casting surface portion 742*b*, a bottom curved or arcuate casting surface portion 742*c*, and a middle casting surface portion 742*a*. FIG. 37C also shows cast part 327, spout 321, and mold walls 741.

Figure 37D:
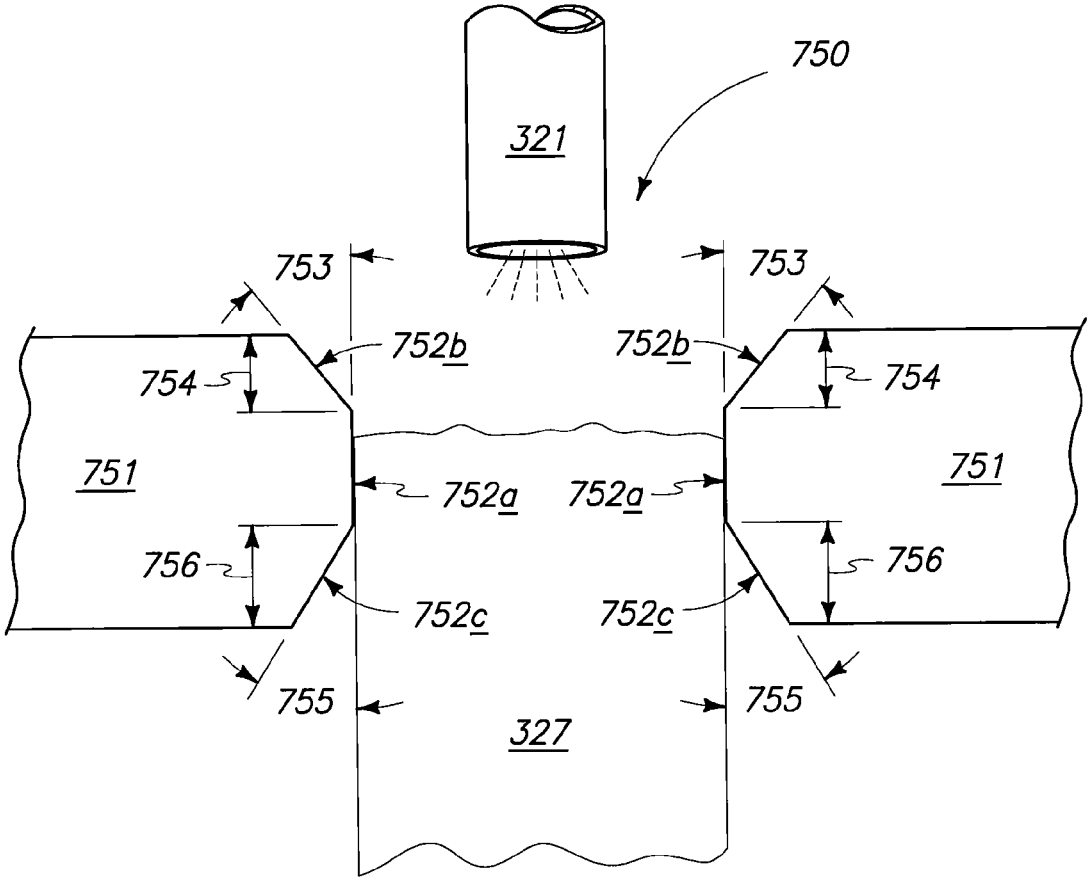
FIG. 37D is a schematic elevation representation of one configuration of mold walls or casting surfaces that may be utilized in some aspects of this invention, illustrating a top and a bottom beveled surface area on each mold wall, with the top beveled surface area having a dissimilar angle dimensions that the bottom beveled surface area.

FIG. 37D is a schematic elevation representation of one configuration 750 of mold walls 751 with casting surfaces that may be utilized in some aspects of this invention. FIG. 37D illustrates a top casting surface area 752*b* at angle 753 from vertical or from the middle casting surface area in this case because it is linear, a middle casting surface area 752*a*, and a bottom casting surface area 752*c* at angle 755 from vertical. In FIG. 37D, angle 753 is different than angle 755, and the length 754 of the beveled area at the top portion is different than the length 756 at the bottom portion of the beveled area. It should be noted that the desired cast part may be preferably configured using different configurations for the casting surface, and dissimilar configurations in angles and lengths from the top portion of the casting surface to the bottom portion of the casting surface, all within the contemplation of some aspects of this invention. FIG. 37D also shows cast part 327, spout 321, and mold walls 751.

Figure 37E:
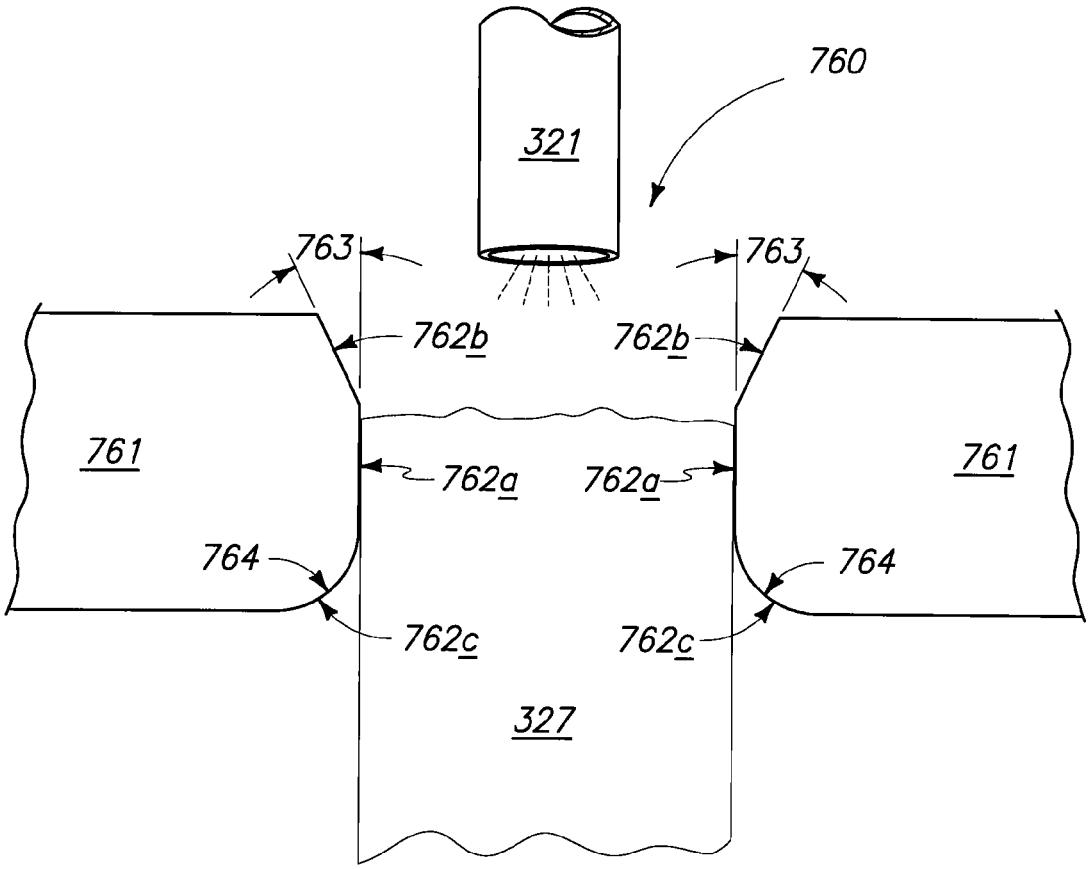
FIG. 37E is a schematic elevation representation of one configuration of mold walls or casting surfaces that may be utilized in some aspects of this invention, illustrating a top beveled surface area combined with a curved or arcuate bottom surface area on each mold wall.

FIG. 37E is a schematic elevation representation of one configuration 760 of mold walls 761 with casting surfaces that may be utilized in some aspects of this invention, illustrating a combination casting surface which includes a middle portion 762*a*, a top portion 762*b* at an angle 763 from vertical, a curved or arcuate bottom portion 762*c* with an inner radius 764. FIG. 37E also shows cast part 327, spout 321, and mold walls 761.

FIG. 38A through 38D are a series of schematic elevation representations of one configuration 620 of mold walls 621 with casting surfaces and bottom block 399, coolant stream 627, and sequentially illustrate one method wherein embodiments of this invention may be utilized in casting, with particular reference to the molten metal level and casting surface relative to the molten metal level during the casting process. The casting surfaces illustrated in FIG. 38A through 38D include middle portion 623*a*, top portion 623*b* at angle 625 from vertical, bottom portion 623*c* at angle 626 from vertical, cast part 327, molten metal spout 321. FIG. 38A through 38D further illustrate an aspect of this invention wherein the mold walls 621, or more particularly, the casting surface, may be moved vertically upward or downward in order to more effectively manage the level of molten metal relative to the casting surface and the portion of the casting surface where it is desired at that stage of casting to have the molten metal level. In order to avoid repetitiously restating each component relative to each of FIG. 38A through 38D, they will each not be repeated for each figure. Arrow 622 shows the vertical movement of the mold walls 621 which causes the vertical movement of the casting surfaces, and arrows 622*a* shows how the casting surfaces or mold walls 621 may be moved horizontally relative to the castpart.

Figure 38A:
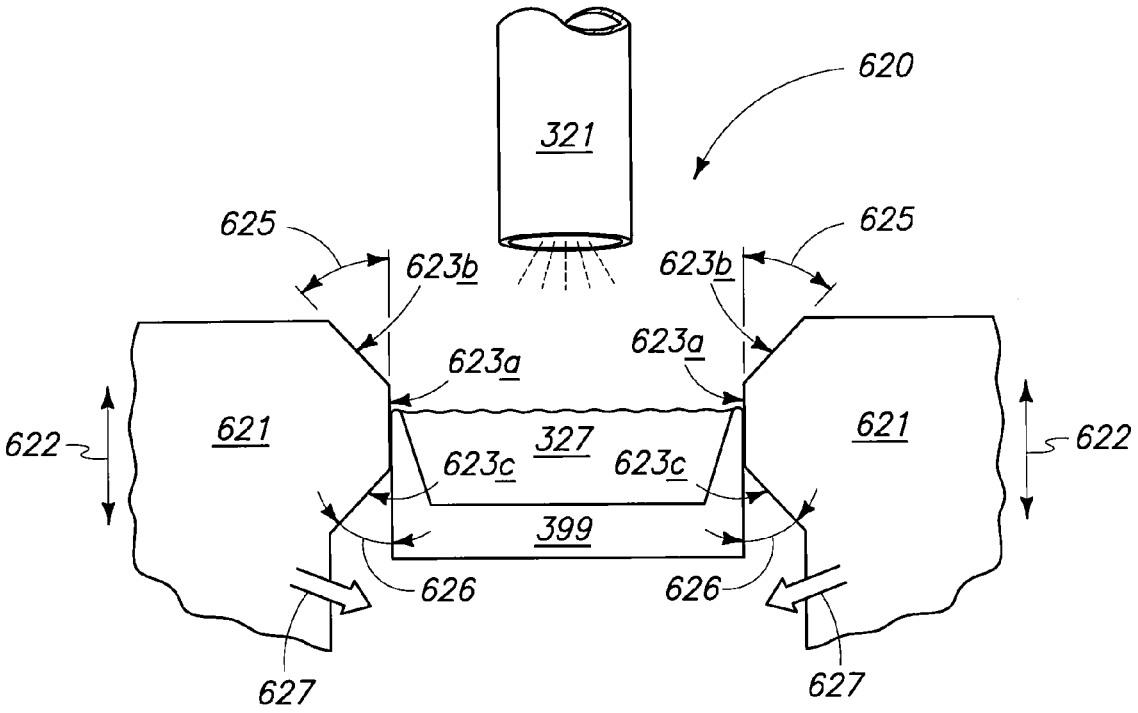
FIG. 38A is a schematic elevation representation of one configuration of mold walls or casting surfaces, at what may be the initial startup phase of casting in one embodiment of the invention, wherein the molten metal level is initially in the middle portion 623*a* of the mold walls.

FIG. 38A therefore illustrates a molten metal level in the middle portion 623*a* of the casting surface during the initial or startup phase when the starting block is filling and still at least partially located at the casting surfaces.

Figure 38B:
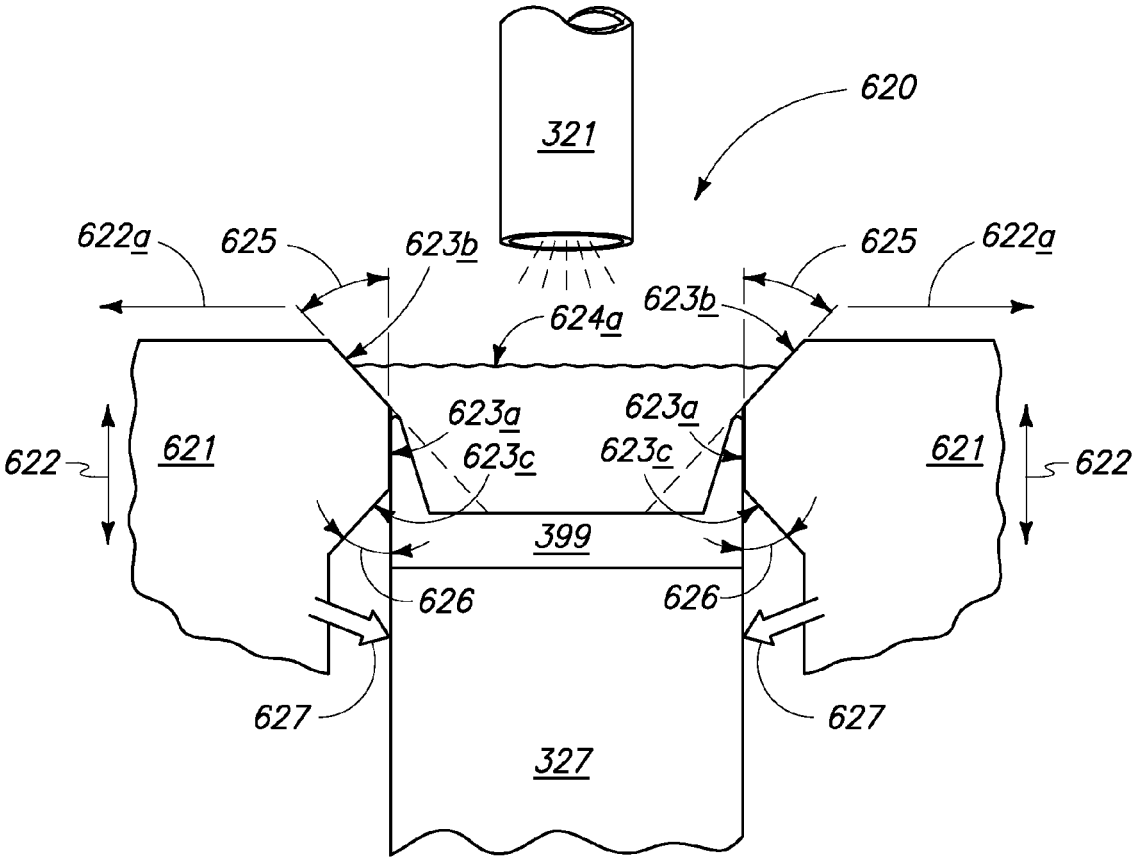
FIG. 38B is a schematic elevation representation of one configuration of mold walls or casting surfaces, at what may be a second phase of casting in one embodiment of the invention, wherein the molten metal level has been raised from that shown in FIG. 38A such that it is at the upper portion 623*b* of the mold walls.

FIG. 38B therefore illustrates a molten metal level at the top portion 623*b* of the casting surface during the next phase wherein the bottom portion of the cast part is being formed outwardly from the dimension shown in FIG. 38B. Even though it may be stated here in that the molten metal level is raised, this is relative and relative to the casting service so that the molten metal level may be raised or it might rise relative to the casting surface if the mold walls 621 are moved upwardly and/or downwardly to accomplish the relative movement.

Figure 38C:
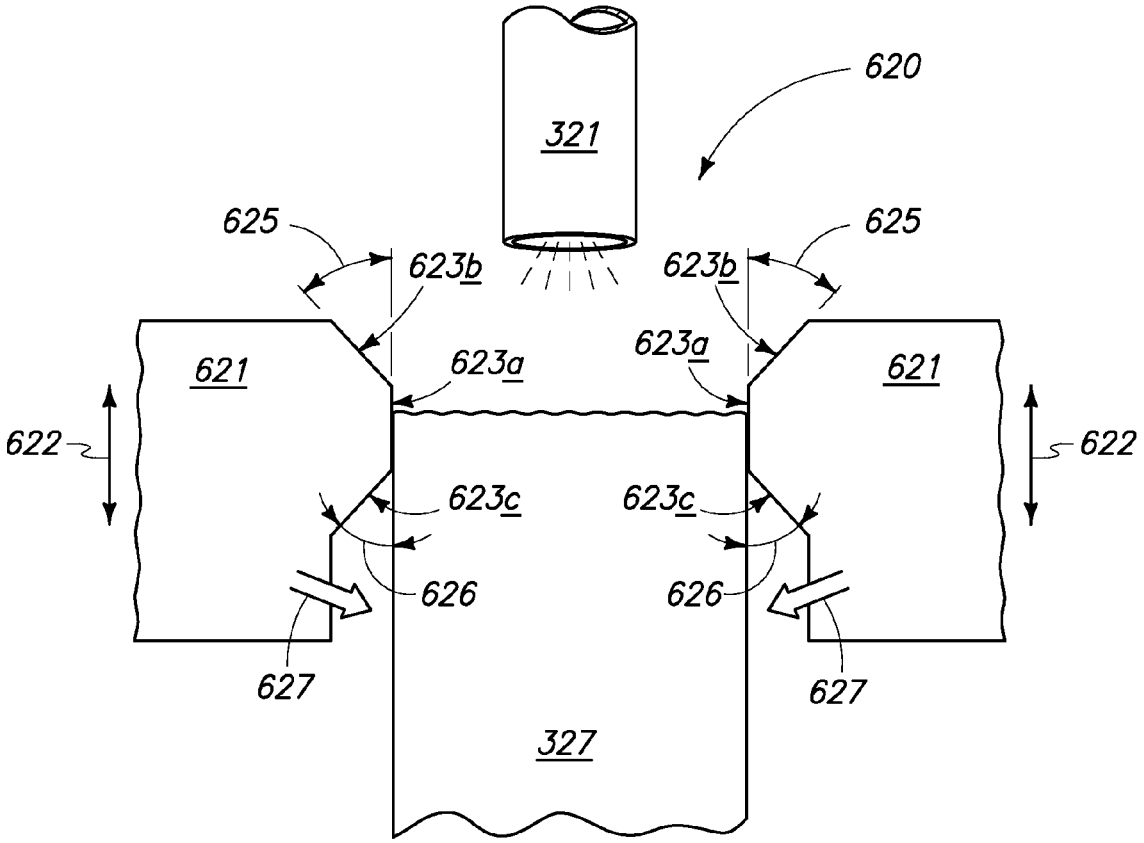
FIG. 38C is a schematic elevation representation of one configuration of mold walls or casting surfaces, at what may be a third or steady state phase of casting in one embodiment of the invention, wherein the molten metal level is at the middle portion 623*a* of the mold walls.

FIG. 38C therefore illustrates a molten metal level back in the middle portion 623*a* of the casting surface, which is a preferred location during the middle of the casting when it is referred to as steady state casting.

Figure 38D:
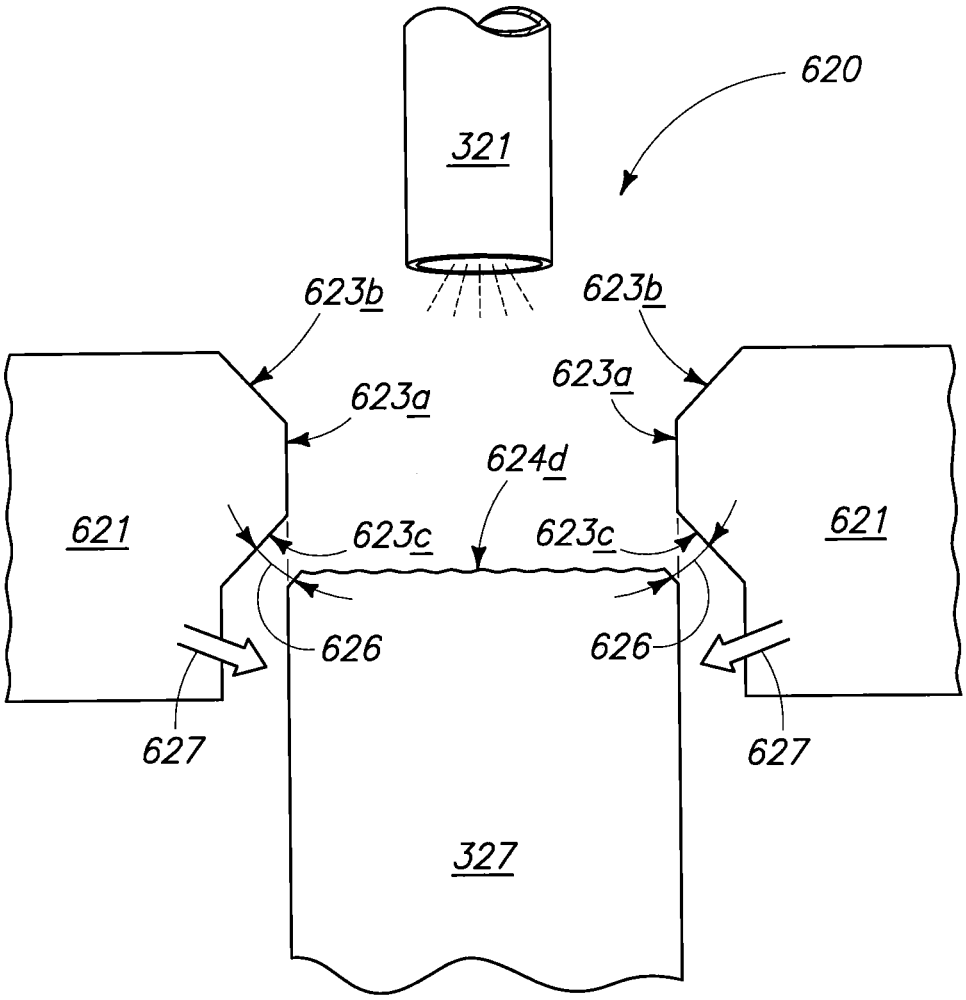
FIG. 38D is a schematic elevation representation of one configuration of mold walls or casting surfaces, at what may be a third or steady state phase of casting in one embodiment of the invention, wherein the molten metal level is at the lower portion 623*c* of the mold walls.

FIG. 38D therefore illustrates a molten metal level 624*d* at the lower portion 623*c* of the casting surface during the final phase wherein the top portion of the cast part 327 is being configured as desired, such as placing a taper in at the same approximate angle 626 that lower portion 623*c* is configured at. It is important that the molten metal level remained below the point at which the middle portion 623*a* of the casting surface intersects the lower portion 623*c* of the casting surface. This is a preferred location for the molten metal level during the last phase of casting to achieve a tapered top in the castpart 327. The angle of the resulting taper in the cast part will be approximately equal to angle 626, with allowances for tolerances and shrinkages.

Figure 39:
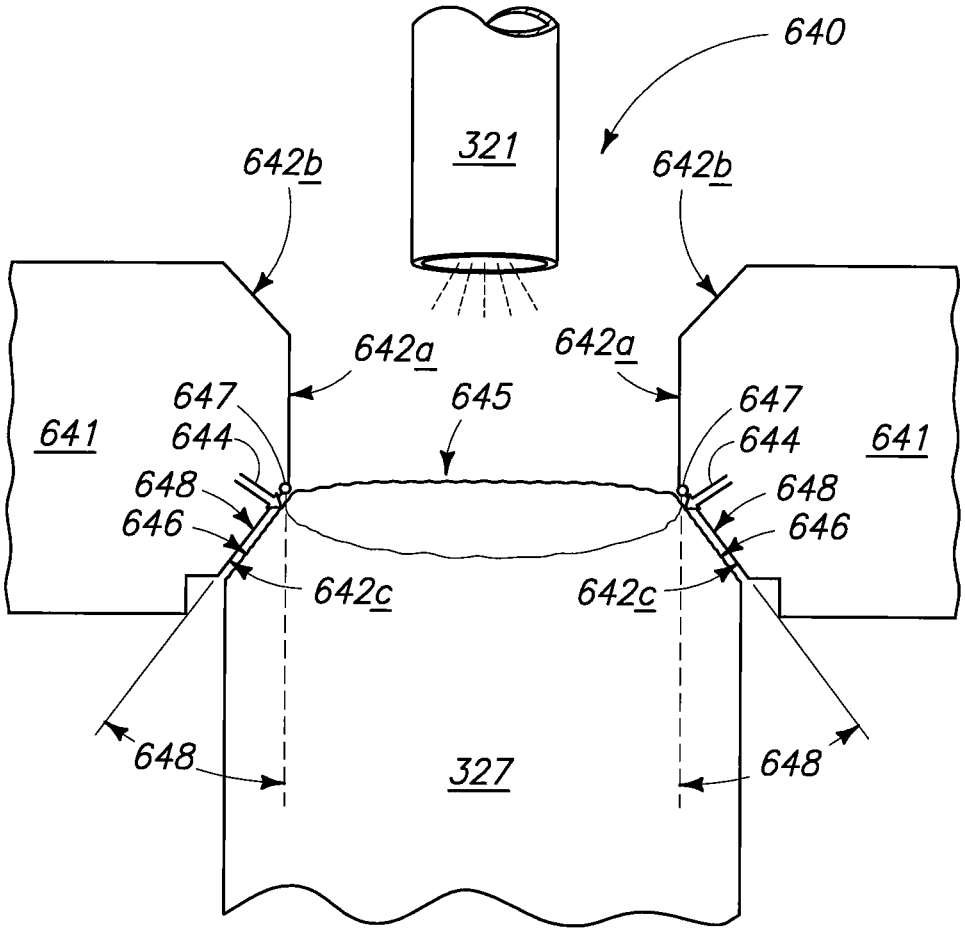
FIG. 39 is a schematic elevation representation of one configuration of mold walls or casting surfaces in one embodiment of the invention, illustrating the top portion of the castpart being formed into a taper at a pre-determined angle.

FIG. 39 is a schematic elevation representation of one configuration 640 of mold walls 641 with casting surfaces in one embodiment of the invention, illustrating a casting surface with a top portion 642*b*, a middle portion 642*a*, and a bottom portion 642*c* at angle 648 from vertical. FIG. 39 illustrates cast part 327 being formed at its top portion with a taper at a predetermined angle 648. FIG. 39 further illustrates molten metal spout 321, solidification point 647, coolant 644, molten metal surface 645 and 646.

Figure 40:
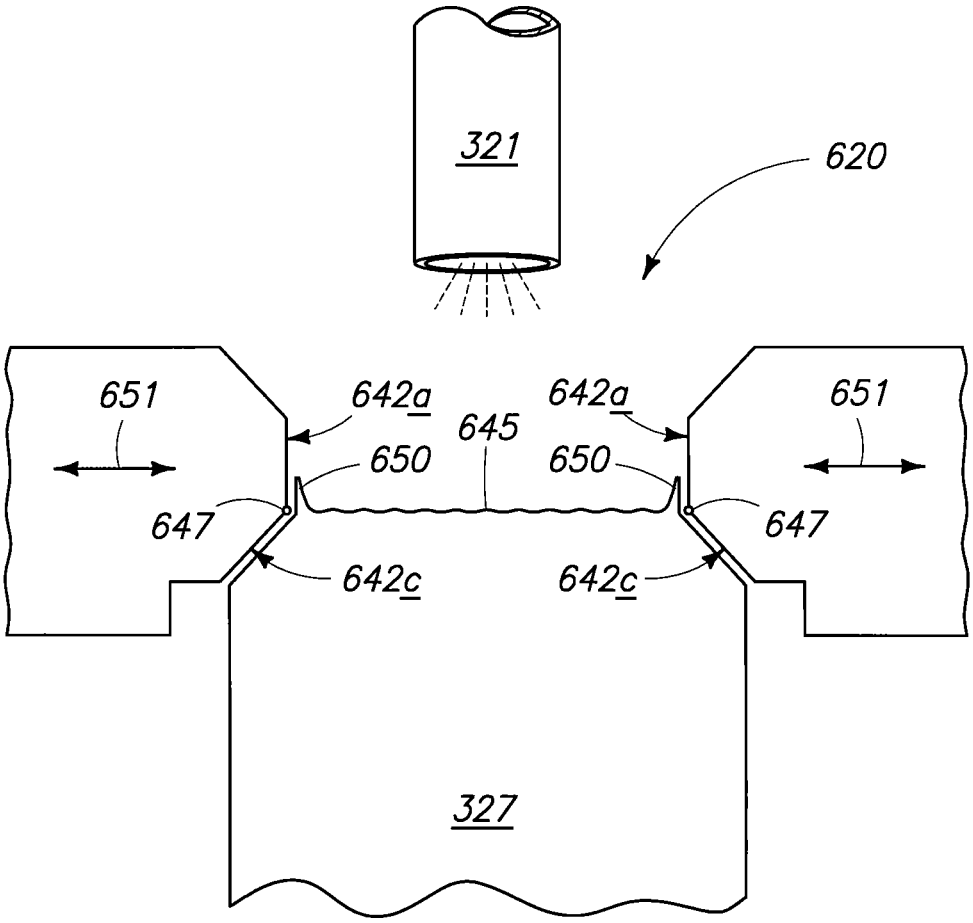
FIG. 40 is a schematic elevation representation of one configuration of mold walls or casting surfaces in one embodiment of the invention, illustrating why the molten metal level needs to be maintained in the lower portion of the mold walls to prevent metal freeze from blocking the further inward movement of mold walls in creating the top taper.

FIG. 40 is a schematic elevation representation of one configuration 620 of mold walls with middle portion 642*a* and lower portion 642*c* of casting surfaces in one embodiment of the invention. FIG. 40 illustrates how mold walls may be moved horizontally as represented by arrow 651. The solidification points 647 shows where solidification is occurring and there is a freeze area 650 which will generally happen if the molten metal level 645 is not below the corner between the two casting surfaces shown at or near solidification point 647. If the solidification occurs as freeze 650, then the mold walls and casting surface may not be moved further inwardly because the solidified metal 650 or freeze, would prevent the inward movement of mold walls or casting surface 642*a*. That is why in most embodiments of this invention during that phase of the casting, it is preferred to maintain the molten metal level 645 at or below the solidification point 647.

Figure 41:
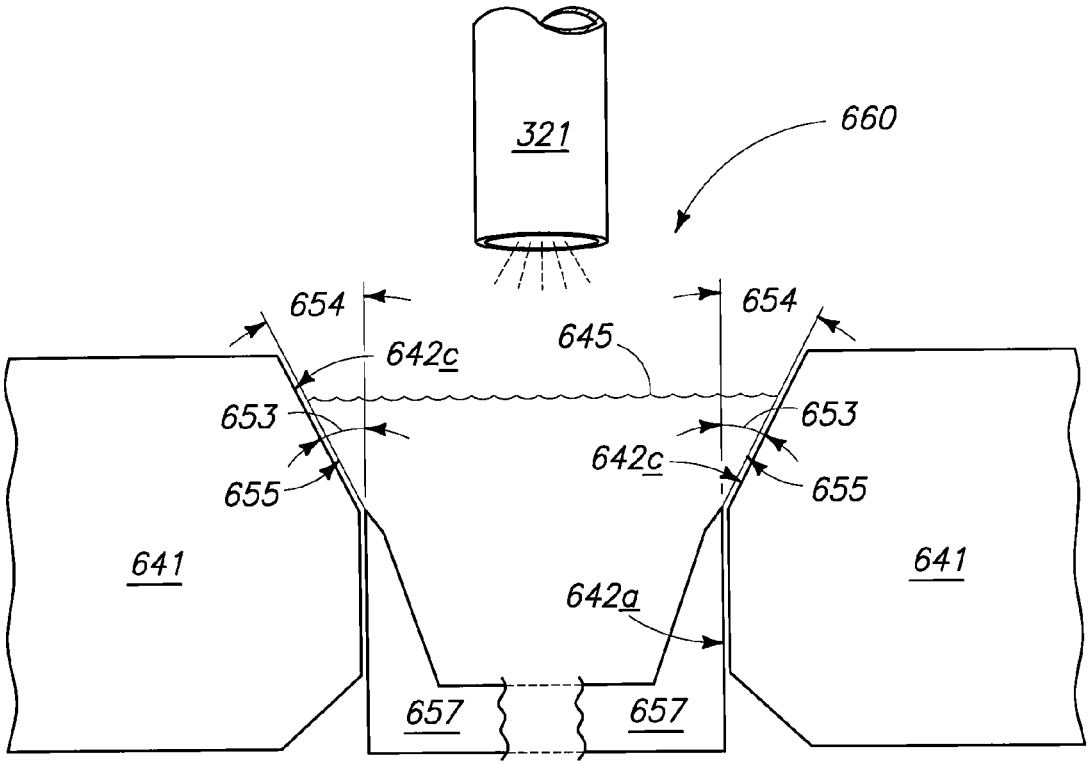
FIG. 41 is a schematic elevation representation of one configuration of mold walls or casting surfaces in one embodiment of the invention, illustrating an upper portion with a beveled surface forming a tapered castpart bottom portion in combination with the bottom block.

FIG. 41 is a schematic elevation representation of a configuration 660 of mold walls 641 or casting surfaces in one embodiment of the invention, illustrating casting surfaces including an upper portion 642*c*, which may be referred to as a beveled surface, forming a tapered castpart bottom portion 655 in combination with the bottom block 657. In this phase of the casting, mobile metal is deposited through spout 321 and molten metal level 645 is maintained on upper portion 642*c*, which is at angle 654 and 653 from vertical. FIG. 41 shows how a bottom portion of a cast part may be formed in combination by the inner cavity configuration of a bottom block 657 combined with aspects of this invention provided by movable casting surfaces and an angled casting surface for preferred results.

Figure 42:
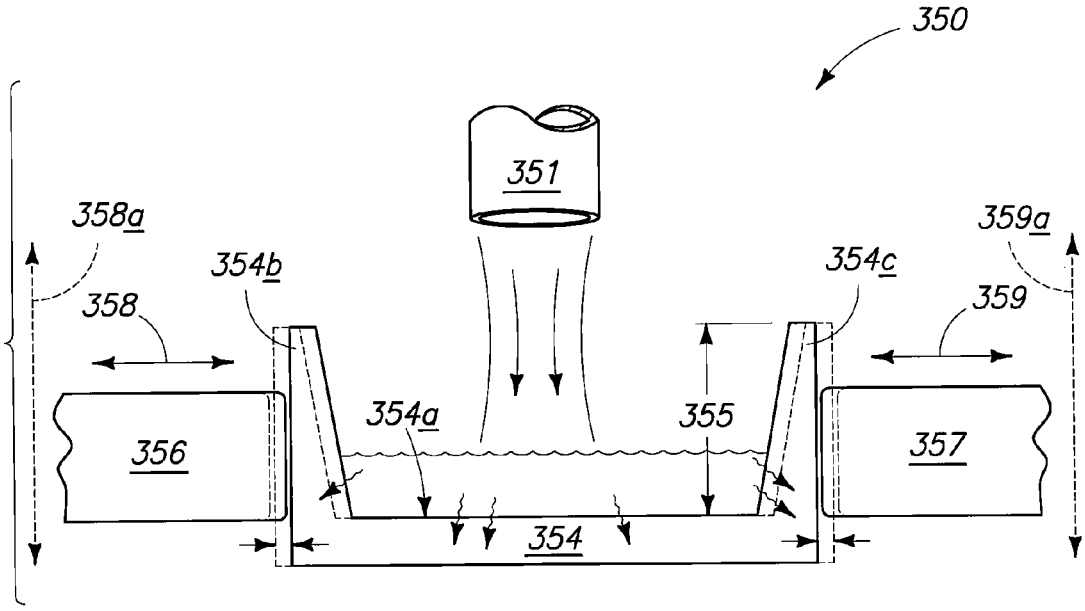
FIG. 42 is a schematic elevation representation of a mold and bottom block configuration which illustrates another feature of some embodiments of this invention, wherein the mold walls can be moved outwardly to accommodate the expansion of the bottom block on startup.

FIG. 42 is a schematic elevation representation of a mold and bottom block configuration 350 which illustrates another feature of some embodiments of this invention, wherein the mold walls 357 can be moved outwardly to accommodate the expansion of the bottom block 354 on startup. It is desirable to have a tight fit between bottom block 354 and mold walls 356 and 357. However, since prior art mold walls are not movable to accommodate the natural expansion of the metallic bottom block 354, it would be difficult to maintain the desired tolerances between mold walls 356 and 357, and the bottom block sides 354, which would likely leave the mold sham because the bottom block 354 might become enlarged and stuck within the mold cavity between mold walls 356, 357. Second bottom block identification 354B and 354C show the bottom block in its expanded condition from the heat, and arrows 358 and 359 show how mold walls 356 and 357 can be moved so that the same tight fit remains between the mold walls and the bottom block, but the bottom block is met expand sets that get stuck between the mold walls. In this case the bottom block height 355 is measured from the bottom surface 354*a* and the top of bottom block walls 354*b* and 354*c*. Arrows 358*a* and 359*a* show how mold walls 356 and 357 may be moved vertically.

As will be appreciated by those of reasonable skill in the art, there are numerous embodiments to this invention, and variations of elements and components which may be used, all within the scope of this invention.

One embodiment of this invention, for example, a molten metal mold is provided which comprises: a mold cavity framework including a first side, a second side opposite the first side, a third side, and a fourth side opposite the third side, each side including an inner surface and the inner surfaces defining a mold cavity; and wherein the first side is movably mounted relative to the second side.

Further embodiments from that disclosed in the preceding paragraph may include: a molten metal mold further wherein the second side is movably mounted relative to the first side; a molten metal mold further wherein the first side moves linearly relative to the second side; a molten metal mold further wherein the first side is pivotally mounted; and/or a molten metal mold further wherein pivotal movement of the first side relative to the mold cavity framework alters the defined mold cavity. In further aspects, the movement of the first side and the second side may be asynchronous.

In another embodiment, a vertical molten metal mold casting system may be provided which comprises: a mold cavity framework including a first side, a second side opposite the first side, a third side, and a fourth side opposite the third side, each side including an inner surface and wherein the inner surfaces define a mold cavity; wherein the first side and second side are movably mounted relative to one another; and a bottom block configured to fit within the mold cavity at startup of the mold casting system.

Further embodiments from that disclosed in the preceding paragraph may include: a vertical molten metal mold casting system further wherein the first side and second side move linearly relative to one another; a vertical molten metal mold casting system further wherein the first side and second side are pivotally mounted for movement relative to one another; a vertical molten metal mold casting system wherein the bottom block includes two sidewalls and further wherein the third side and the fourth side of the mold cavity framework combined with the two sidewalls of the bottom block to define the mold cavity on startup; a vertical molten metal mold casting system wherein the bottom block includes an internal cooling apparatus; and/or a vertical molten metal mold casting system further wherein the bottom block is configured for vertical movement within the mold cavity during startup to control a spout to bottom block distance during startup casting.

In another embodiment of the invention, a method for vertical direct chill molten metal casting is provided comprising: providing a mold cavity framework with a first side and a second side opposite the first side, a third side and a fourth side opposite the third side, with inner surfaces of the first side, second side, third side and fourth side defining a mold cavity disposed to receive molten metal; providing a vertically movable bottom block configured relative to the mold cavity to contain molten metal entering the mold cavity upon startup; providing molten metal to the mold cavity; moving the bottom block downward at a predetermined rate; and moving the first side and the second side of the mold cavity framework relative to one another during casting and thereby varying dimensions of a resulting castpart during casting.

Further embodiments from that disclosed in the preceding paragraph may include: a method for vertical direct chill molten metal casting, and further wherein the first side and second side are moved linearly relative to one another; a method for vertical direct chill molten metal casting, and further wherein the first side and second side are moved asymmetrically relative to one another; a method for vertical direct chill molten metal casting, and further wherein the first side and the second side are pivotally mounted relative to the mold cavity framework such that pivotal movement of the first side and the second side alter the defined mold cavity; and/or a method for vertical direct chill molten metal casting, and further wherein the moving of the first side and the second side are at the same approximate rate.

Still further embodiments of that disclosed in the second preceding paragraph may include: a method for vertical direct chill molten metal casting and further wherein moving the first side and the second side of the mold cavity framework relative to one another during casting further comprises moving the first side and the second side away from each other at an early portion of the casting after startup, to provide an increasing cross-section of the castpart from its bottom portion; and/or a method for vertical direct chill molten metal casting wherein moving the first side and the second side of the mold cavity framework relative to one another during casting further comprises: moving the first side and the second side toward one another at an end portion of the casting to provide a decreasing cross-section of the castpart at its top portion. These embodiments may be further wherein moving the first side and the second side of the mold cavity framework relative to one another during casting further comprises: moving the first side and the second side toward one another at an end portion of the casting to provide a decreasing cross-section of the castpart at its top portion. The increasing cross-section of the castpart from its bottom portion provides a taper on the bottom portion of the castpart may for example be at an angle in the range of 22 degrees to 29 degrees; and/or the increasing cross-section of the castpart from its top portion provides a taper on the top portion of the castpart may be at an angle in the range of 22 degrees to 29 degrees.

In further method embodiments of method for vertical direct chill molten metal casting as set forth above, the moving of the first side and the second side of the mold cavity framework relative to one another during casting produces a castpart with a larger cross-section in a middle portion than the bottom block; and/or produces a castpart with a larger cross-section in its middle portion than at its bottom portion and top portion.

In yet another embodiment of the invention, a molten metal mold is provided which comprises: a mold cavity framework including a first side, a second side opposite the first side and spaced apart from the first side by a variable distance, a third side, and a fourth side opposite the third side, each side including an inner surface and the inner surfaces defining a mold cavity; and wherein the mold cavity framework is alternatively configurable to cast a first castpart with a first thickness and to cast a second castpart with a second thickness.

In still another embodiment of the invention, a method for vertical direct chill molten metal casting comprising: providing a mold cavity framework with a first side and a second side opposite the first side and spaced apart from the first side by a variable distance, a third side and a fourth side opposite the third side, with inner surfaces of the first side, second side, third side and fourth side defining a mold cavity disposed to receive molten metal; providing a vertically movable bottom block configured relative to the mold cavity to contain molten metal entering the mold cavity upon startup; providing molten metal to the mold cavity; casting a first castpart of a first thickness; and moving the first side and the second side of the mold cavity framework relative to one another; and casting a second castpart of a second thickness different than the first thickness.

In a still further embodiment of the invention, a molten metal mold may be provided which comprises: a mold framework; a mold operative connected to the mold framework, the mold being comprised of: a first side movably mounted relative to the mold framework; a second side opposite the first side and movably mounted to the mold framework; a third side; a fourth side opposite the third side; wherein each side includes an inner surface and the inner surfaces define a mold cavity; a first motor operatively connected to the first side and configured to move the first side relative to the mold framework; a second motor operatively connected to the second side and configured to move the second side relative to the mold framework; and a programmable logic controller operatively connected to and controlling the first motor and the second motor to control predetermined movement of the first side and the second side of the mold.

Further embodiments from that disclosed in the preceding paragraph may include: a molten metal mold and further wherein the first motor and the second motor are servo motors; and/or a molten metal mold further comprising a human user interface operatively attached to the programmable logic controller.

In another method embodiment, a method to optimize the rolling surfaces of a castpart produced during continuous molten metal casting may be provided which comprises: providing a mold cavity framework with a first side and a second side opposite the first side, a third side and a fourth side opposite the third side, with inner surfaces of the first side, second side, third side and fourth side defining a mold cavity disposed to receive molten metal; providing a vertically movable bottom block configured relative to the mold cavity to contain molten metal entering the mold cavity upon startup; providing molten metal to the mold cavity; moving the bottom block downward at a predetermined cast speed; and moving the first side and the second side of the mold cavity framework in a predetermined way relative to one another during casting to optimize the castpart configuration for later operations. A possible further embodiment of this may be wherein moving the first side and the second side of the mold cavity is to at least substantially offset predicted shrinkage during casting at the predetermined cast speed.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A method for vertical direct chill molten metal casting comprising:

providing a mold cavity framework with a rigid first side and a rigid second side opposite the first side, a third side and a fourth side opposite the third side, with inner surfaces of the first side, second side, third side and fourth side defining a mold cavity disposed to receive molten metal;

providing a vertically movable bottom block configured relative to the mold cavity to contain molten metal entering the mold cavity upon startup;

providing molten metal to the mold cavity;

moving the bottom block downward at a predetermined rate;

providing a programmable logic controller that controls the movement of the first side such that the movement of the first side is correlated to a level of the molten metal surface relative to an upper portion or a lower portion of the first side; and moving the first side and the second side of the mold cavity framework relative to one another during casting and thereby varying dimensions of a resulting castpart during casting while maintaining the level of the molten metal surface at a predetermined location relative to the mold cavity framework such that the level of the molten metal top surface moves from a level at a middle portion or upper portion of the first side to the lower portion of the first side and the second side during an inward movement of the first side and second side, to impart an inward taper on a top portion of the resulting castpart.

2. A method for vertical direct chill molten metal casting as recited in claim 1, and further wherein the first side and second side are moved linearly relative to one another.

3. A method for vertical direct chill molten metal casting as recited in claim 1, and further wherein the first side and second side are moved asymmetrically relative to one another.

4. A method for vertical direct chill molten metal casting as recited in claim 1, and further wherein the first side and the second side are pivotally mounted relative to the mold cavity framework such that pivotal movement of the first side and the second side alter the defined mold cavity.

5. A method for vertical direct chill molten metal casting as recited in claim 1, and further wherein the moving of the first side and the second side are at the same approximate rate.

6. A method for vertical direct chill molten metal casting as recited in claim 1, and wherein moving the first side and the second side of the mold cavity framework relative to one another during casting further comprises:

moving the first side and the second side away from each other at an early portion of the casting after startup, to provide an increasing cross-section of the castpart from its bottom portion.

7. A method for vertical direct chill molten metal casting as recited in claim 6, and wherein moving the first side and the second side of the mold cavity framework relative to one another during casting further comprises:

moving the first side and the second side toward one another at an end portion of the casting to provide a decreasing cross-section of the castpart at its top portion.

8. A method for vertical direct chill molten metal casting as recited in claim 6, and further wherein the increasing cross-section of the castpart from its bottom portion provides a taper on the bottom portion of the castpart at an angle in the range of 22 degrees to 29 degrees.

9. A method for vertical direct chill molten metal casting as recited in claim 1, and wherein moving the first side and the second side of the mold cavity framework relative to one another during casting further comprises:

moving the first side and the second side toward one another at an end portion of the casting to provide a decreasing cross-section of the castpart at its top portion.

10. A method for vertical direct chill molten metal casting as recited in claim 9, and further wherein the increasing cross-section of the castpart from its top portion provides a taper on the top portion of the castpart at an angle in the range of 22 degrees to 29 degrees.

11. A method for vertical direct chill molten metal casting as recited in claim 1, and further wherein the moving of the first side and the second side of the mold cavity framework relative to one another during casting produces a castpart with a larger cross-section in a middle portion than the bottom block.

12. A method for vertical direct chill molten metal casting as recited in claim 1, and further wherein the moving of the first side and the second side of the mold cavity framework relative to one another during casting produces a castpart with a larger cross-section in its middle portion than at its bottom portion and top portion.

13. A method for vertical direct chill molten metal casting as recited in claim 1, and further wherein the programmable logic controller is further configured to move the first and second side walls toward one another at a later phase of casting to move the molten metal top surface level from a level at a middle portion or upper portion of the first side to a level in the lower portion of the inner surfaces of the first side and second side in the mold cavity during the moving of the first and second side walls toward one another; and wherein the mold cavity framework is alternatively configurable to cast a first castpart with a first thickness and to cast a second castpart with a second thickness.

14. A method for vertical direct chill molten metal casting comprising:

providing a mold cavity framework with a rigid first side and a rigid second side opposite the first side and spaced apart from the first side by a variable distance, a third side and a fourth side opposite the third side, with inner surfaces of the first side, second side, third side and fourth side defining a mold cavity disposed to receive molten metal;

providing a vertically movable bottom block configured relative to the mold cavity to contain molten metal entering the mold cavity upon startup;

providing molten metal to the mold cavity, the molten metal having a molten metal top surface;

casting a first castpart of a first thickness while maintaining the level of the molten metal top surface at a predetermined vertical location relative to the inner surfaces of the mold cavity; and moving the first side and the second side of the mold cavity framework relative to one another; and casting a second castpart of a second thickness different than the first thickness while maintaining the level of the molten metal top surface at a predetermined vertical location relative to the inner surfaces of the mold cavity.

15. A method to optimize rolling surfaces of a castpart produced during continuous molten metal casting, comprising:

providing a mold cavity framework with a rigid first side and a rigid second side opposite the first side, a third side and a fourth side opposite the third side, with inner surfaces of the first side, second side, third side and fourth side defining a mold cavity disposed to receive molten metal;

providing a vertically movable bottom block configured relative to the mold cavity to contain molten metal entering the mold cavity upon startup;

providing molten metal to the mold cavity, the molten metal having a molten metal top surface;

moving the bottom block downward at a predetermined cast speed;

providing a programmable logic controller operatively connected to and controlling the vertical movement of the bottom block and controlling the movement of the first side and the second side of the mold;

controlling the movement of the first side and the second side such that the movement is correlated to a predetermined first vertical location and then in a second vertical location of the molten metal top surface in either an upper portion or a lower portion of the first side; and moving the first side and the second side of the mold cavity framework in a predetermined way relative to one another during casting to optimize the castpart configuration for later operations.

16. A method to optimize rolling surfaces of a castpart produced during continuous molten metal casting as recited in claim 15, and further wherein moving the first side and the second side of the mold cavity is to at least substantially offset predicted shrinkage during casting at the predetermined cast speed.

17. A process for molding molten metal as recited in claim 15, and further wherein the moving the first side and the second side of the mold cavity framework are at the same approximate rate of movement.

18. A method for vertical direct chill molten metal casting as recited in claim 15, and further wherein the moving of the first side and the second side of the mold cavity framework relative to one another during casting causes variable dimensions of a resulting castpart during casting, while maintaining the level of the molten metal surface at a predetermined location relative to the mold cavity framework such that the level of the molten metal top surface moves from a level at a middle portion or upper portion of the first side to the lower portion of the first side and the second side during an inward movement of the first side and second side, to impart an inward taper on a top portion of the resulting castpart.

19. A process for molding molten metal comprising the following:

providing a mold cavity framework including a rigid first side, a second side opposite the first side, a third side, and a fourth side opposite the third side, each side including an inner surface and the inner surfaces defining a mold cavity, and wherein the first side is movably mounted relative to the second side;

providing the inner surfaces of the first side and second side have a lower portion with a linear or an arcuate surface which slopes downwardly and outwardly introducing a flow of molten metal into the mold cavity, the molten metal having a molten metal top surface;

controlling the movement of the first side of the mold cavity framework and the flow of molten metal into the mold cavity such that the movement of the first side is correlated to maintain the molten metal top surface at a predetermined first vertical location in the first side and then in a second vertical location in the lower portion of the first side in creating a taper on an upper portion of an emerging castpart.

20. A process for molding molten metal comprising the following:

providing a mold cavity framework including a rigid first side, a rigid second side opposite the first side, a third side, and a fourth side opposite the third side, each side including an inner surface and the inner surfaces defining a mold cavity, and wherein the first side is movably mounted relative to the second side;

providing the inner surfaces of the first side and second side have an upper portion with a linear or an arcuate surface which slopes upwardly and inwardly;

introducing a flow of molten metal into the mold cavity during casting, the molten metal having a molten metal top surface; and controlling the movement of the first side of the mold cavity framework and the flow of molten metal into the mold cavity such that the movement of the first side is correlated to maintain the molten metal top surface at a predetermined first vertical location in the first side and then in a second vertical location in the upper portion of the first side, in creating a taper on a lower portion of an emerging castpart.

* * * * *